US008317283B2

(12) United States Patent
Makuta et al.

(10) Patent No.: US 8,317,283 B2
(45) Date of Patent: Nov. 27, 2012

(54) IMAGE FORMING APPARATUS, IMAGE FORMING METHOD, REMOTE MONITORING SYSTEM, AND METHOD OF PROVIDING MAINTENANCE SERVICE

(75) Inventors: Toshiyuki Makuta, Kanagawa-ken (JP); Yoshiaki Inoue, Kanagawa-ken (JP); Hirofumi Saita, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 343 days.

(21) Appl. No.: 12/647,172

(22) Filed: Dec. 24, 2009

(65) Prior Publication Data

US 2010/0165022 A1 Jul. 1, 2010

(30) Foreign Application Priority Data

Dec. 26, 2008 (JP) ..... 2008-334855

(51) Int. Cl.
*B41J 29/38* (2006.01)

(52) U.S. Cl. ..... 347/9

(58) Field of Classification Search ..... 347/9, 14, 347/19, 33

See application file for complete search history.

(56) References Cited

U.S. PATENT DOCUMENTS

| | | | | |
|---|---|---|---|---|
| 5,353,052 | A | 10/1994 | Suzuki et al. | |
| 5,627,572 | A * | 5/1997 | Harrington et al. | 347/23 |
| 6,000,776 | A | 12/1999 | Suzuki et al. | |
| 6,257,716 | B1 | 7/2001 | Yanagawa et al. | |
| 6,341,854 | B1 | 1/2002 | Takemoto | |
| 7,484,824 | B2 * | 2/2009 | Chiwata | 347/19 |
| 8,057,007 | B2 * | 11/2011 | Sasayama | 347/19 |
| 2001/0003458 | A1 | 6/2001 | Shioya | |
| 2001/0038409 | A1 | 11/2001 | Yanagawa et al. | |
| 2006/0214960 | A1 | 9/2006 | Chiwata | |
| 2006/0262151 | A1 | 11/2006 | Chiwata | |
| 2007/0229578 | A1 | 10/2007 | Yokozawa et al. | |

FOREIGN PATENT DOCUMENTS

| | | | |
|---|---|---|---|
| EP | 1035466 | A2 | 9/2000 |
| JP | 4-28555 | A | 1/1992 |
| JP | 4-39041 | A | 2/1992 |

(Continued)

OTHER PUBLICATIONS

Japanese Office Action for corresponding Application No. JP 2008-334855, dated Sep. 14, 2012, and English-language translation thereof.

*Primary Examiner* — An Do
(74) *Attorney, Agent, or Firm* — Birch, Stewart, Kolasch & Birch, LLP

(57) ABSTRACT

An image forming apparatus includes: a recording head which has a plurality of nozzles for ejecting an ink onto a recording medium; a movement device which causes relative movement between the recording head and the recording medium; an image forming controller which controls the recording head according to image data in such a manner that an image corresponding to the image data is formed on the recording medium; an ejection abnormality detection device which detects ejection abnormality including at least one of non-ejection and ejection direction deviation of the plurality of nozzles; a compensation device which compensates an image defect caused by the ejection abnormality; and a determination device which determines whether or not the head is in a state where the compensation device can compensate the image defect, according to detection result of the ejection abnormality detection device.

48 Claims, 22 Drawing Sheets

FOREIGN PATENT DOCUMENTS

| | | | |
|---|---|---|---|
| JP | 9-151342 | A | 6/1997 |
| JP | 10-25440 | A | 1/1998 |
| JP | 10-140065 | A | 5/1998 |
| JP | 11-43636 | A | 2/1999 |
| JP | 11-172180 | A | 6/1999 |
| JP | 11-188858 | A | 7/1999 |
| JP | 11-209672 | A | 8/1999 |
| JP | 2000-37942 | A | 2/2000 |
| JP | 2000-272116 | A | 10/2000 |
| JP | 2001-162784 | A | 6/2001 |
| JP | 2001-181549 | A | 7/2001 |
| JP | 2001-247787 | A | 9/2001 |
| JP | 2002-88294 | A | 3/2002 |
| JP | 2003-145740 | A | 5/2003 |
| JP | 2004-10633 | A | 1/2004 |
| JP | 2005-67191 | A | 3/2005 |
| JP | 2006-264069 | A | 10/2006 |
| JP | 2006-347164 | A | 12/2006 |
| JP | 2007-290352 | A | 11/2007 |
| JP | 2008-080632 | A | 4/2008 |
| JP | 2008-213333 | A | 9/2008 |

* cited by examiner

IMAGE FORMING APPARATUS, IMAGE FORMING METHOD, REMOTE MONITORING SYSTEM, AND METHOD OF PROVIDING MAINTENANCE SERVICE

BACKGROUND OF THE INVENTION

1. Field of the Invention

The present invention relates to an image forming apparatus and an image forming method, and more particularly to an image forming method and an image forming apparatus for recording an image on a recording medium by ejecting ink droplets from an inkjet head, and to a remote monitoring system using same.

2. Description of the Related Art

In recent years, there have been increasing demands for short print runs involving a small number of copies in the field of commercial printing. In an offset printing method which has been used conventionally, it has been necessary to create a plate, and hence this is an obstacle in terms of both time and cost when performing a short print run. On the other hand, an electrophotographic method can be cited as an on-demand printing method in which a plate is not created. However, with this method, there are apprehensions that running costs are high and productivity is low.

A recording method using inkjet technology can be cited as a method which is able to resolve the apprehensions described above. An inkjet method is inexpensive compared to an electrophotographic method and also has higher productivity. Inkjet recording systems are used widely both in domestic printing for individual use and office printers for commercial use.

However, when an apparatus is used for printing, it would be better off having a capability to able to handle printing papers, such as coated paper, but with printing paper of this kind, the permeation of the ink is slow and therefore when recording with an inkjet system, a problem of bleeding (landing interference) occurs in that when droplets are ejected to form mutually overlapping adjacent dots in a continuous fashion, the ink droplets on the recording medium combine together due to their surface tension, making it impossible to form the desired dots. In the case of dots of the same color, the dot shape is disturbed and in the case of dots of different colors, an additional problem of color mixing occurs.

In order to suppress bleeding as described above, various methods haven been described hitherto (Japanese Patent Application Publication No. 11-188858, Japanese Patent Application Publication No. 2000-037942, Japanese Patent Application Publication No. 2004-10633, Japanese Patent Application Publication No. 4-39041, and the like). In Japanese Patent Application Publication No. 11-188858, it is made possible to rapidly stop bleeding in a permeable recording medium by depositing a powder layer (water-soluble resin) which can swell, increase in viscosity and separate by reaction with ink on an intermediate transfer medium. However, with this method, there are the following problems.

(1) Since the coloring material in the ink is not aggregated actively, then when ink droplets are ejected at a fast rate of 10 kHz or above, the swelling and viscosity raising actions do not occur quickly enough and the landing interference described above still occurs.

(2) Since the transferred image forming layer swells as the ink solvent is absorbed, then the thickness of the image portion increases, giving rise to an additional problem of "pile height". If the image thickness becomes large, then not only is there a problem of image quality due to the change in appearance at the boundaries between a printed region and a non-printed region, there is also a problem in that a step difference will be noticeable when these boundaries portions are touched.

(3) Since the ink solvent is absorbed in the transferred image forming layer, this ink solvent bleeds out onto the surface of the paper after transfer and gives rise to deformation of the paper (so-called "cockling").

(4) Since an intermediate transfer body is used, the system is complex.

Problems (2) and (3) described above both occur because the final image is formed on the recording medium (paper) while still containing ink solvent.

Furthermore, Japanese Patent Application Publication No. 2000-037942 and Japanese Patent Application Publication No. 2004-10633, and the like, disclose a method of avoiding bleeding by using an aggregating reaction. Japanese Patent Application Publication No. 2000-037942 discloses technology which uses polyvalent metal as a reaction solution, and Japanese Patent Application Publication No. 2004-10633 discloses technology which controls the pigment aggregating characteristics on the surface of paper and consequently improves optical density, bleeding, coloring mixing, and drying time, by making one of a treatment liquid and ink acidic, and the other alkaline. These methods do not require the use of a transfer method and make it possible to construct a simple system.

In order to impart high productivity to an inkjet recording system, it is desirable to form an image by means of a single pass method. A single pass method is a method in which the relative positional relationship between the inkjet head and the base material (recording medium) is changed in terms of one direction only, and enables higher speed printing compared to a shuttle scan (serial scanning) method which is chiefly employed in consumer devices.

However, in a single pass method, there is a possibility that if there is a nozzle which is not ejecting or a nozzle in which deviation of the ejection direction has occurred, then the omitted portions are very highly noticeable.

As described hitherto, if an inkjet recording method is used for printing, a desirable mode is one where printing is carried out in a single pass using an aggregating method. However, a major problem of such a method is that since an ink having aggregating properties is used, then there is a high possibility of the nozzles in the head becoming blocked, and moreover high-speed image formation is carried out in a single pass in which such blockages (nozzle defects) may be influential in terms of image quality.

In response to instability of this kind, Japanese Patent Application Publication No. 4-39041 and Japanese Patent Application Publication No. 4-28555 and the like describe a method of compensating the portions where dots have been omitted due to ejection failure or deviation of the ejection direction.

However, when compensation is performed using the method used in Japanese Patent Application Publication No. 4-39041 and Japanese Patent Application Publication No, 4-28555, if it is not possible to respond by means of compensation alone, then intensive maintenance or head replacement must be carried out. But if the head is replaced too soon then this leads to increased running costs, whereas if the head is replaced too late and the head breaks down, and a service technician has to be called out to make the replacement, then this presents a major obstacle to work operations. The development of technology which resolves these problems is required.

SUMMARY OF THE INVENTION

The present invention has been contrived in view of the foregoing circumstances, an object thereof being to provide an image forming apparatus and an image forming method, and a remote monitoring system, whereby head replacement and intensive maintenance can be carried out efficiently.

One aspect of the present invention is directed to an image forming apparatus comprising: a recording head which has a plurality of nozzles for ejecting an ink onto a recording medium; a movement device which causes relative movement between the recording head and the recording medium; an image forming controller which controls the recording head according to image data in such a manner that an image corresponding to the image data is formed on the recording medium; an ejection abnormality detection device which detects an ejection abnormality caused by at least one of non-ejection and ejection direction deviation of the plurality of nozzles; a compensation device which compensates an image defect caused by the ejection abnormality; and a determination device which determines whether or not the head is in a state where the compensation device can compensate the image defect, according to detection result of the ejection abnormality detection device.

Possible methods for compensating density non-uniformity (image defects) are a method which compensates density non-uniformity by altering the ejection drive conditions in accordance with the density non-uniformity so as to adjust the dot size and dot density, and a method which eliminates the effects of density non-uniformity in the recorded image by compensating the image data in accordance with the density non-uniformity. Either of these methods may be employed in implementing embodiments of the present invention.

Methods of changing the ejection drive conditions involve changing the ink droplets ejected from the inkjet head, and therefore in practical implementation, the method is restricted by the drive method and compensation width of the inkjet head. As opposed to this, the method of compensating the image data in accordance with density non-uniformity can be realized by directly compensating the data relating to the ink droplets actually ejected from the inkjet head, without altering the inkjet head itself (in other words, without making physical changes), and hence there is good freedom of design, various compensation methods can be proposed, and consequently this mode is desirable.

Another aspect of the invention is directed to a remote monitoring system comprising: an image forming apparatus; and a remote monitoring information management apparatus which serves as the external apparatus that gathers and manages the information obtained by the ejection abnormality detection device of the image forming apparatus.

Another aspect of the invention is directed to a method of providing a maintenance service, in which in use of the remote monitoring system, a service technician is dispatched and at least one maintenance task of head replacement and intensive maintenance is carried out by the service technician, for the image forming apparatus which is determined to have the recording head in a state where a compensating effect by the compensation device cannot be expected.

Another aspect of the invention is directed to an image forming method which causes an ink to be ejected from a plurality of nozzles of a recording head onto a recording medium while causing relative movement between a recording medium and the recording head in such a manner that an image is formed on the recording medium, the image forming method comprising: an ejection abnormality detection step of detecting ejection abnormality including at least one of non-ejection and ejection direction deviation of the plurality of nozzles; a compensation step of compensating an image defect caused by the ejection abnormality; and a determination step of determining whether or not the recording head is in a state where compensation in the compensation step is possible, according to detection result in the ejection abnormality detection step.

According to the present invention, it is possible to continue to use a head until the state of the head has become such that a compensating effect by the compensation device cannot be expected, and head replacement, intensive maintenance, or the like, can be carried out at an optimal timing.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Overall Structure of Inkjet Recording Apparatus

Firstly, the overall composition of an inkjet recording apparatus according to an embodiment of the present invention will be described.

Figure 1:
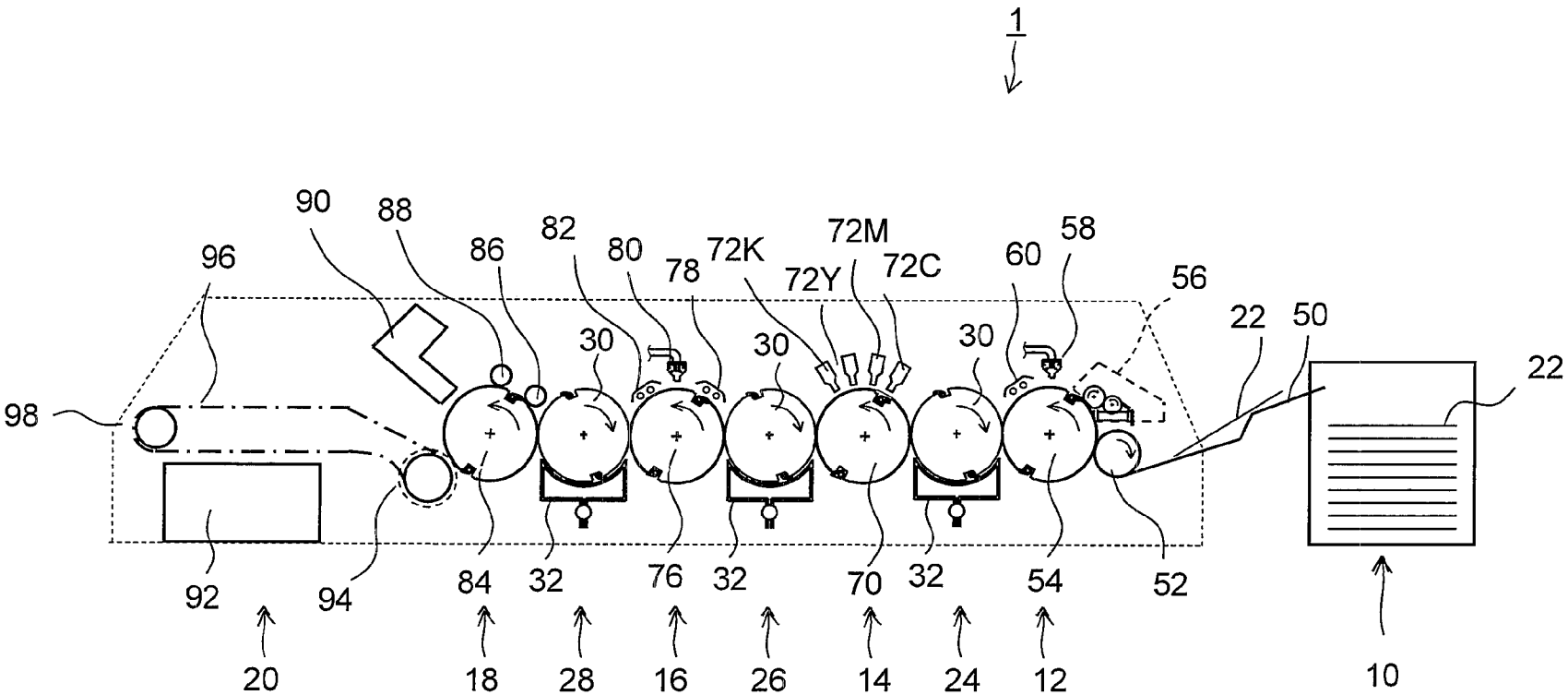
FIG. 1 is a schematic structural diagram illustrating an inkjet printing apparatus according to an embodiment of the present invention.

FIG. 1 is a structural diagram illustrating the entire configuration of an inkjet recording apparatus 1 of an embodiment of the present invention. The inkjet recording apparatus 1 illustrated in the drawing forms an image on a recording surface of a recording medium 22. The inkjet recording apparatus 1 includes a paper feed unit 10, a treatment liquid application unit 12, an image formation unit 14, a drying unit 16, a fixing unit 18, and a discharge unit 20 as the main components. A recording medium 22 (paper sheets) is stacked in the paper feed unit 10, and the recording medium 22 is fed from the paper feed unit 10 to the treatment liquid application unit 12. A treatment liquid is applied to the recording surface in the treatment liquid application unit 12, and then a color ink is applied to the recording surface in the image formation unit 14. The image is fixed with the fixing unit 18 on the recording medium 22 onto which the ink has been applied, and then the recording medium is discharged with the discharge unit 20.

In the inkjet recording apparatus 1, intermediate conveyance units 24, 26, 28 are provided between the units, and the recording medium 22 is transferred by these intermediate conveyance units 24, 26, 28. Thus, a first intermediate conveyance unit 24 is provided between the treatment liquid application unit 12 and image formation unit 14, and the recording medium 22 is transferred from the treatment liquid application unit 12 to the image formation unit 14 by the first intermediate conveyance unit 24. Likewise, the second intermediate conveyance unit 26 is provided between the image formation unit 14 and the drying unit 16, and the recording medium 22 is transferred from the image formation unit 14 to the drying unit 16 by the second intermediate conveyance unit 26. Further, a third intermediate conveyance unit 28 is provided between the drying unit 16 and the fixing unit 18, and the recording medium 22 is transferred from the drying unit 16 to the fixing unit 18 by the third intermediate conveyance unit 28.

Each unit (paper feed unit 10, treatment liquid application unit 12, image formation unit 14, drying unit 16, fixing unit 18, discharge unit 20, and first to third intermediate conveyance units 24, 26, 28) of the inkjet recording apparatus 1 will be described below in greater details.

Paper Feed Unit

The paper feed unit 10 is a mechanism that feeds the recording medium 22 to the image formation unit 14. A paper feed tray 50 is provided in the paper feed unit 10, and the recording medium 22 is fed, sheet by sheet, from the paper feed tray 50 to the treatment liquid application unit 12. As a recording medium 22, a matt coated paper (such as "YU-LIGHT" manufactured by Nippon Paper Group, Inc.) is used in this example, but other recording media can be used properly.

Treatment Liquid Application Unit

The treatment liquid application unit 12 is a mechanism that applies a treatment liquid to the recording surface of the recording medium 22. The treatment liquid includes a coloring material aggregating agent that causes the aggregation or precipitation of a coloring material (pigment) included in the ink applied in the image formation unit 14, and the separation of the coloring material and a solvent in the ink is enhanced when the treatment.

It is desirable in the present embodiment that the treatment liquid has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, phosphoric acid, polyphosphoric acid, metaphosphoric acid, and derivatives of these compounds, and salts of these.

A treatment liquid having added thereto a polyvalent metal salt or a polyallylamine is the preferred examples of the treatment liquid. The aforementioned compounds may be used individually or in combinations of two or more thereof.

From the standpoint of aggregation ability with the ink, the treatment liquid desirably has a pH of 1 to 6, more desirably a pH of 2 to 5, and even more desirably a pH of 3 to 5.

The amount of the component that causes aggregation of the pigment and polymer particles of the ink in the treatment liquid is desirably not less than 0.01 wt % and not more than 20 wt % based on the total weight of the liquid. Where the amount of this component is less than 0.01 wt %, sufficient concentration diffusion does not proceed when the treatment liquid and ink come into contact with each other, and sufficient aggregation action caused by pH variation sometimes does not occur. Further, in cases where the amount of this component is more than 20 wt %, the glaze of applied printing paper might be altered.

It is preferred that a non-curling solvent be added to the treatment liquid. Specific examples of non-curling agents include alcohols (for example, isopropanol, butanol, isobutanol, sec-butanol, t-butanol, pentanol, hexanol, cyclohexanol, and benzyl alcohol), polyhydric alcohols (for example, ethylene glycol, diethylene glycol, triethylene glycol, polyethylene glycol, propylene glycol, dipropylene glycol, polypropylene glycol, butylene glycol, hexane diol, pentane diol, hexane triol, and thiodiglycol), glycol derivatives (for example, ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether), amines (for example ethanolamine, diethanolamine, triethanolamine, N-methyldiethanolamine, N-ethyldiethanolamine, morpholine, N-ethylmorpholine, ethylenediamine, diethylenetriamine, triethylenetetramine, polyethyleneimine, and tetramethylpropylenediamine), and other polar solvents (for example, formamide, N,N-dimethylformamide, N,N-dimethylacetamide, dimethylsulfoxide, sulfolan, 2-pyrrolidone, N-methyl-2-pyrrolidone, N-vinyl-2-pyrrolidone, 2-oxazolidone, 1,3-dimethyl-2-imidazolidinone, acetonitrile, and acetone).

The above-described organic solvents may be used individually or in combinations of two or more thereof. It is preferred that these organic solvents be included in the treatment liquid at a content ratio of 1 wt % to 50 wt %.

As illustrated in FIG. 1, the treatment liquid application unit 12 includes a transfer drum 52, a treatment liquid drum 54, a treatment liquid application device 56, a warm-air blow-out nozzle 58, and an IR (infrared) heater 60. The transfer drum 52 is disposed between the paper feed tray 50 of the paper feed unit 10 and the treatment liquid drum 54. The rotation of the transfer drum is driven and controlled by a below-described motor driver 108 (see FIG. 13). The recording medium 22 fed from the paper feed unit 10 is received by the transfer drum 52 and transferred to the treatment liquid drum 54. The below-described intermediate conveyance unit may be also provided instead of the transfer drum 52.

The treatment liquid drum 54 is a drum that holds and rotationally conveys the recording medium 22. The rotation of the treatment liquid drum is driven and controlled by the below-described motor driver 108 (see FIG. 13). Further, the treatment liquid drum 54 is provided on the outer peripheral surface thereof with a hook-shaped holding device (device identical to a below-described holding device 73 illustrated in FIG. 4). The leading end of the recording medium 22 is held by the holding device. In a state in which the leading end of the recording medium 22 is held by the holding device, the treatment liquid drum 54 is rotated to convey rotationally the recording medium. In this case, the recording medium 22 is conveyed so that the recording surface thereof faces outside. The treatment liquid drum 54 may be provided with suction holes on the outer peripheral surface thereof and connected to a suction device that performs suction from the suction holes. As a result, the recording medium 22 can be tightly held on the circumferential surface of the treatment liquid drum 54.

The treatment liquid application device 56, the warm-air blow-out nozzle 58, and the IR heater 60 are provided on the outside of the treatment liquid drum 54 opposite the circumferential surface thereof. The treatment liquid application device 56, warm-air blow-out nozzle 58, and IR heater 60 are installed in the order of description from the upstream side in the rotation direction (counterclockwise direction in FIG. 1) of the treatment liquid drum 54. First, the treatment liquid is applied on the recording surface of the recording medium 22 by the treatment liquid application device 56.

Figure 2:
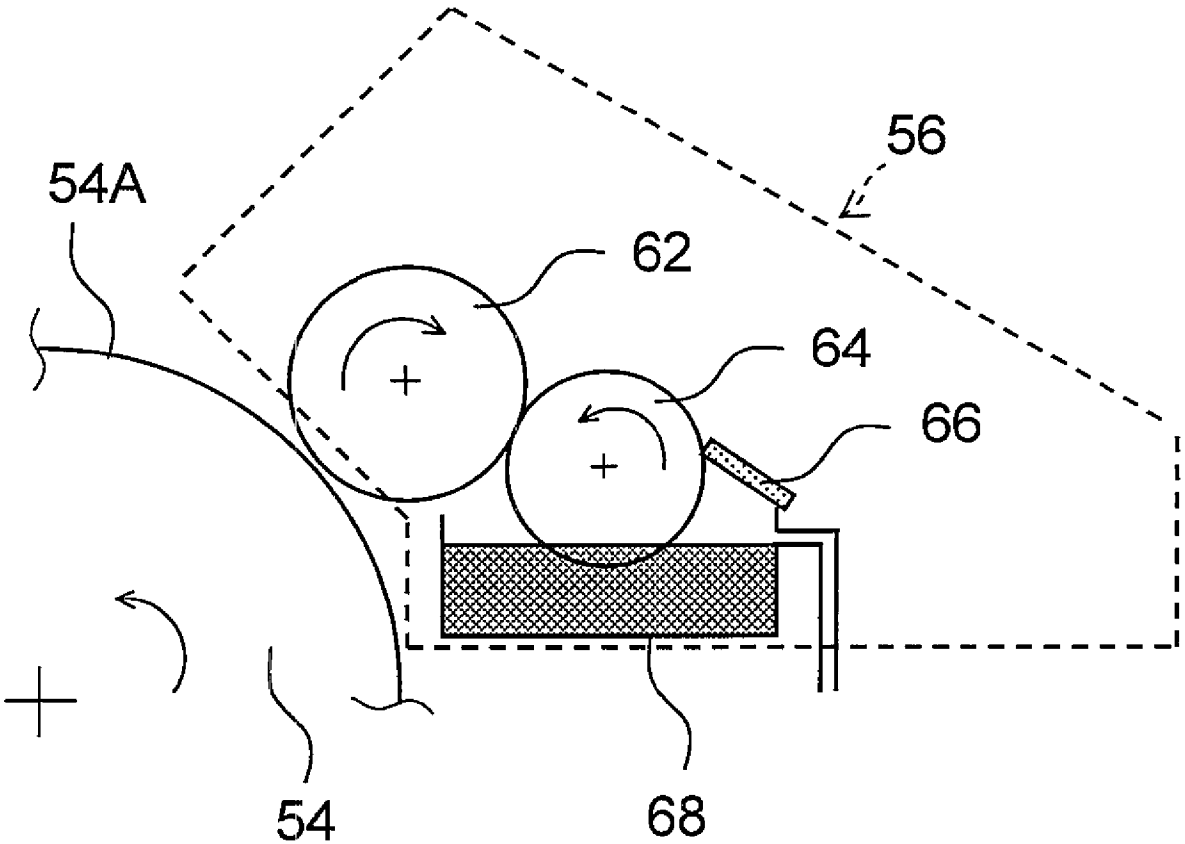
FIG. 2 is a structural diagram illustrating the treatment liquid application device of the treatment liquid application unit.

FIG. 2 is a configuration diagram of the treatment liquid application device 56. As illustrated in FIG. 2, the treatment liquid application device 56 is composed of a rubber roller 62, an anilox roller 64, a squeegee 66, and a treatment liquid container 68. The treatment liquid is stored in the treatment liquid container 68, and part of the anilox roller 64 is immersed in the treatment liquid. The squeegee 66 and rubber roller 62 are pressed against the anilox roller 64. The rubber roller 62 is brought into contact with the recording medium 22 that is held and rotationally conveyed by the treatment liquid drum 54, and the rubber roller is rotationally driven with a constant predetermined speed in the direction opposite (clockwise direction in the drawing) the rotation direction of the treatment liquid drum 54.

With the treatment liquid application device 56 of the above-described configuration, the treatment liquid is applied by the rubber roller 62 on the recording medium 22, while being metered by the anilox roller 64 and squeegee 66. In this case, it is preferred that the film thickness of the treatment liquid be sufficiently smaller than the diameter of ink droplets that are ejected from inkjet heads 72C, 72M, 72Y, 72K (see FIG. 1) of the image formation unit 14. For example, when the ink droplet volume is 2 picoliters (pl), the average diameter of the droplet is 15.6 μm. In this case, when the film thickness of the treatment liquid is large, the ink dot will be suspended in the treatment liquid, without coming into contact with the surface of the recording medium 22. Accordingly, when the ink droplet volume is 2 pl, it is preferred that the film thickness of the treatment liquid be not more than 3 μm in order to obtain a landing dot diameter not less than 30 μm.

Figure 3:
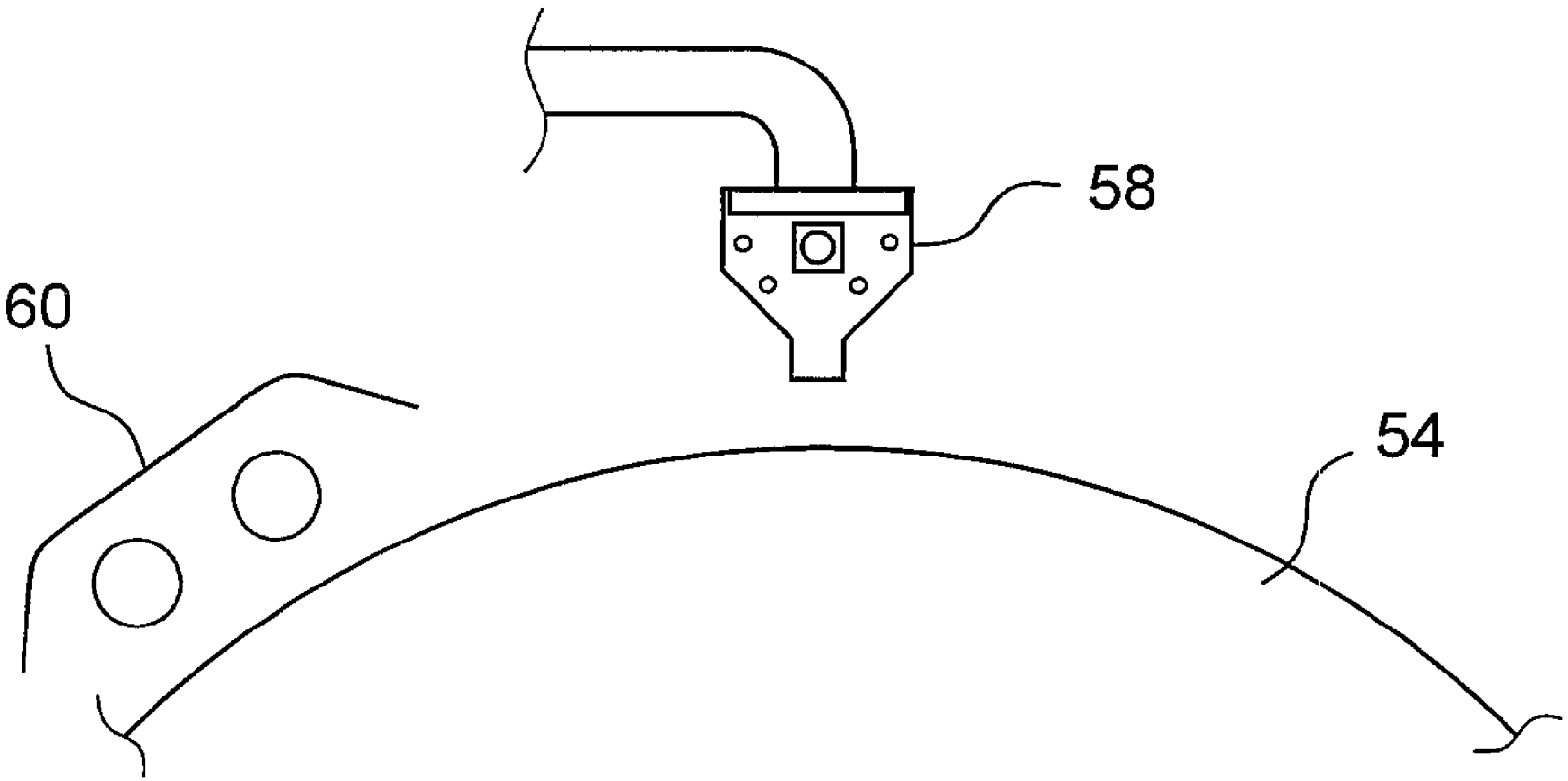
FIG. 3 is a structural diagram illustrating the drying device of the treatment liquid application unit.

The recording medium 22 that has been coated with the treatment liquid in the treatment liquid application device 56 is conveyed to the location of the warm-air blow-out nozzle 58 and IR heater 60 illustrated in FIG. 3. The warm-air blow-out nozzle 58 is configured to blow hot air at a high temperature (for example, 70° C.) at a constant blowing rate (for example, 9 $m^3$/min) toward the recording medium 22, and the IR heater 60 is controlled to a high temperature (for example, 180° C.). Water included in the solvent of the treatment liquid is evaporated by heating with these warm-air blow-out nozzle 58 and IR heater 60, and a thin layer of the treatment liquid is formed on the recording surface. Where the treatment liquid is formed into such a thin layer, the dots of ink deposited in the image formation unit 14 come into contact with the recording surface of the recording medium 22 and a necessary dot diameter is obtained. Moreover, the ink reacts with the components of the treatment liquid formed into the thin layer, coloring material aggregation occurs, and an action fixing the ink to the recording surface of the recording medium 22 is easily obtained. The treatment liquid drum 54 may be controlled to a predetermined temperature (for example, 50° C.).

Intermediate Conveyance Unit

Next, the structure of the first intermediate conveyance unit 24 will be described. The second intermediate conveyance unit 26 and the third intermediate conveyance unit 28 have a similar structure to the first intermediate conveyance unit 24, and therefore further description thereof is omitted here.

Figure 4:
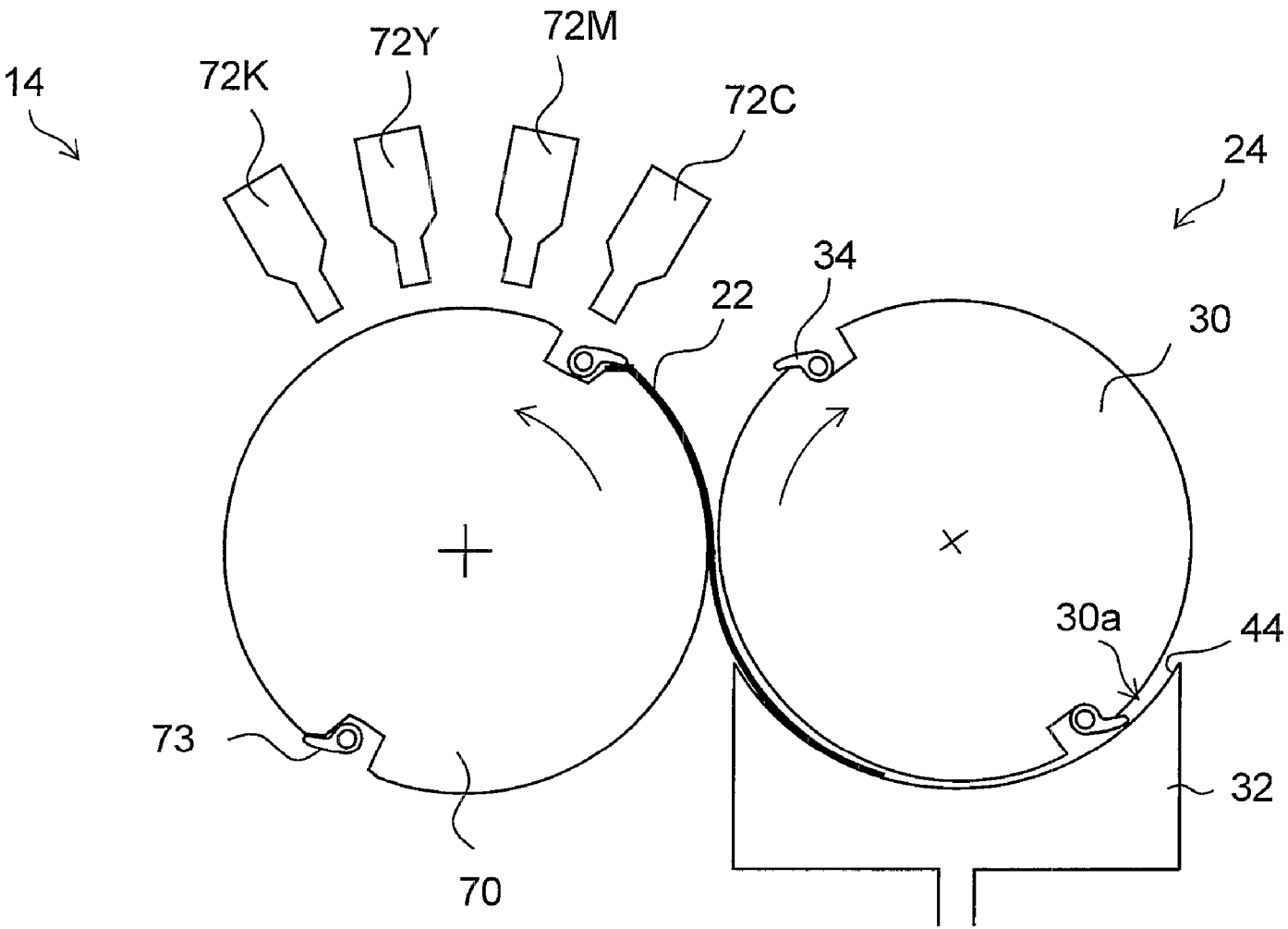
FIG. 4 is a structural diagram illustrating the image formation unit.
Figure 5:
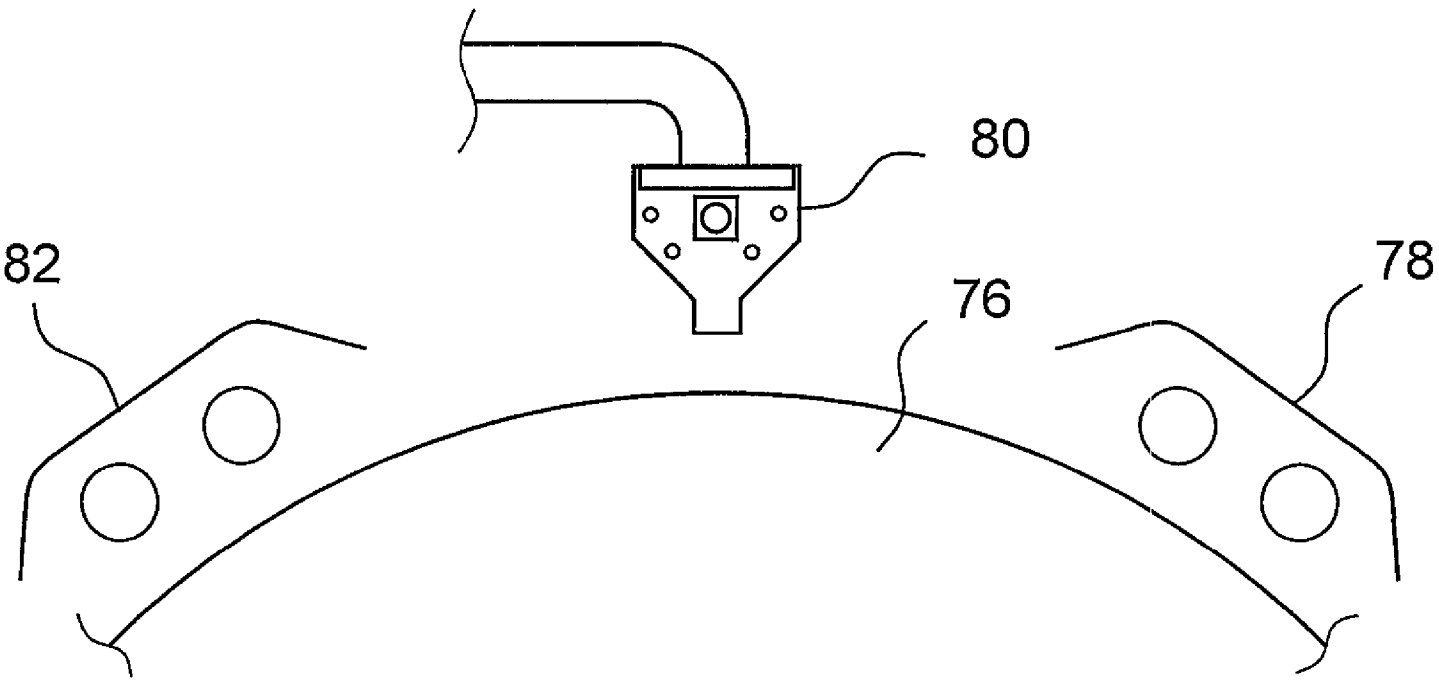
FIG. 5 is a structural diagram illustrating the drying unit.

As illustrated in FIG. 4, the first intermediate conveyance unit 24 principally comprises an intermediate conveyance body 30 and a conveyance guide 32. The intermediate conveyance body 30 is a drum which receives a recording medium 22 from the drum of a previous stage, conveys the medium by rotation, and then passes the recording medium to a drum of a subsequent stage. The intermediate conveyance body 30 is rotated by a motor (not illustrated) and the rotation thereof is driven and controlled by an intermediate conveyance body rotational drive unit (not illustrated).

Hook-shaped holding devices 34 (devices similar to the holding devices 73 in FIG. 4) are provided at 90° intervals on the outer circumferential surface of the intermediate conveyance body 30. The holding devices 34 rotate so as to trace a circular path and the leading edge of the recording medium 22 is held by the action of a holding device 34. Therefore, by rotating the intermediate conveyance body 30 in a state where the leading edge of a recording medium 22 is held by a holding device 34, it is possible to convey the recording medium 22 in rotation. In this, the recording medium 22 is rotated with the recording surface facing toward the inner side and the non-recording surface facing toward the outer side. In the present embodiment, two holding devices 34 are used in the intermediate conveyance body 30, but the number of holding devices 34 is not limited to this.

A plurality of ventilation holes (not illustrated in the drawings) are formed on the surface of the intermediate conveyance body 30. A blower (not illustrated) is connected to the interior of the intermediate conveyance body 30 and by means of this blower, air is supplied to the intermediate conveyance body 30. Desirably, the air is heated, and a heated air flow at 70° C. for instance is blown as a rate of 1 $m^3$/min. By this means, a heated air flow is blown out form the ventilation holes in the surface of the intermediate conveyance body 30, whereby the recording medium 22 is supported in a floating manner, as well as performing a drying process of the recording surface. Consequently, it is possible to prevent the recording surface of the recording medium 22 from making contact with the intermediate conveyance body 30 and adherence of treatment liquid to the intermediate conveyance body 30 can be avoided.

The conveyance guide 32 has a circular arc-shaped guide surface 44, and this guide surface 44 is disposed following the circumferential surface of the lower half of the intermediate conveyance body 30. Therefore, the recording medium 22 which is supported in a floating state by the intermediate conveyance body 30 is conveyed while the surface opposite to the recording surface (hereinafter called the non-recording surface) makes contact with the guide surface 44. By this means, it is possible to apply a tension to the recording medium 22 in the direction opposite to the direction of conveyance (hereinafter, this is called a "back tension"), and therefore the occurrence of wrinkles in the recording medium 22 during conveyance can be prevented.

As a method of applying a back tension, apart from an electrostatic attraction method and a negative pressure suction method, it is also possible to increase the surface roughness of the guide surface 44 by applying a surface treatment to same, or to form the guide surface 44 from a member having a high coefficient of friction, such as rubber.

The recording medium 22 which has been conveyed by the first intermediate conveyance unit 24 is received onto the drum of the subsequent stage (in other words, the printing drum 70). In this, the recording medium 22 is transferred by synchronizing the holding device 34 of the intermediate conveyance unit 24 and the holding device 73 of the printing unit 14. The recording medium 22 which has been transferred is held by the printing drum 70 and conveyed in rotation. In this, the recording medium 22 immediately after transfer is conveyed with the trailing edge side thereof in tight contact with the conveyance guide 32, and therefore it is possible to prevent the occurrence of problems such as wrinkles during transfer.

Image Formation Unit

As illustrated in FIG. 4, the image formation unit 14 is composed of an image formation drum 70 and inkjet heads 72C, 72M, 72Y, 72K that are proximally disposed in a position facing the outer peripheral surface of the image formation drum 70. The inkjet heads 72C, 72M, 72Y, 72K correspond to inks of four colors: cyan (C), magenta (M), yellow (Y), and black (K) and are disposed in the order of description from the upstream side in the rotation direction (counterclockwise direction in FIG. 4) of the image formation drum 70.

The image formation drum 70 is a drum that holds the recording medium 22 on the outer peripheral surface thereof and rotationally conveys the recording medium. The rotation of the image formation drum is driven and controlled by the below-described motor driver 108 (see FIG. 13). Further, the image formation drum 70 is provided on the outer peripheral surface thereof with a hook-shaped holding device 73, and the leading end of the recording medium 22 is held by the holding device 73. In a state in which the leading end of the recording medium 22 is held by the holding device 73, the image formation drum 70 is rotated to convey rotationally the recording medium. In this case, the recording medium 22 is conveyed so that the recording surface thereof faces outside. Inks are applied to the recording surface by the inkjet heads 72C, 72M, 72Y, 72K.

The inkjet heads 72C, 72M, 72Y, 72K are recording heads (inkjet heads) of an inkjet system of a full line type that have a length corresponding to the maximum width of the image formation region in the recording medium 22. A nozzle row is formed on the ink ejection surface of the inkjet head. The nozzle row has a plurality of nozzles arranged therein for discharging ink over the entire width of the image recording region. Each inkjet head 72C, 72M, 72Y 72K is fixedly disposed so as to extend in the direction perpendicular to the conveyance direction (rotation direction of the image formation drum 70) of the recording medium 22.

Droplets of corresponding colored inks are ejected from the inkjet heads 72C, 72M, 72Y, 72K having the above-described configuration toward the recording surface of the recording medium 22 held on the outer peripheral surface of the image formation drum 70. As a result, the ink comes into contact with the treatment liquid that has been heretofore applied on the recording surface by the treatment liquid application unit 12, the coloring material (pigment) dispersed in the ink is aggregated, and a coloring material aggregate is formed. Therefore, the coloring material flow on the recording medium 22 is prevented and an image is formed on the recording surface of the recording medium 22. In this case, because the image formation drum 70 of the image formation unit 14 is structurally separated from the treatment liquid drum 54 of the treatment liquid application unit 12, the treatment liquid does not adhere to the inkjet heads 72C, 72M, 72Y, 72K, and the number of factors preventing the ejection of ink can be reduced.

The following reaction can be considered as the reaction of ink and treatment liquid. For example, by using a mechanism of breaking the pigment dispersion and causing aggregation by introducing an acid into the treatment liquid and decreasing pH, it is possible to avoid oozing of the coloring agent, color mixing among inks of different colors, and deposition interference caused by merging of ink droplets during landing.

According to a composition in which a full line head having a nozzle row covering the whole width of the image forming region of the recording medium 22 is provided for each ink color, by conveying the recording medium 22 at a uniform speed on the printing drum 70 and performing just one action of moving the recording medium 22 and the respective inkjet heads 172C, 72M, 72Y and 72K relatively in this conveyance direction (sub-scanning direction), (in other words, by means of just one sub-scanning action), it is possible to record an image on the image forming region of the recording medium 22. Image formation using a single pass method based on a full line (page wide) head of this kind enables higher speed printing than when using a multi-pass method based on a serial (shuttle) type head which moves reciprocally in a direction (main scanning direction) which is perpendicular to the direction of conveyance of the recording medium (sub-scanning direction), as well as enabling improved printing productivity.

The ejection timing of the inkjet heads 72C, 72M, 72Y, 72K is synchronized by an encoder (not illustrated) that is disposed in the image formation drum 70 and detects the rotation speed. As a result, landing positions can be determined with high accuracy. Further, it is also possible to learn in advance the speed fluctuations caused, e.g., by oscillations of the image formation drum 70 and correct the ejection timing obtained with the encoder, excluding the effect of oscillations of the image formation drum 70, accuracy of the rotation shafts, and speed of the outer peripheral surface of the image formation drum 70, and reduce the unevenness of deposition.

Further, maintenance operations such as cleaning of the nozzle surface of the inkjet heads 72C, 72M, 72Y, 72K and ejection of thickened ink may be performed after the head units have been withdrawn from the image formation drum 70.

In the present example, a CMYK standard color (four color) configuration is described, but combinations of ink colors and numbers of colors are not limited to that of the present embodiment, and if necessary, light inks, dark inks, and special color inks may be added. For example, a configuration is possible in which an ink head is added that ejects a light ink such as light cyan and light magenta. The arrangement order of color heads is also not limited. The inkjet heads 72C, 72M, 72Y, 72K will be described below in greater detail.

The aqueous ink used in the embodiment of the present invention will be described below in greater detail.

The aqueous ink in accordance with the present invention is configured as a special ink including at least a resin dispersant (A), a pigment (B) that is dispersed by the resin dispersant (A), self-dispersible polymer microparticles (C), and an aqueous liquid medium (D).

Resin Dispersant (A)

The resin dispersant (A) is used as a dispersant for the pigment (B) in the aqueous liquid medium (D) and may be any appropriate resin, provided that it can disperse the pigment (B). The preferred structure of the resin dispersant (A) includes a hydrophobic structural unit (a) and a hydrophilic structural unit (b). If necessary, the resin dispersant (A) can also include a structural unit (c) that is different from the hydrophobic structural unit (a) and hydrophilic structural unit (b).

As for the compounding ratio of the hydrophobic structural unit (a) and hydrophilic structural unit (b), it is preferred that the hydrophobic structural unit (a) takes more than 80 wt %, desirably 85 wt % or more of the total weight of the resin dispersant (A). Thus, the compounding ratio of the hydrophilic structural unit (b) has to be not more than 15 wt %. Where the compounding ratio of the hydrophilic structural unit (b) is more than 15 wt %, the amount of component that is independently dissolved in the aqueous liquid medium (D), without participating in the dispersion of the pigment, increases, thereby causing degradation of performance such as dispersivity of the pigment (B) and worsening the ejection ability of ink for inkjet recording.

Hydrophobic Structural Unit (a)

The hydrophobic structural unit (a) of the resin dispersant (A) in accordance with the present invention includes at least a hydrophobic structural unit (a1) having an aromatic ring that is not directly coupled to an atom forming the main chain of the resin dispersant (A).

The expression "that is not directly coupled to" as used herein means a structure in which an aromatic ring and an atom forming the main chain structure of the resin are coupled via a linking group. With such a configuration, an adequate distance is maintained between the hydrophilic structural unit in the resin dispersant (A) and the hydrophobic aromatic ring. Therefore, interaction easily occurs between the resin dispersant (A) and pigment (B), strong adsorption is induced, and therefore dispersivity is increased.

Hydrophobic Structural Unit (a1) Having Aromatic Ring

From the standpoint of pigment dispersion stability, ejection stability, and cleaning ability, it is preferred that the hydrophobic structural unit (a1) having an aromatic ring that is not directly coupled to an atom forming the main chain of the resin dispersant (A) have a content ratio not less than 40 wt % and less than 75 wt %, more desirably not less than 40 wt % and less than 70 wt %, and even more desirably not less than 40 wt % and less than 60 wt % based on the total weight of the resin dispersant (A).

From the standpoint of improving the pigment dispersion stability, ejection stability, cleaning ability, and abrasion resistance, it is preferred that the aromatic ring that is not directly coupled to an atom forming the main chain of the resin dispersant (A) be contained in the resin dispersant (A) at a ratio not less than 15 wt % and not more than 27 wt %, more desirably not less than 15 wt % and not more than 25 wt %, and even more desirably not less than 15 wt % and not more than 20 wt %.

Within the above-described ranges, the pigment dispersion stability, ejection stability, cleaning ability, and abrasion resistance can be improved.

In accordance with the present invention, the hydrophobic structural unit (a1) having an aromatic ring in the hydrophobic structural unit (a) is desirably introduced in the resin dispersant (A) in the structure represented by General Formula (I) below.

General Formula (1)

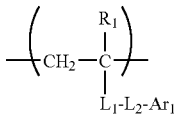

In the General Formula (I), R1 represents a hydrogen atom, a methyl group, or a halogen atom; L1 represents (main chain side)-COO—, —CONR2-, —O—, or substituted or unsubstituted phenylene group; and R2 represents a hydrogen atom and an alkyl group having 1 to 10 carbon atoms. L2 represents a single bond or a divalent linking group having 1 to 30 carbon atom; when it is a divalent linking group, the linking group desirably has 1 to 25 carbon atoms, more desirably 1 to 20 carbon atoms. Examples of suitable substituents include a halogen atom, an alkyl group, an alkoxy group, a hydroxyl group, and a cyano group, but this list is not limiting. Ar1 represents a monovalent group derived from an aromatic ring.

In the General Formula (I) the following combination of structural units is preferred: R1 is a hydrogen atom or a methyl group, L1 is (main chain side) —COO—, and L2 is a divalent linking group having 1 to 25 carbon atoms and including an alkyleneoxy group and/or alkylene group. In the even more preferred combination, R1 is a hydrogen atom or a methyl group, L1 is (main chain side) —COO—, and L2 is (main chain side) —(CH2-CH2-O—)— (n represents the average number of structural repeating units; n=1 to 6).

The aromatic ring in the Ar1 contained in the hydrophobic structural unit (a1) is not particularly limited, and examples of suitable aromatic rings include a benzene ring, a condensed aromatic ring having 8 or more carbon atoms, a hetero ring containing condensed aromatic rings, or two or more linked benzene rings.

The condensed aromatic ring having 8 or more carbon atoms as referred to herein is an aromatic compound having 8 or more carbon atoms that is composed of an aromatic ring having at least two or more condensed benzene rings, and/or at least one or more aromatic rings and an alicyclic hydrocarbon condensed to the aromatic ring. Specific examples thereof include naphthalene, anthracene, fluorene, phenanthrene, and acenaphthene.

The hetero ring in which aromatic rings are condensed are compounds in which an aromatic compound having no heteroatoms (desirably a benzene ring) and a cyclic compound having a heteroatom are condensed. The cyclic compound having a heteroatom is desirably a five-membered ring or a six-membered ring. The preferred examples of the heteroatom are a nitrogen atom, an oxygen atom, and a sulfur atom. The cyclic compound having a heteroatom may have a plurality of heteroatoms. In this case, the heteroatoms may be identical or different. Specific examples of the hetero ring in which aromatic rings are condensed include phthalimide, acridone, carbazole, benzoxazole, and benzothiazole.

Specific examples of monomers that can form the hydrophobic structural unit (a1) including a benzene ring, a condensed aromatic ring having 8 or more carbon atoms, a hetero ring in which aromatic rings are condensed, or a monovalent group derived from two or more benzene rings connected to each other are presented below, but the present invention is not limited to the below-described specific examples.

M-1

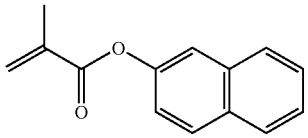

M-2

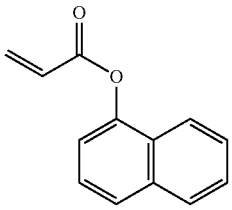

M-3

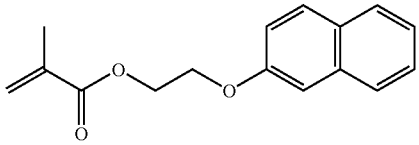

M-4

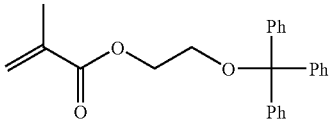

M-5

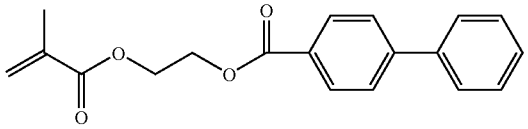

M-6

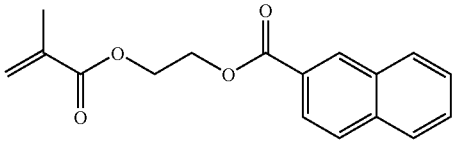

M-7

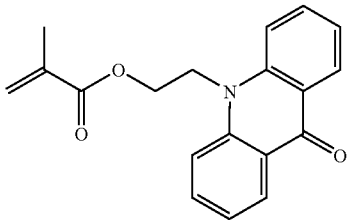

M-8

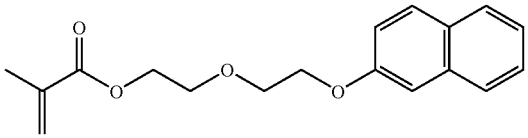

M-9

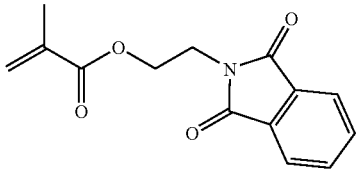

M-10

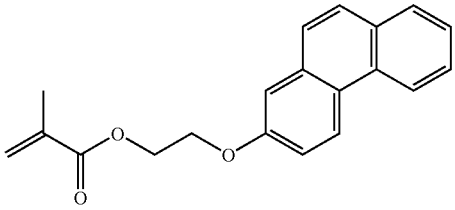

M-11

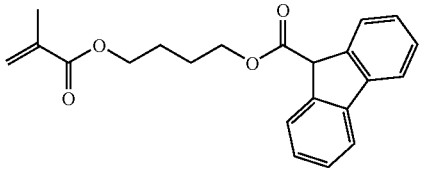

M-12

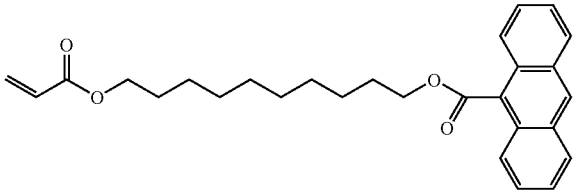

M-13

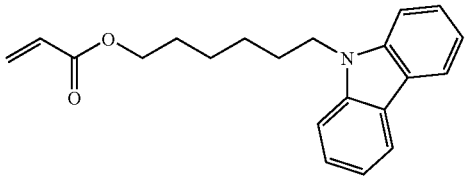

M-14

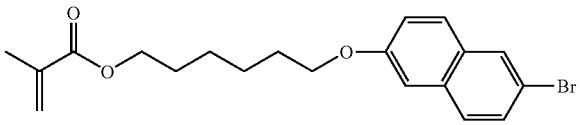

-continued

M-15

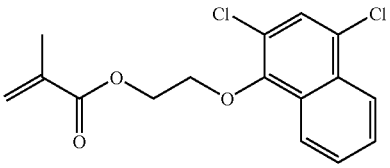

M-16

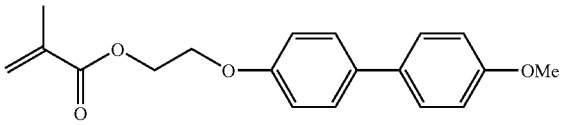

M-17

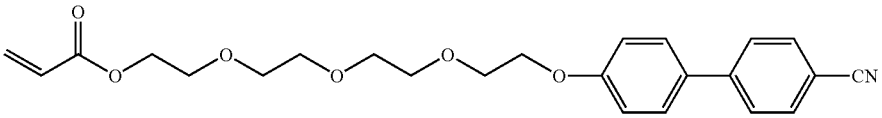

M-18

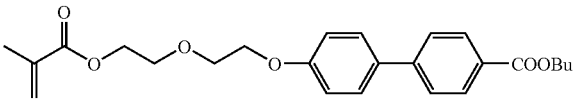

M-19

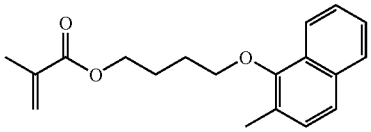

M-20

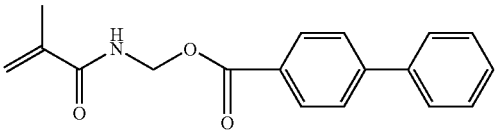

M-21

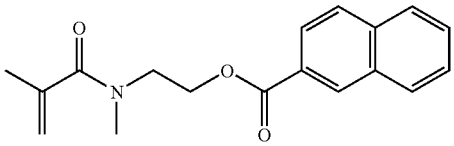

M-22

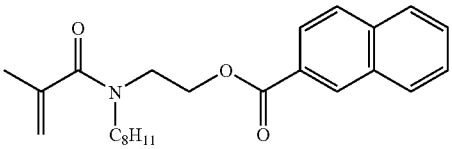

M-23

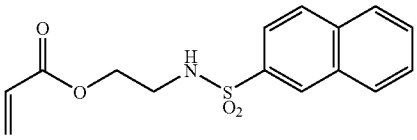

M-24

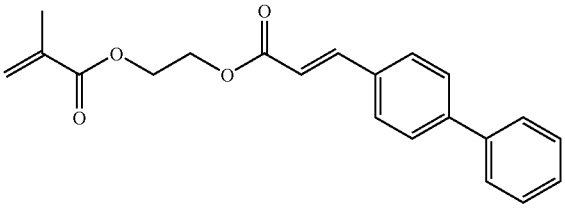

M-25

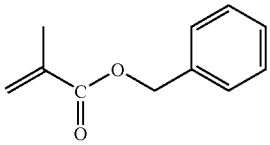

M-26

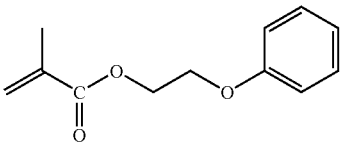

M-27

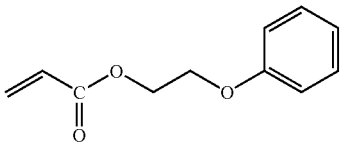

In accordance with the present invention, from the standpoint of dispersion stability, among the hydrophobic structural units (a1) having an aromatic ring that is directly coupled to an atom that forms the main chain of the resin dispersant (A), the preferred structural units are derived from at least any one from among benzyl methacrylate, phenoxyethyl acrylate, and phenoxyethyl methacrylate.

Hydrophobic Structural Unit (a2) Derived from an Alkyl Ester Having 1 to 4 Carbon Atoms of Acrylic Acid or Methacrylic Acid The hydrophobic structural unit (a2) derived from an alkyl ester having 1 to 4 carbon atoms of acrylic acid or methacrylic acid that is contained in the resin dispersant (A) has to be contained in the resin dispersant (A) at a content ratio at least not less than 15 wt %, desirably not less than 20 wt % and not more than 60 wt %, and more desirably not less than 20 wt % and not more than 50 wt %.

Specific examples of the (meth)acrylates include methyl (meth)acrylate, ethyl (meth)acrylate, (iso)propyl (meth)acrylate, and (iso or tertiary) butyl (meth)acrylate.

The number of carbon atoms in the alkyl group is desirably 1 to 4, more desirably 1 to 2.

Hydrophilic Structural Unit (b)

The hydrophilic structural unit (b) constituting the resin dispersant (A) in accordance with the present invention will be described below.

The hydrophilic structural unit (b) is contained at a ratio of more than 0 wt % and not more than 15 wt %, desirably not less than 2 wt % and not more than 15 wt %, more desirably not less than 5 wt % and not more than 15 wt %, and even more desirably not less than 8 wt % and not more than 12 wt %.

The resin dispersant (A) includes at least acrylic acid and/or methacrylic acid (b1) as the hydrophilic structural unit (b).

Hydrophilic Structural Unit (b1)

The content of the hydrophilic structural unit (b1) has to change depending on the amount of the below-described structural unit (b2) or the amount of the hydrophobic structural unit (a), or both these amounts.

Thus, the resin dispersant (A) in accordance with the present invention may contain the hydrophobic structural unit (a) at a content ratio higher than 80 wt % and the hydrophilic structural unit (b) at a content ratio not more than 15 wt % and is determined by the hydrophobic structural units (a1) and (a2), hydrophilic structural units (b1) and (b2), and structural unit (c).

For example, when the resin dispersant (A) is configured only by the hydrophobic structural units (a1) and (a2), hydrophilic structural unit (b1), and structural unit (b2), the content ratio of the acrylic acid and methacrylic acid (b1) can be found by (100−(wt % of hydrophobic structural units (a1) and (a2))−(wt % of structural unit (b2))). In this case, the sum total of the (b1) and (b2) has to be not more than 15 wt %.

When the resin dispersant (A) is configured by the hydrophobic structural units (a1) and (a2), hydrophilic structural unit (b1), and structural unit (c), the content ratio of the hydrophilic structural unit (b1) can be found by "100−(wt % of hydrophobic structural units (a1) and (a2))−(wt % of structural unit (c))".

The resin dispersant (A) can be also configured only by the hydrophobic structural unit (a1), hydrophobic structural unit (a2), and hydrophilic structural unit (b1).

The hydrophilic structural unit (b1) can be obtained by polymerization of acrylic acid and/or methacrylic acid.

The acrylic acid and methacrylic acid can be used individually or in a mixture.

From the standpoint of pigment dispersibility and stability in storage, the acid value of the resin dispersant (A) in accordance with the present invention is desirably not lower than 30 mg KOH/g and not higher than 100 mg KOH/g, more desirably not lower than 30 mg KOH/g and lower than 85 mg KOH/g, and even more desirably not lower than 50 mg KOH/g and lower than 85 mg KOH/g.

The acid value as referred to herein is defined as a weight (mg) of KOH required to neutralize completely 1 g of the resin dispersant (A) and can be measured by a method described in a JIS standard (JIS K0070, 1992).

Structural Unit (b2)

The structural unit (b2) desirably has a nonionic aliphatic group. The structural unit (b2) can be formed by polymerizing a monomer corresponding thereto, and an aliphatic functional group may be introduced into the polymer chain after the polymerization of the polymer.

The monomer forming the structural unit (b2) is not particularly limited provided that it has a functional group that can form the polymer and a nonionic hydrophilic functional group. Well known suitable monomers can be used, but from the standpoint of availability, handleability, and utility, vinyl monomers are preferred.

Examples of vinyl monomers include (meth)acrylates, (meth)acrylamides, and vinyl esters having hydrophilic functional groups having a hydrophilic functional group.

Examples of the hydrophilic functional group include a hydroxyl group, an amino group, an amido group (with unsubstituted nitrogen atom), and the below-described alkylene oxide polymers such as polyethylene oxide and polypropylene oxide.

Among them hydroxyethyl (meth)acrylate, hydroxybutyl (meth)acrylate, (meth)acrylamide, aminoethyl acrylate, aminopropyl acrylate, and (meth)acrylates including alkylene oxide polymers are especially preferred.

The structural unit (b2) desirably includes a hydrophilic structural unit having an alkylene oxide polymer structure.

From the standpoint of hydrophility, it is preferred that the alkylene in the alkylene oxide polymer have 1 to 6 carbon atoms, more desirably 2 to 6 carbon atoms, and even more desirably 2 to 4 carbon atoms.

The degree of polymerization of the alkylene oxide polymer is desirably 1 to 120, more desirably 1 to 60, and even more desirably 1 to 30.

It is also preferred that the structural unit (b2) be a hydrophilic structural unit having a hydroxyl group.

The number of hydroxyl groups in the structural unit (b2) is not particularly limited. From the standpoint of hydrophility of the resin (A) and mutual solubility of the solvent or other monomers during the polymerization, it is preferred that this number be 1 to 4, more desirably 1 to 3, even more desirably 1 to 2.

Structural Unit (c)

As described above, the resin dispersant (A) in accordance with the present invention can also include a structural unit (c) having a structure different from that of the hydrophobic structural unit (a1), hydrophobic structural unit (a2), and hydrophilic structural unit (b) (this structural unit will be referred to hereinbelow simply as "structural unit (c)".

The structural unit (c) different from the hydrophobic structural unit (a1), hydrophobic structural unit (a2), and hydrophilic structural unit (b), as referred to herein, is a structural unit (c) having a structure different from that of the (a1), (a2), and (b), and it is preferred that the structural unit (c) be a hydrophobic structural unit.

The structural unit (c) can be a hydrophobic structural unit, but it has to be a structural unit having a structure different from that of the hydrophobic structural unit (a1) and hydrophobic structural unit (a2).

The content ratio of the structural unit (c) is desirably not more than 35 wt %, more desirably not more than 20 wt %, and even more desirably not more than 15 wt % based on the entire weight of the resin dispersant (A).

The structural unit (c) can be formed by polymerizing a monomer corresponding thereto. A hydrophobic functional group may be introduced into the polymer chain after the polymerization.

The monomer suitable in the case where the structural unit (c) is a hydrophobic structural unit is not particularly limited, provided that it has a functional group that can form a polymer and a hydrophobic functional group, and well known suitable monomers can be used.

From the standpoint of availability, handleability, and utility, vinyl monomers ((meth)acrylamides, styrenes, and vinyl esters) are preferred as the monomers that can form the hydrophobic structural unit.

Examples of (meth)acrylamides include N-cyclohexyl (meth)acrylamide, N-(2-methoxyethyl) (meth)acrylamide, N,N,-diallyl (meth)acrylamide, and N-allyl (meth)acrylamide.

Examples of styrenes include styrene, methyl styrene, dimethyl styrene, trimethyl styrene, ethyl styrene, isopropyl styrene, n-butyl styrene, tert-butyl styrene, methoxystyrene, butoxystyrene, acetoxystyrene, chlorostyrene, dichlorostyrene, bromostyrene, chloromethyl styrene, hydroxystyrene protected by a group (for example, t-Boc) that can be deprotected by an acidic substance, methylvinyl benzoate, and α-methyl styrene, and vinyl naphthalene. Among them, styrene and α-methyl styrene are preferred.

Examples of vinyl esters include vinyl acetate, vinyl chloroacetate, vinyl propionate, vinyl butyrate, vinyl methoxyacetate, and vinyl benzoate. Among them, vinyl acetate is preferred.

The aforementioned compounds can be used individually or in mixtures of two or more thereof.

The resin dispersant (A) in accordance with the present invention may be a random copolymer into which the structural units are introduced irregularly, or a block copolymer into which the structural units are introduced regularly. When resin dispersant is a block copolymer, the synthesis may be performed by introducing the structural units in any order and the same structural component may be used two or more times. From the standpoint of utility and productivity, it is preferred that the resin dispersant be a random copolymer.

Further, the molecular weight range of the resin dispersant (A) in accordance with the present invention is desirably 30,000 to 150,000, more desirably 30,000 to 100,000, and even more desirably 30,000 to 80,000 as represented by a weight-average molecular weight (Mw).

Setting the molecular weight within the aforementioned ranges is preferred because the steric repulsion effect of the dispersant tends to be good and the time for adsorption to a pigment tends to be eliminated by the steric effect.

The molecular weight distribution (represented by the ratio of the weight-average molecular weight to the number-average molecular weight) of the resin used in accordance with the present invention is desirably 1 to 6, more desirably 1 to 4.

Setting the molecular weight distribution within the aforementioned ranges is preferred from the standpoint of ink dispersion stability and ejection stability. The number-average molecular weight and weight-average molecular weight are a molecular weight detected with a differential refractometer by using THF as a solvent in a GPC analyzer employing TSKgel, GMHxL, TSKgel, G4000HxL, TSKgel, G2000HxL (all are trade names of products manufactured by Tosoh Co.) and represented by recalculation using polystyrene as a standard substance.

The resin dispersion (A) used in accordance with the present invention can be synthesized by a variety of polymerization methods, for example, by solution polymerization, precipitation polymerization, suspension polymerization, lump polymerization, and emulsion polymerization. The polymerization reaction can be carried out by conventional operations, for example, in a batch mode, a semi-continuous mode, or a continuous mode.

A method using a radical initiator and a method using irradiation with light or radiation are known as polymerization initiation methods. These polymerization methods and polymerization initiation methods are described in Teiji Tsuruda "Kobunshi Gosei Hoho", Kaiteiban (Nikkan Kogyo Shinbunsha Kan, 1971) and Takayuki Otsu, Masaetsu Kinoshita "Kobunshi Gosei-no Jikkenho" Kagaku Dojin, 1972, p. 124 to 154.

A solution polymerization method using radical initiation is especially preferred as the polymerization method. Examples of solvents that can be used in the solution polymerization method include a variety of organic solvents such as ethyl acetate, butyl acetate, acetone, methyl ethyl ketone, methyl isobutyl ketone, cyclohexaneone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. These solvents may be used individually or in mixtures of two or more thereof. A mixed solvent additionally containing water may be also used.

The polymerization temperature has to be set according to the molecular weight of the polymer to be synthesized and the type of polymerization initiator. Usually, the polymerization temperature is about 0° C. to 100° C., but it is preferred that the polymerization be conducted within a range of 50° C. to 100° C.

The reaction pressure can be set appropriately. Usually the reaction pressure is 1 kg/cm$^2$ to 100 kg/cm$^2$, and desirably 1 kg/cm$^2$ to 30 kg/cm$^2$. The reaction time is about 5 hours to 30 hours. The resin obtained may be subjected to purification such as reprecipitation.

The preferred specific examples of the resin dispersant (A) in accordance with the present invention are presented below, but the present invention is not limited thereto.

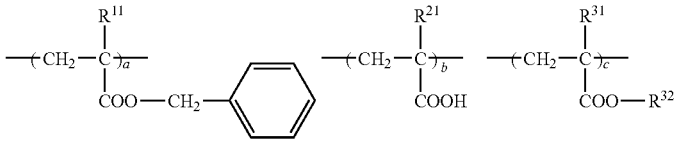

| | $R^{11}$ | $R^{21}$ | $R^{31}$ | $R^{32}$ | a | b | c | Mw |
|---|---|---|---|---|---|---|---|---|
| B-1 | $CH_3$ | $CH_3$ | $CH_3$ | $—CH_3$ | 60 | 10 | 30 | 46000 |
| B-2 | H | H | H | $—CH_3$ | 60 | 10 | 30 | 50000 |
| B-3 | $CH_3$ | $CH_3$ | $CH_3$ | $—CH_2CH_3$ | 61 | 10 | 29 | 43000 |
| B-4 | $CH_3$ | $CH_3$ | $CH_3$ | $—CH_2CH_2CH_2CH_3$ | 61 | 9 | 30 | 51000 |
| B-5 | $CH_3$ | $CH_3$ | $CH_3$ | $—CH_2(CH_3)CH_3$ | 60 | 9 | 31 | 96000 |
| B-6 | H | H | H | $—CH_2(CH_3)(CH_3)CH_3$ | 60 | 10 | 30 | 32000 |
| B-7 | $CH_3$ | $CH_3$ | $CH_3$ | $—CH_2CH(CH_3)CH_3$ | 60 | 5 | 30 | 75000 |

(a, b and c represent respective compositions (wt %))

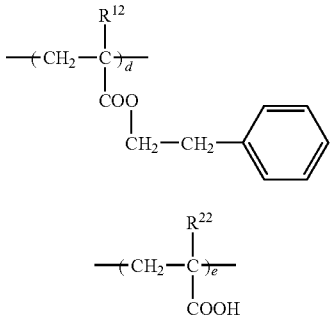

-continued
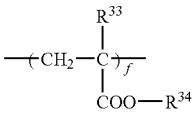
| | $R^{12}$ | $R^{22}$ | $R^{33}$ | $R^{34}$ | d | e | f | Mw |
|---|---|---|---|---|---|---|---|---|
| B-8 | $CH_3$ | $CH_3$ | $CH_3$ | —$CH_3$ | 55 | 12 | 33 | 31000 |
| 8-9 | H | H | H | —CH2CH(CH3)CH3 | 70 | 10 | 20 | 34600 |
(d, e and f represent respective compositions (wt %))
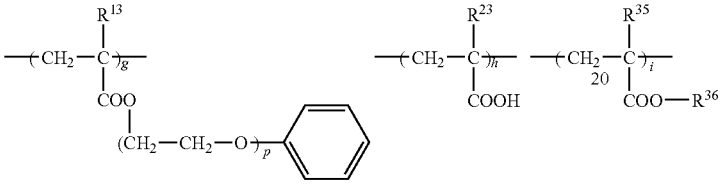
| | $R^{13}$ | p | $R^{23}$ | $R^{35}$ | $R^{36}$ | g | h | i | Mw |
|---|---|---|---|---|---|---|---|---|---|
| B-10 | $CH_3$ | 1 | $CH_3$ | $CH_3$ | —$CH_3$ | 60 | 9 | 31 | 35500 |
| B-11 | H | 1 | H | H | —$CH_2CH_3$ | 69 | 10 | 21 | 41200 |
| B-12 | $CH_3$ | 2 | $CH_3$ | $CH_3$ | —$CH_3$ | 70 | 11 | 19 | 68000 |
| B-13 | $CH_3$ | 4 | $CH_3$ | $CH_3$ | —$CH_2(CH_3)CH_3$ | 70 | 7 | 23 | 72000 |
| B-14 | H | 5 | H | H | —$CH_3$ | 70 | 10 | 20 | 86000 |
| B-15 | H | 5 | H | H | —$CH_2CH(CH_3)CH_3$ | 70 | 2 | 28 | 42000 |
(g, h and i represent respective compositions (wt %))
B-16
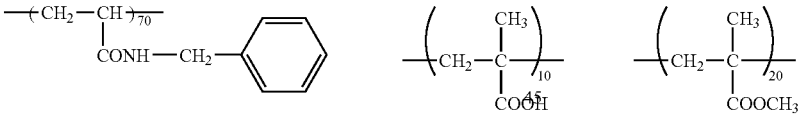
Mw: 34300
| | Mw |
|---|---|
| B-17 | 72400 |
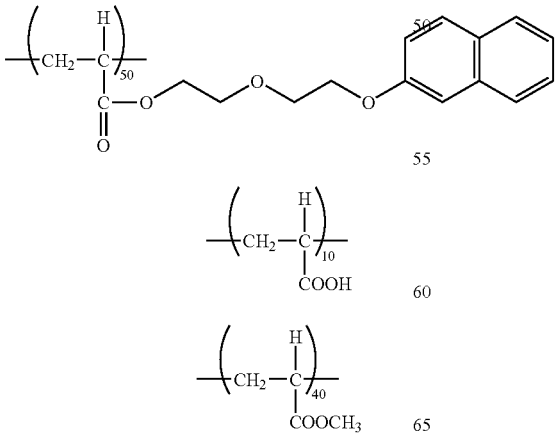

-continued

B-18 33800

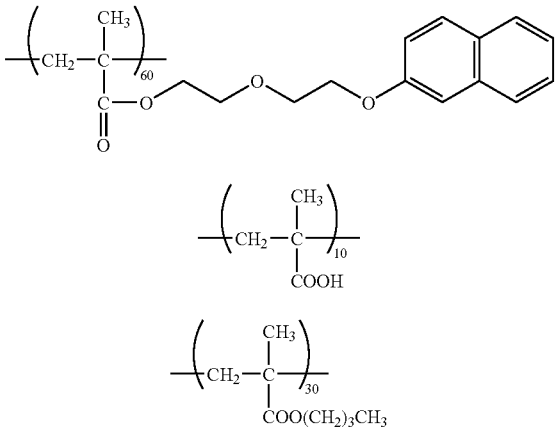

B-19 39200

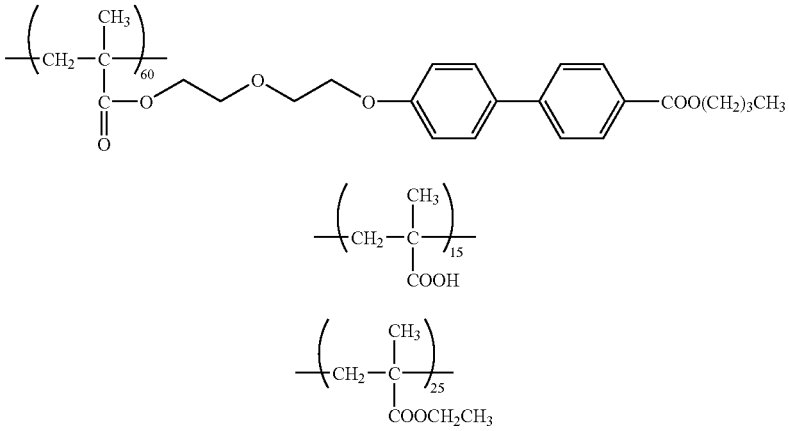

B-20 55300

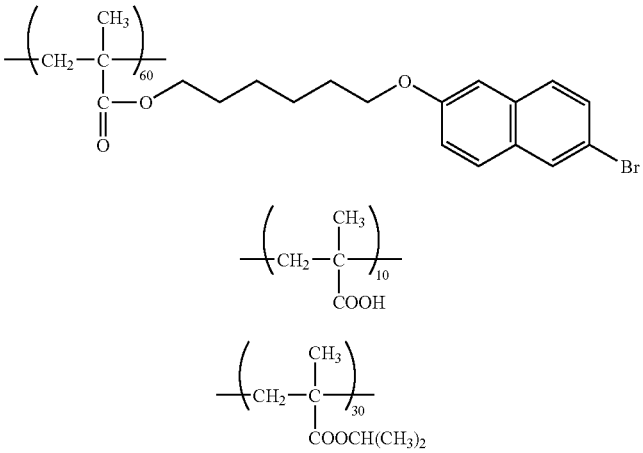

Ratio of Pigment (B) and Resin Dispersant (A)

The weight ratio of the pigment (B) and resin dispersant (A) is desirably 100:25 to 100:140, more desirably 100:25 to 100:50. When the resin dispersant is present at a ratio not lower than 100:25, the dispersion stability and abrasion resistance tend to improve, and where the resin dispersant is present at a ratio of 100:140 or less, the dispersion stability tends to improve.

Pigment (B)

In accordance with an embodiment of the present invention, the pigment (B) is a general term for color substances (including white color when the pigment is inorganic) that are practically insoluble in water and organic solvents, as described in Kagaku Daijiten (third edition), published on Apr. 1, 1994, (ed. by Michinori Oki), p. 518, and organic pigments and inorganic pigments can be used in accordance with the present invention.

Further, "the pigment (B) dispersed by the resin dispersant (A)" in the description of the present embodiment means a pigment that is dispersed and held by the resin dispersant (A) and is desirably used as a pigment that is dispersed and held by the resin dispersant (A) in the aqueous liquid medium (D).

An additional dispersant may be optionally contained in the aqueous liquid medium (D).

The pigment (B) dispersed by the resin dispersant (A) in accordance with the present embodiment is not particularly limited, provided that it is a pigment that is dispersed and held by the resin dispersant (A). From the standpoint of pigment dispersion stability and ejection stability, microcapsulated pigments produced by a phase transition method are more preferred from among the aforementioned pigments.

A microcapsulated pigment represents a preferred example of the pigment (B) employed in accordance with the present embodiment. The microcapsulated pigment as referred to herein is a pigment coated by the resin dispersant (A).

The resin of the microcapsulated pigment has to use the resin dispersant (A), but it is preferred that a polymer compound having self-dispersibility or solubility in water and also having an anionic (acidic) group be used in a resin other than the resin dispersant (A).

Manufacture of Microcapsulated Pigment

A microcapsulated pigment can be prepared by conventional physical and chemical methods using the above-described components such as the resin dispersant (A). For example, a microcapsulated pigment can be prepared by methods disclosed in Japanese Patent Application Publication Nos. 9-151342, 10-140065, 11-209672, 11-172180, 10-025440, and 11-043636. Methods for manufacturing a microcapsulated pigments will be reviewed below.

A phase transition method or acid precipitation method described in Japanese Patent Application Publication Nos. 9-151342 and 10-140065 can be used as methods for manufacturing microcapsulated pigments, and among them the phase transition method is preferred from the standpoint of dispersion stability.

(a) Phase Transition Method

The phase transition method as referred to in the description of the present invention is basically a self-dispersion (phase transition emulsification) method by which a mixed melt of a pigment and a resin having self-dispersibility or solubility is dispersed in water. The mixed melt may also include the above-described curing agent or polymer compound. The mixed melt as referred to herein is presumed to include a state obtained by mixing without dissolution, a state obtained by mixing with dissolution, and both these states. A more specific manufacturing method of the "phase transition method" may be identical to that disclosed in Japanese Patent Application Publication No. 10-140065.

(b) Acid Precipitation Method

The acid precipitation method as referred to in the description of the present embodiment is a method of manufacturing a microcapsulated pigment by using a water-containing cake composed of a resin and a pigment and neutralizing all or some of the anionic groups contained in the resin within the water-containing cake by using a basic compound.

More specifically, the acid precipitation method includes the steps of: (1) dispersing a resin and a pigment in an alkaline aqueous medium and, if necessary, performing a heat treatment to gel the resin; (2) hydrophobizing the resin by obtaining neutral or acidic pH and strongly fixing the resin to the pigment; (3) if necessary, performing filtration and water washing to obtain a water-containing cake; (4) neutralizing all or some of the anionic groups contained in the resin in the water-containing cake by using a basic compound and then re-dispersing in an aqueous medium; and (5) if necessary, performing a heat treatment and gelling the resin.

More specific manufacturing methods of the above-described phase transition method and acid precipitation method may be identical to those disclosed in Japanese Patent Application Publication Nos. 9-151342 and 10-140065. Methods for manufacturing coloring agents described in Japanese Patent Application Publication Nos. 11-209672 and 11-172180 can be also used in accordance with the present embodiment of the invention.

The preferred manufacturing method in accordance with the present embodiment basically includes the following manufacturing steps: (1) mixing a resin having an anionic group or a solution obtained by dissolving the resin in an organic solvent with an aqueous solution of a basic compound to cause neutralization; (2) admixing a pigment to the mixed liquid to form a suspension and then dispersing the pigment with a dispersing apparatus to obtain a pigment dispersion; and (3) if necessary, removing the solvent by distillation and obtaining an aqueous dispersion in which the pigment is coated with the resin having an anionic group.

In accordance with an embodiment of the present invention, kneading and dispersion treatment mentioned hereinabove can be performed using, for example, a ball mill, a roll mill, a beads mill, a high-pressure homogenizer, a high-speed stirring dispersing apparatus, and an ultrasound homogenizer.

Pigment B

The following pigments can be used in accordance with an embodiment of the present invention. Thus, examples of yellow ink pigments include C.I. Pigment Yellow 1, 2, 3, 4, 5, 6, 7, 10, 11, 12, 13, 14, 14C, 16, 17, 24, 34, 35, 37, 42, 53, 55, 65, 73, 74, 75, 81, 83, 93, 95, 97, 98, 100, 101, 104, 108, 109, 110, 114, 117, 120, 128, 129, 138, 150, 151, 153, 154, 155, 180.

Examples of magenta ink pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 48 (Ca), 48 (Mn), 48:2, 48:3, 48:4, 49, 49:1, 50, 51, 52, 52:2, 53:1, 53, 55, 57 (Ca), 57:1, 60, 60:1, 63:1, 63:2, 64, 64:1, 81, 83, 87, 88, 89, 90, 101 (Bengal), 104, 105, 106, 108 (cadmium red), 112, 114, 122 (quinacridone magenta), 123, 146, 149, 163, 166, 168, 170, 172, 177, 178, 179, 184, 185, 190, 193, 202, 209, 219. Among them, C.I. Pigment Red 122 is especially preferred.

Examples of cyan ink pigments include C.I. Pigment Blue 1, 2, 3, 15, 15:1, 15:2, 15:3, 15:4, 16, 17:1, 22, 25, 56, 60, C.I. Vat Blue 4, 60, 63. Among them, C.I. Pigment Blue 15:3 is especially preferred.

Examples of other color ink pigments include C.I. Pigment Orange 5, 13, 16, 17, 36, 43, 51, C.I. Pigment Green 1, 4, 7, 8, 10, 17, 18, 36, C.I. Pigment Violet 1 (Rhodamine Lake), 3, 5:1, 16, 19 (quinacridone red), 23, 28. Processed pigments such as graft carbon that are obtained by treating the pigment surface with a resin or the like can be also used.

Carbon black is an example of a black pigment. Specific examples of carbon black include No. 2300, No. 900, MCF88, No. 33, No. 40, No. 45, No. 52, MA 7, MA8, MA100, and No. 2200B manufactured by Mitsubishi Chemical, Raven 5750, Raven 5250, Raven 5000, Raven 3500, Raven 1255, and Raven 700 manufactured by Colombia, Regal 400R, Regal 1330R, Regal 1660R, Mogul L, Monarch 700, Monarch 800, Monarch 880, Monarch 900, Monarch 1000, Monarch 1100, Monarch 1300, and Monarch 1400 manufactured by Cabot Corp., and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 manufactured by Degussa Co., Ltd.

The aforementioned pigments may be used individually or in combinations obtained by selecting a plurality of pigments in each of the above-described groups or a plurality of pigments from different groups.

From the standpoint of dispersion stability and concentration of the aqueous ink, the content ratio of the pigment (B) in the aqueous ink in accordance with the present invention is desirably 1 wt % to 10 wt %, more desirably 2 wt % to 8 wt %, and even more desirably 2 wt % to 6 wt %.

Self-Dispersible Polymer Microparticles

The aqueous ink used in accordance with the present embodiment includes self-dispersible polymer microparticles of at least one kind. Self-dispersible polymer microparticles as referred to herein mean microparticles of a water-insoluble polymer containing no free emulsifying agent, this water-insoluble polymer being capable of assuming a dispersion state in an aqueous medium under the effect of functional groups (especially acidic groups or salt thereof) of the resin itself, without the presence of another surfactant.

The dispersion state as referred to herein includes both an emulsion state (emulsion) in which the water-insoluble polymer is dispersed in a liquid state in the aqueous medium and a dispersion state (suspension) in which the water-insoluble polymer is dispersed in a solid state in the aqueous medium.

From the standpoint of ink stability and ink aggregation speed in the case the water-insoluble polymer is contained in a water-soluble ink, it is preferred that the water-insoluble polymer in accordance with the present embodiment be a water-insoluble polymer that can assume a dispersion state in which the water-insoluble polymer is dispersed in a solid state.

The dispersion state of the self-dispersible polymer microparticles in accordance with the present embodiment represents a state such that the presence of a dispersion state can be visually confirmed with good stability at least over a week at a temperature of 25° C. in a system obtained by mixing a solution obtained by dissolving 30 g of a water-insoluble polymer in 70 g of an organic solvent (for example, methyl ethyl ketone), a neutralizing agent capable of 100% neutralization of salt-forming groups of the water-insoluble polymer (where the salt-forming group is anionic, the neutralizing agent is sodium hydroxide, and where the salt-forming group is cationic, the neutralizing agent is acetic acid), and 200 g water, stirring (apparatus: stirring apparatus equipped with a stirring impeller, revolution speed 200 rpm, 30 min, 25° C.), and then removing the organic solvent from the mixed liquid.

The water-insoluble polymer as referred to herein is a resin that dissolves in an amount of 10 g or less when dried for 2 hours at 105° C. and then dissolved in 100 g of water at 25° C. The amount dissolved is desirably not more than 5 g, more desirably not more than 1 g. The amount dissolved refers to a state upon 100% neutralization with sodium hydroxide or acetic acid, correspondingly to the type of the salt-forming group of the water-insoluble polymer.

The aqueous medium may be composed of water or, if necessary, may also include a hydrophilic organic solvent. In accordance with an embodiment of the present invention, a composition including water and a hydrophilic organic solvent at a content ratio not more than 0.2 wt % with respect to the water is preferred, and a composition including only water is more preferred.

A main chain skeleton of the water-insoluble polymer is not particularly limited and a vinyl polymer or a condensation polymer (an epoxy resin, a polyester, a polyurethane, a polyamide, cellulose, a polyether, a polyurea, a polyimide, a polycarbonate, etc.) can be used. Among them, a vinyl polymer is preferred.

The preferred examples of vinyl polymers and monomers constituting vinyl polymers are described in Japanese Patent Application Publication Nos. 2001-181549 and 2002-088294. A vinyl polymer having a dissociative group introduced into the end of the polymer chain by radical polymerization of a vinyl monomer using a chain transfer agent, a polymerization initiator, or an iniferter having a dissociative group (or a substituent that can derive a dissociative group) or by ion polymerization using a compound having a dissociative group (or a substituent that can derive a dissociative group) for either an initiator or a stopping agent can be also used.

The preferred examples of condensation polymers and monomers constituting the condensation polymers are described in Japanese Patent Application Publication No. 2001-247787.

From the standpoint of self-dispersibility, it is preferred that the self-dispersible polymer microparticles in accordance with an embodiment of the present invention include a water-insoluble polymer including a hydrophilic structural unit and a structural unit derived from a monomer having an aromatic group.

The hydrophilic structural unit is not particularly limited provided that it is derived from a monomer including a hydrophilic group, and this structural unit may be derived from one monomer having a hydrophilic group or two or more monomers having a hydrophilic group. The hydrophilic group is not particularly limited and may be a dissociative group or a nonionic hydrophilic group.

From the standpoint of enhancing the self dispersion and also from the standpoint of stability of emulsion or dispersion state that has been formed, it is preferred that the hydrophilic group in accordance with an embodiment of the present invention be a dissociative group, more desirably an anionic dissociative group. Examples of dissociative groups include a carboxyl group, a phosphate group, and a sulfonate group. Among them, from the standpoint of fixing ability when the ink composition is configured, a carboxyl group is preferred.

From the standpoint of self-dispersibility and aggregation ability, it is preferred that the monomer having a hydrophilic group in accordance with an embodiment of the present invention be a monomer having a dissociative group, more desirably a monomer having a dissociative group that has a dissociative group and an ethylenic unsaturated body.

Examples of suitable monomers having a dissociative group include an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxymethylsuccinic acid. Specific examples of the unsaturated sulfonic acid monomer include styrenesulfonic acid, 2-acrylamido-2-methylpropanesulfonic acid, 3-sulfopropyl (meth)acrylate, and bis-(3-sulfopropyl)-itaconic acid esters. Specific examples of the unsaturated phosphoric acid monomer include vinylphosphonic acid, vinyl phosphate, bis(methacryloxyethyl) phosphate, diphenyl-2-acryloyloxyethyl phosphate, diphenyl-2-methacryloyloxyethyl phosphate, dibutyl-2-acryloyloxyethyl phosphate.

Among the monomers including a dissociative group, from the standpoint of dispersion stability and ejection stability, unsaturated carboxylic acid monomers are preferred and acrylic acid and methacrylic acid are especially preferred.

From the standpoint of self-dispersibility and aggregation speed during contact with a reaction liquid, it is preferred that the self-dispersible polymer microparticles in accordance with the present embodiment include a first polymer having a carboxyl group and an acid value (mg KOH/g) of 25 to 100. Furthermore, from the standpoint of self-dispersibility and aggregation speed during contact with a reaction liquid, it is preferred that the acid value be 25 to 80, more desirably 30 to 65. Where the acid value is not lower than 25, good stability of self-dispersibility is obtained. Where the acid value is not higher than 100, aggregation ability is improved.

The monomer including an aromatic groups is not particularly limited, provided it is a compound having an aromatic group and a polymerizable group. The aromatic group may be a group derived from an aromatic hydrocarbon or a group derived from an aromatic hetero ring. In accordance with an embodiment of the present invention, from the standpoint of particle shape stability in the aqueous medium, it is preferred that the aromatic group be derived from an aromatic hydrocarbon.

The polymerizable group may be a condensation polymerizable group or an addition polymerizable group. In accordance with the present embodiment, from the standpoint of particle shape stability in the aqueous medium, it is preferred that the polymerizable group be an addition polymerizable group, more desirably a group including an ethylenic unsaturated bond.

The monomer including an aromatic group in accordance with the present embodiment is desirably a monomer having an aromatic group derived from an aromatic hydrocarbon and an ethylenic unsaturated body, more desirably a (meth)acrylate monomer including an aromatic group. In accordance with the present embodiment, the monomer including an aromatic group of one kind may be used or a combination of monomers of two or more kinds may be used.

Examples of the monomer including an aromatic group include phenoxyethyl (meth)acrylate, benzyl (meth)acrylate, phenyl (meth)acrylate, and styrene monomers. Among them, from the standpoint of hydrophilic-hydrophobic balance of the polymer chain and ink fixing ability, it is preferred that the monomer including an aromatic group be of at least of one kind selected from phenoxyethyl (meth)acrylate, benzyl (meth)acrylate, and phenyl (meth)acrylate. Among them, phenoxyethyl (meth)acrylate is preferred, and phenoxyethyl acrylate is even more preferred.

"(Meth)acrylate" means acrylate or methacrylate.

The self-dispersible polymer microparticles in accordance with the present embodiment include a structural unit derived from a (meth)acrylate monomer including an aromatic group, and the content ratio thereof is desirably 10 wt % to 95 wt %. Where the content ratio of the (meth)acrylate monomer including an aromatic group is 10 wt % to 95 wt %, the stability of self-emulsion or dispersion state is improved. In addition, the increase in ink viscosity can be inhibited.

In accordance with an embodiment of the present invention, from the standpoint of stability of the self-dispersion state, stabilization of particle shape in the aqueous medium by hydrophobic interaction of aromatic rings with each other, and decrease in the amount of water-soluble components caused by adequate hydrophobization of the particles, it is preferred that the content ratio of the (meth)acrylate monomer including an aromatic group be 15 wt % to 90 wt %, desirably 15 wt % to 80 wt %, more desirably 25 wt % to 70 wt %.

The self-dispersible polymer microparticles in accordance with the present embodiment can be configured, for example, by a structural unit including a monomer having an aromatic group and a structural unit including a monomer having a dissociative group. If necessary, the microparticles may also include other structural units.

The monomers forming other structural units are not particularly limited, provided that they are monomers copolymerizable with the monomer having an aromatic group and the monomer having a dissociative group. Among them, from the standpoint of flexibility of the polymer skeleton and easiness of controlling the glass transition temperature (Tg), a monomer including an alkyl group is preferred.

Examples of the monomer including an alkyl group include alkyl (meth)acrylates such as methyl (meth)acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate, and ethylhexyl (meth)acrylate; ethylenic unsaturated monomers having a hydroxyl group, such as hydroxymethyl (meth)acrylate, 2-hydroxyethyl (meth)acrylate, 2-hydroxypropyl (meth) acrylate, 4-hydroxybutyl (meth)acrylate, hydroxypentyl (meth)acrylate, and hydroxyhexyl (meth)acrylate; dialkylaminoalkyl (meth)acrylates such as dimethylaminoethyl (meth)acrylate; N-hydroxyalkyl (meth)acrylamides such as N-hydroxymethyl (meth)acrylamide, N-hydroxyethyl (meth)acrylamide, and N-hydroxybutyl (meth)acrylamide; and (meth)acrylamides such as N-alkoxyalkyl (meth)acrylamides, for example, N-methoxymethyl (meth)acrylamide, N-ethoxymethyl (meth)acrylamide, N-(n-, iso)butoxymethyl (meth)acrylamide, N-methoxyethyl (meth)acrylamide, N-ethoxyethyl (meth)acrylamide, and N-(n-, iso)butoxyethyl (meth)acrylamide.

The molecular weight range of the water-insoluble polymer constituting the self-dispersible polymer microparticles in accordance with the present embodiment is desirably 3000 to 200,000, more desirably 50000 to 150,000, even more desirably 10,000 to 100,000, as a weight-average molecular weight. Where the weight-average molecular weight is not less than 3000, the amount of water-soluble components can be effectively inhibited. Where the weight-average molecular weight is not more than 200,000, self-dispersion stability can be increased. The weight-average molecular weight can be measured by gel permeation chromatography (GPC).

From the standpoint of controlling the hydrophilicity and hydrophobicity of the polymer, it is preferred that the water-insoluble polymer constituting the self-dispersible polymer microparticles in accordance with the present embodiment include a (meth)acrylate monomer including an aromatic group at a copolymerization ratio of 15 wt % to 90 wt %, a monomer including a carboxyl group, and a monomer including an alkyl group, have an acid value of 25 to 100, and have a weight-average molecular weight of 3000 to 200,000. It is even more preferred that the water-insoluble polymer constituting the self-dispersible polymer microparticles include a (meth)acrylate monomer including an aromatic group at a copolymerization ratio of 15 wt % to 80 wt %, a monomer including a carboxyl group, and a monomer including an alkyl group, have an acid value of 25 to 95, and have a weight-average molecular weight of 5000 to 150,000.

Exemplary Compounds B-01 to B-19 are presented below as specific examples of the water-insoluble polymer constituting the self-dispersible polymer microparticles, but embodiments of the present invention is not limited thereto. The weight ratio of the copolymer components is shown in the parentheses.

B-01: phenoxyethyl acrylate-methyl methacrylate-acrylic acid copolymer (50/45/5).

B-02: phenoxyethyl acrylate-benzyl methacrylate-isobutyl methacrylate-methacrylic acid copolymer (30/35/29/6).

B-03: phenoxyethyl methacrylate-isobutyl methacrylate-methacrylic acid copolymer (50/44/6).

B-04: phenoxyethyl acrylate-methyl methacrylate-ethyl acrylate-acrylic acid copolymer (30/55/10/5).

B-05: benzyl methacrylate-isobutyl methacrylate-methacrylic acid copolymer (35/59/6).

B-06: styrene-phenoxyethyl acrylate-methyl methacrylate-acrylic acid copolymer (10/50/35/5).

B-07: benzyl acrylate-methyl methacrylate-acrylic acid copolymer (55/40/5).

B-08: phenoxyethyl methacrylate-benzyl acrylate-methacrylic acid copolymer (45/47/8).

B-09: styrene-phenoxyethyl acrylate-butyl methacrylate-acrylic acid copolymer (5/48/40/7).

B-10: benzyl methacrylate isobutyl methacrylate cyclohexyl methacrylate-methacrylic acid copolymer (35/30/30/5).

B-11: phenoxyethyl acrylate-methyl methacrylate-butyl acrylate-methacrylic acid copolymer (12/50/30/8).

B-12: benzyl acrylate-isobutyl methacrylate-acrylic acid copolymer (93/2/5).

B-13: styrene-phenoxyethyl methacrylate-butyl acrylate-acrylic acid copolymer (50/5/20/25).

B-14: styrene-butyl acrylate-acrylic acid copolymer (62/35/3).

B-15: methyl methacrylate-phenoxyethyl acrylate-acrylic acid copolymer (45/51/4).

B-16: methyl methacrylate-phenoxyethyl acrylate-acrylic acid copolymer (45/49/6).

B-17: methyl methacrylate-phenoxyethyl acrylate-acrylic acid copolymer (45/48/7).

B-18: methyl methacrylate-phenoxyethyl acrylate-acrylic acid copolymer (45/47/8).

B-19: methyl methacrylate-phenoxyethyl acrylate-acrylic acid copolymer (45/45/10).

A method of manufacturing the water-insoluble polymer constituting the self-dispersible polymer microparticles in accordance with the present embodiment is not particularly limited. Examples of suitable methods include a method of performing emulsion polymerization in the presence of a polymerizable surfactant and inducing covalent coupling of the surfactant and a water-insoluble polymer and a method of copolymerizing a monomer mixture including the above-described monomer including a hydrophilic group and the monomer including an aromatic group by a well-known polymerization method such as a solution polymerization method and a lump polymerization method. Among the aforementioned polymerization methods, from the standpoint of aggregation speed and stability of deposition in the case of an aqueous ink, the solution polymerization method is preferred, and a solution polymerization method using an organic solvent is more preferred.

From the standpoint of aggregation speed, it is preferred that the self-dispersible polymer microparticles in accordance with the present embodiment include a first polymer synthesized in an organic solvent and that this first polymer be prepared as a resin dispersion having carboxyl groups and an acid number of 20 to 100, wherein at least some of carboxyl groups of the first polymer are neutralized and water is contained as a continuous phase.

Thus, the method of manufacturing the self-dispersible polymer microparticles in accordance with the present embodiment desirably includes a step of synthesizing the first polymer in an organic solvent and a dispersion step of obtaining an aqueous dispersion in which at least some of carboxyl groups of the first polymer are neutralized.

The dispersion step desirably includes the following step (1) and step (2).

Step (1): a step of stirring a mixture including a first polymer (water-insoluble polymer), an organic solvent, a neutralizing agent, and an aqueous medium.

Step (2): a step of removing the organic solvent from the mixture.

The step (1) is desirably a treatment in which the first polymer (water-insoluble polymer) is dissolved in an organic solvent, then the neutralizing agent and aqueous medium are gradually added, the components are mixed and stirred, and a dispersion is obtained. By adding the neutralizing agent and aqueous medium to a solution of the water-insoluble polymer obtained by dissolving in an organic solvent, it is possible to obtain self-dispersible polymer particles of a particle size that ensures higher stability in storage. The method of stirring the mixture is not particularly limited and a mixing and stirring apparatus of general use and, if necessary, a dispersing apparatus such as an ultrasound dispersing apparatus or a high-pressure homogenizer can be used.

An alcohol-based solvent, a ketone-based solvent, or an ether-based solvent is preferred as the organic solvent. Examples of the alcohol-based solvent include isopropyl alcohol, n-butanol, t-butanol, and ethanol. Examples of ketone solvents include acetone, methyl ethyl ketone, diethyl ketone, and methyl isobutyl ketone. Examples of ether solvents include dibutyl ether and dioxane. Among these solvents, ketone-based solvents such as methyl ethyl ketone and alcohol-based solvents such as isopropyl alcohol are preferred. Further, with the object of moderating the variations of polarity in a phase transition from an oil system to an aqueous system, it is preferred that isopropyl alcohol and methyl ethyl ketone be used together. Where the two solvents are used together, aggregation and precipitation and also fusion of particles with each other are prevented and self-dispersible polymer microparticles of a fine particle size and high dispersion stability can be obtained.

The neutralizing agent is used so that the dissociative groups be partially or completely neutralized and the self-dispersible polymer form a stable emulsion or dispersion state in water. When the self-dispersible polymer in accordance with the present embodiment has anionic dissociative groups (for example, carboxyl groups) as the dissociative groups, basic compounds such as organic amine compounds, ammonia, and alkali metal hydroxides can be used as the neutralizing agent. Examples of the organic amine compounds include monomethylamine, dimethylamine, trimethylamine, monoethylamine, diethylamine, triethylamine, monopropylamine, dipropylamine, monoethanolamine, diethanolamine, triethanolamine, N,N-dimethylethanolamine, N,N-diethylethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, and triisopropanolamine. Examples of alkali metal hydroxides include lithium hydroxide, sodium hydroxide, and potassium hydroxide. Among them, from the standpoint of stabilizing the dispersion of the self-dispersible polymer microparticles in accordance with the present embodiment in water, sodium hydroxide, potassium hydroxide, triethylamine, and triethanolamine are preferred.

These basic compounds are used desirably at 5 mol % to 120 mol %, more desirably 10 mol % to 110 mol %, and even more desirably 15 mol % to 100 mol % per 100 mol of dissociative groups. Where the ratio of the basic compound is not less than 15 mol %, the stabilization effect of particle dispersion in water is demonstrated, and where the ratio is not more than 100 mol %, the amount of water-soluble components is decreased.

In the step (2), the organic solvent is distilled out by the usual method such as vacuum distillation from the dispersion obtained in the step (1), thereby inducing phase transition to an aqueous system and making it possible to obtain an aqueous dispersion of self-dispersible polymer particles. The organic solvent contained in the obtained aqueous dispersion is substantially removed, and the amount of organic solvent is desirably not more than 0.2 wt %, more desirably not more than 0.1 wt %.

The mean particle size of the self-dispersible polymer microparticles in accordance with the present embodiment is desirably within a range of 10 nm to 400 nm, more desirably 10 nm to 200 nm, and even more desirably 10 nm to 100 nm. Particles with a mean size of 10 nm or more are more suitable for manufacture. Where the mean particle size is not more than 400 nm, stability in storage is improved.

The particle size distribution of the self-dispersible polymer microparticles in accordance with the present invention is not particularly limited, and particles with a wide particle size distribution or a monodisperse particle size distribution may be used. Furthermore, water-insoluble particles of two or more kinds may be used as a mixture.

The mean particle size and particle size distribution of the self-dispersible polymer microparticles can be measured, for example, by using a light scattering method.

The self-dispersible polymer microparticles in accordance with the present embodiment can be advantageously contained in an aqueous ink composition, and the particles of one kind may be used individually, or particles of two or more kinds may be used together.

Aqueous Liquid Medium (D)

In the aqueous ink of the inkjet recording system, the aqueous liquid medium (D) represents a mixture of water and a water-soluble organic solvent. The water-soluble organic solvent (also can be referred to hereinbelow as "solvent medium") is used as a drying preventing agent, wetting agent, and penetrating agent.

A drying preventing agent is used with the object of preventing the ink ejection port of a nozzle from clogging by the dried inkjet ink. A water-soluble organic solvent with a vapor pressure lower than that of water is preferred as the drying preventing agent and wetting agent. Further, a water-soluble organic solvent can be advantageously used as a penetrating agent with the object of ensuring better penetration of the ink for inkjet printing into the recording medium (paper and the like).

Examples of water-soluble organic solvents include alkane diols (polyhydric alcohols) such as glycerin, 1,2,6-hexanetriol, trimethylolpropane, ethylene glycol, propylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, 1,2-octanediol, 1,2-hexanediol, 1,2-pentanediol, and 4-methyl-1,2-pentanediol; sugars such as glucose, mannose, fructose, ribose, xylose, arabinose, galactose, aldonic acid, glucitol (sorbit), maltose, cellobiose, lactose, sucrose, trehalose, and maltotriose; sugar alcohols; hyaluronic acids; the so-called solid wetting agents such as urea; alkyl alcohols having 1 to 4 carbon atoms such as ethanol, methanol, butanol, propanol, and isopropanol, glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-n-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; 2-pyrrolidone, N-methyl-2-pyrrolidone, 1,3-dimethyl-2-imidazolidinone, formamide, acetamide, dimethylsulfoxide, sorbit, sorbitan, acetin, diacetin, triacetin, and sulfolan. These compounds can be used individually or in combinations of two or more thereof.

A polyhydric alcohol is useful as a drying preventing agent or a wetting agent. Examples of suitable polyhydric alcohols include glycerin, ethylene glycol, diethylene glycol triethylene glycol, propylene glycol, dipropylene glycol, tripropylene glycol, 1,3-butanediol, 2,3-butanediol, 1,4-butanediol, 3-methyl-1,3-butanediol, 1,5-pentanediol, tetraethylene glycol, 1,6-hexanediol, 2-methyl-2,4-pentanediol, polyethylene glycol, 1,2,4-butanetriol, and 1,2,6-hexanetriol. These alcohols can be used individually or in combinations of two or more thereof.

A polyol compound is preferred as a penetrating agent. Examples of aliphatic diols include 2-ethyl-2-methyl-1,3-propanediol, 3,3,-dimethyl-1,2,-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, and 2-ethyl-1,3-hexanediol. Among them, 2-ethyl-1,3-hexanediol and 2,2,4-trimethyl-1,3-pentanediol are preferred.

The water-soluble organic solvents may be used individually or in mixtures of two or more thereof. The content ratio of the water-soluble organic solvent in the ink is desirably not less than 1 wt % and not more than 60 wt %, more desirably not less than 5 wt % and not more than 40 wt %.

The amount of water added to the ink is not particularly limited, but it is desirably not less than 10 wt % and not more than 99 wt %, more desirably not less than 30 wt % and not more than 80 wt %. It is especially preferred that the amount of water be not less than 50 wt % and not more than 70 wt %.

From the standpoint of dispersion stability and ejection stability, it is preferred that the content ratio of the aqueous liquid medium (D) in accordance with the present embodiment be not less than 60 wt % and not more than 95 wt %, more desirably not less than 70 wt % and not more than 95 wt %.

Surfactant

It is preferred that a surfactant (can be also referred to hereinbelow as "surface tension adjusting agent") be added to the aqueous ink in accordance with the present embodiment. Examples of surfactants include nonionic, cationic, anionic, and betaine surfactants. The amount of the surface tension adjusting agent added to the ink is desirably such as to adjust the surface tension of the aqueous ink in accordance with the present embodiment to 20 mN/m to 60 mN/m, more desirably to 20 mN/m to 45 mN/m, and even more desirably to 25 mN/m to 40 mN/m, in order to eject the ink with an ink jet.

A compound having a structure having a combination of a hydrophilic portion and a hydrophobic portion in a molecule can be effectively used as the surfactant, and anionic surfactants, cationic surfactants, amphoteric surfactants, and nonionic surfactants can be used. Furthermore, the above-described polymer substance (polymer dispersant) can be also used as the surfactant.

Specific examples of anionic surfactants include sodium dodecylbenzenesulfonate, sodium lauryl sulfate, sodium alkyldiphenyl ether disulfonates, sodium alkyl naphthalenesulfonate, sodium dialkylsulfosuccinates, sodium stearate, potassium oleate, sodium dioctylsulfosuccinate, polyoxyethylene alkyl ether sulfuric acid sodium, polyoxyethylene alkyl ether sulfuric acid sodium, polyoxyethylene alkyl phenyl ether sulfuric acid sodium, sodium dialkylsulfosuccinates, sodium stearate, sodium oleate, and t-octylphenoxyethoxypolyethoxyethyl sulfuric acid sodium salt. These surfactants can be used individually or in combinations of two or more thereof.

Specific examples of nonionic surfactants include polyoxyethylene laurylether, polyoxyethylene octyl phenyl ether, polyoxyethylene oleyl phenyl ether, polyoxyethylene nonyl phenyl ether, oxyethylene oxypropylene block copolymer, t-octyl phenoxyethyl polyethoxy ethanol, nonyl phenoxyethyl polyethoxy ethanol. These surfactants can be used individually or in combinations of two or more thereof.

Examples of cationic surfactants include tetraalkylammonium salts, alkylamine salts, benzalkonium salts, alkylpyridium salts, and imidazolium salts. Specific examples include dihydroxyethylstearylamine, 2-heptadecenyl-hydroxyethyl imidazoline, lauryldimethylbenzyl ammonium chloride, cetyl pyridinium chloride, and stearamidomethylpyridium chloride.

The amount of the surfactant added to the aqueous ink for inkjet recording in accordance with an embodiment of the present invention is not particularly limited, but desirably this amount is not less than 1 wt %, more desirably 1 wt % to 10 wt %, and even more desirably 1 wt % to 3 wt %.

Other Components

The aqueous ink used in accordance with an embodiment of the present invention may also include other additives. Examples of other additives include such well-known additives as an ultraviolet absorbent, a fading preventing agent, an antimold agent, a pH adjusting agent, an antirust agent, an antioxidant, an emulsion stabilizer, a preservative, an antifoaming agent, a viscosity adjusting agent, a dispersion stabilizer, and a chelating agent.

Examples of the ultraviolet absorbent include a benzophenone-type ultraviolet absorbent a benzotriazole-type ultraviolet absorbent, a salicylate-type ultraviolet absorbent, a cyanoacrylate ultraviolet absorbent, and a nickel complex-type ultraviolet absorbent.

Examples of the fading preventing agent include agents of a variety of organic and metal complex systems. Examples of organic fading preventing agents include hydroquinones, alkoxyphenols, dialkoxyphenols, phenols, anilines, amines, indanes, coumarones, alkoxyanilines, and hetero rings. Examples of metal complexes include nickel complexes and zinc complexes.

Examples of the antimold agent include sodium dehydroacetate, sodium benzoate, sodium pyridinethione-1-oxide, p-hydroxybenzoic acid ethyl ester, 1,2-benzisothiazoline-3-one, sodium sorbitate, and pentachlorophenol sodium. The antimold agent is desirably used at 0.02 wt % to 1.00 wt % in the ink.

The pH adjusting agent is not particularly limited, provided that it can adjust the pH to a desired value, without adversely affecting the prepared recording ink, and the agent can be selected appropriately according to the object. Examples of suitable agents include alcohol amines (for example, diethanolamine, triethanolamine, and 2-amino-2-ethyl-1,3-propanediol), alkali metal hydroxides (for example, lithium hydroxide, sodium hydroxide, and potassium hydroxide), ammonium hydroxides (for example, ammonium hydroxide and quaternary ammonium hydroxide), phosphonium hydroxide, and alkali metal carbonates.

Examples of antirust agents include acidic sulfites, sodium thiosulfate, ammonium thiodiglycolate, diisoproplylammonium nitrate, pentaerythritol tetranitrate, dicyclohexyl ammonium nitrite.

Examples of the antioxidant include phenolic antioxidants (including hindered phenol antioxidants), amine antioxidants, sulfur-containing antioxidants, and phosphorus-containing antioxidants.

Examples of the chelating agent include ethylenediaminetetracetatic acid sodium salt, nitrilotriacetic acid sodium salt, hydroxyethylethylenediaminetriacetic acid sodium salt, diethylenetriaminepentaacetic acid sodium salt, and uramyldiacetic acid sodium salt.

Drying Unit

The drying unit 16 dries water included in the solvent separated by the coloring material aggregation action. As illustrated in FIG. 1, the drying unit includes a drying drum 76 and a first IR heater 78, a warm-air blow-out nozzle 80, and a second IR heater 82 disposed in positions facing the outer peripheral surface of the drying drum 76. The first IR heater 78 is provided upstream of the warm-air blow-out nozzle 80 in the rotation direction (counterclockwise direction in FIG. 1) of the drying drum 76, and the second IR heater 82 is provided downstream of the warm-air blow-out nozzle 80.

The drying drum 76 is a drum that holds the recording medium 22 on the outer peripheral surface thereof and rotationally conveys the recording medium. The rotation of the drying drum is driven and controlled by the below-described motor driver 108 (see FIG. 13). Further, the drying drum 76 is provided on the outer peripheral surface thereof with hook-shaped holding device (device identical to a below-described holding device 73 illustrated in FIG. 4). The leading end of the recording medium 22 is held by the holding device. In a state in which the leading end of the recording medium 22 is held by the holding device, the drying drum 76 is rotated to convey rotationally the recording medium. In this case, the recording medium 22 is conveyed so that the recording surface thereof faces outside. The drying treatment is carried out by the first IR heater 78, warm-air blow-out nozzle 80, and second IR heater 82 with respect to the recording surface of the recording medium.

The warm-air blow-out nozzle 80 is configured to blow hot air at a high temperature (for example, 50° C. to 70° C.) at a constant blowing rate (for example, 12 $m^3$/min) toward the recording medium 22, and the first IR heater 78 and second IR heater 82 are controlled to respective high temperature (for example, 180° C.). Water included in the ink solvent on the recording surface of the recording medium 22 held by the drying drum 76 is evaporated by heating with these first IR heater 78, warm-air blow-out nozzle 80, and second IR heater 82 and drying treatment is performed. In this case, because the drying drum 76 of the drying unit 16 is structurally separated from the image formation drum 70 of the image formation unit 14, the number of ink non-ejection events caused by drying of the head meniscus portion by thermal drying can be reduced in the inkjet heads 72C, 72M, 72Y, 72K. Further, there is a degree of freedom in setting the temperature of the drying unit 16, and the optimum drying temperature can be set.

The evaporated moisture may be released to the outside of the apparatus with a release device (not illustrated in the drawings). Further, the recovered air may be cooled with a cooler (radiator) or the like and recovered as a liquid.

The outer peripheral surface of the aforementioned drying drum 76 may be controlled to a predetermined temperature (for example, not higher than 60° C.).

The drying drum 76 may be provided with suction holes on the outer peripheral surface thereof and connected to a suction device which performs suction from the suction holes. As a result, the recording medium 22 can be tightly held on the circumferential surface of the drying drum 76.

Fixing Unit

Figure 6:
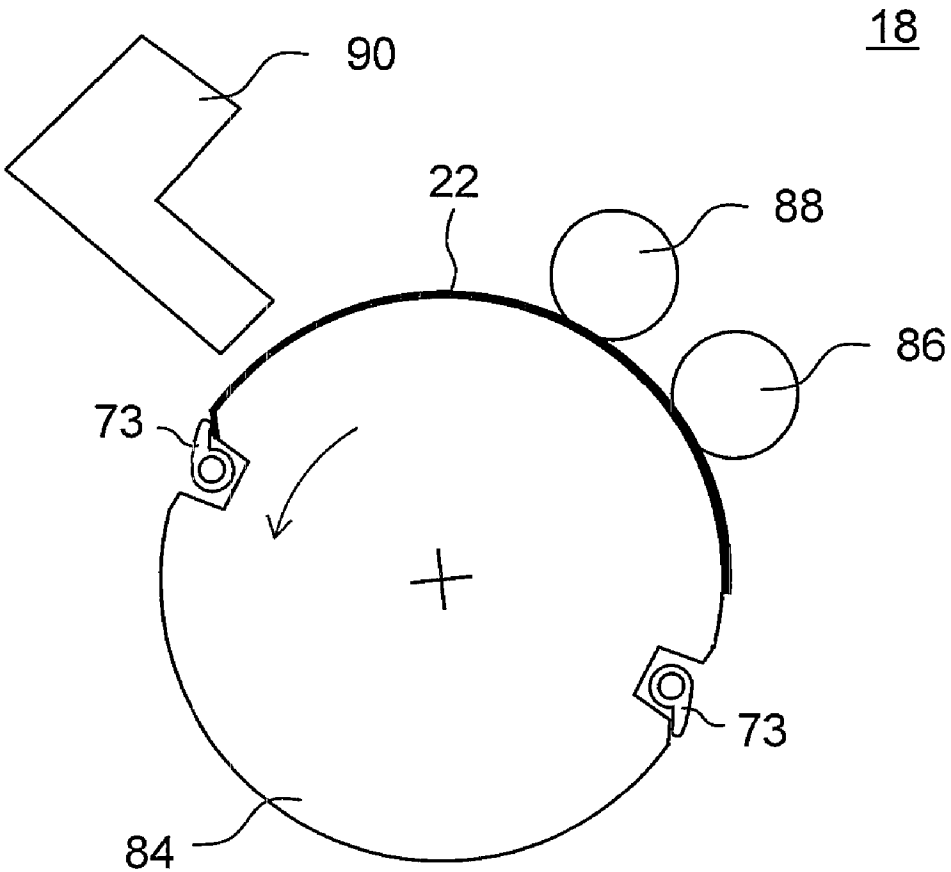
FIG. 6 is a structural diagram illustrating the fixing unit.

As illustrated in FIG. 6, the fixing unit 18 includes a fixing drum 84, a first fixing roller 86, a second fixing roller 88, and an in-line sensor 90. The first fixing roller 86, second fixing roller 88, and in-line sensor 90 are arranged in positions opposite the circumferential surface of the fixing drum 84 in the order of description from the upstream side in the rotation direction (counterclockwise direction in FIG. 6) of the fixing drum 84.

The fixing drum 84 holds the recording medium 22 on the outer peripheral surface thereof, rotates, and conveys the recording medium. The rotation of the fixing drum is driven and controlled by a motor driver 108 (see FIG. 13) described below. The fixing drum 84 has a hook-shaped holding device (device identical to the holding device 73 illustrated in FIG. 4), and the leading end of the recording medium 22 can be held by this holding device. The recording medium 22 is rotated and conveyed by rotating the fixing drum 84 in a state in which the leading end of the recording medium is held by the holding device. In this case, the recording medium 22 is conveyed so that the recording surface thereof faces outside, and the fixing treatment by the first fixing roller 86 and second fixing roller 88 and the inspection by the in-line sensor 90 are performed with respect to the recording surface.

The first fixing roller 86 and second fixing roller 88 are roller members serving to fix the image formed on the recording medium 22 and they are configured to apply a pressure and heat the recording medium 22. Thus, the first fixing roller 86 and second fixing roller 88 are arranged so as to be pressed against the fixing drum 84, and a nip roller is configured between them and the fixing drum 84. As a result, the recording medium 22 is squeezed between the first fixing roller 86 and the fixing drum 84 and between the second fixing roller 88 and the fixing drum 84, nipped under a predetermined nip pressure (for example, 1 MPa), and subjected to fixing treatment. An elastic layer may be formed on the surface of one from the first fixing roller 86, second fixing roller 88, and fixing drum 84 to obtain a configuration providing a uniform nip width with respect to the recording medium 22.

Further, the first fixing roller 86 and second fixing roller 88 are configured by heating rollers in which a halogen lamp is incorporated in a metal pipe, for example from aluminum, having good thermal conductivity and the rollers are controlled to a predetermined temperature (for example 60° C. to 80° C.). Where the recording medium 22 is heated with the heating roller, thermal energy not lower than a Tg temperature (glass transition temperature) of a latex included in the ink is applied and latex particles are melted. As a result, fixing is performed by penetration into the concavities-convexities of the recording medium 22, the concavities-convexities of the image surface are leveled out, and gloss is obtained.

In the above-described embodiment, heating and pressure application are used in combination, but only one of them may be performed. Further, depending on the thickness of image layer and Tg characteristic of latex particles, the first fixing roller 86 and second fixing roller 88 may have a configuration provided with a plurality of steps. Furthermore, the surface of the fixing drum 84 may be controlled to a predetermined temperature (for example 60° C.).

On the other hand, the in-line sensor 90 is a measuring device which measures the check pattern, moisture amount, surface temperature, gloss, and the like of the image fixed to the recording medium 22. A CCD sensor or the like can be used for the in-line sensor 90.

The in-line detection unit 90 comprises an image sensor (line sensor, or the like) for capturing an image of the print results of the printing unit 14 (the droplet ejection results of the respective inkjet heads 72C, 72M, 72Y and 72K) and functions as a device for checking for nozzle blockages and other ejection abnormalities and non-uniformities in the image of ejected droplets (density non-uniformities), on the basis of the image of ejected droplets read in by the image sensor.

For example, a test pattern is formed on the image recording region or non-image portion of the recording medium 22, and this test pattern is read in by the in-line detection unit 90 and in-line detection is carried out to detect density non-uniformities and to judge the presence or absence of abnormalities in each of the nozzles on the basis of the read results.

The in-line detection unit 90 employed in the present embodiment is constituted by a line CCD in which one row or a plurality of rows each comprising a plurality of detection elements (photoelectric transducer elements) are aligned in the breadthways direction of the recording medium 22 (or an area sensor in which a plurality of detection elements are arranged in a two-dimensional configuration), and a lens which is disposed so as to read in simultaneously the breadthways direction of the recording medium 22 by means of the line CCD (or area sensor). Instead of a line sensor having a scanning field capable of reading in the whole recordable width simultaneously, it is also possible to adopt a mode using a sensor having a narrower reading range than this, which performs reading while moving (scanning) the reading position).

With the fixing unit 18 of the above-described configuration, the latex particles located within a thin image layer formed in the drying unit 16 are melted by pressure application and heating by the first fixing roller 86 and second fixing roller 88. Therefore, the latex particles can be reliably fixed to the recording medium 22. In addition, with the fixing unit 18, the fixing drum 84 is structurally separated from other drums. Therefore, the temperature of the fixing unit 18 can be freely set separately from the image formation unit 14 and drying unit 16.

Further, the above-described fixing drum 84 may be provided with suction holes on the outer peripheral surface thereof and connected to a suction device which performs suction from the suction holes. As a result, the recording medium 22 can be tightly held on the circumferential surface of the fixing drum 84.

Discharge Unit

As illustrated in FIG. 1, the discharge unit 20 is provided after the fixing unit 18. The discharge unit 20 includes a discharge tray 92, and a transfer drum 94, a conveying belt 96, and a tension roller 98 are provided between the discharge tray 92 and the fixing drum 84 of the fixing unit 18 so as to face the discharge tray and the fixing drum. The recording medium 22 is fed by the transfer drum 94 onto the conveying belt 96 and discharged into the discharge tray 92.

Structure of Ink Heads

The structure of ink heads will be described below. Because inkjet heads 72C, 72M, 72Y, 72K have a common structure, an ink head representing them will be denoted below with a reference symbol 500.

Figure 7A:
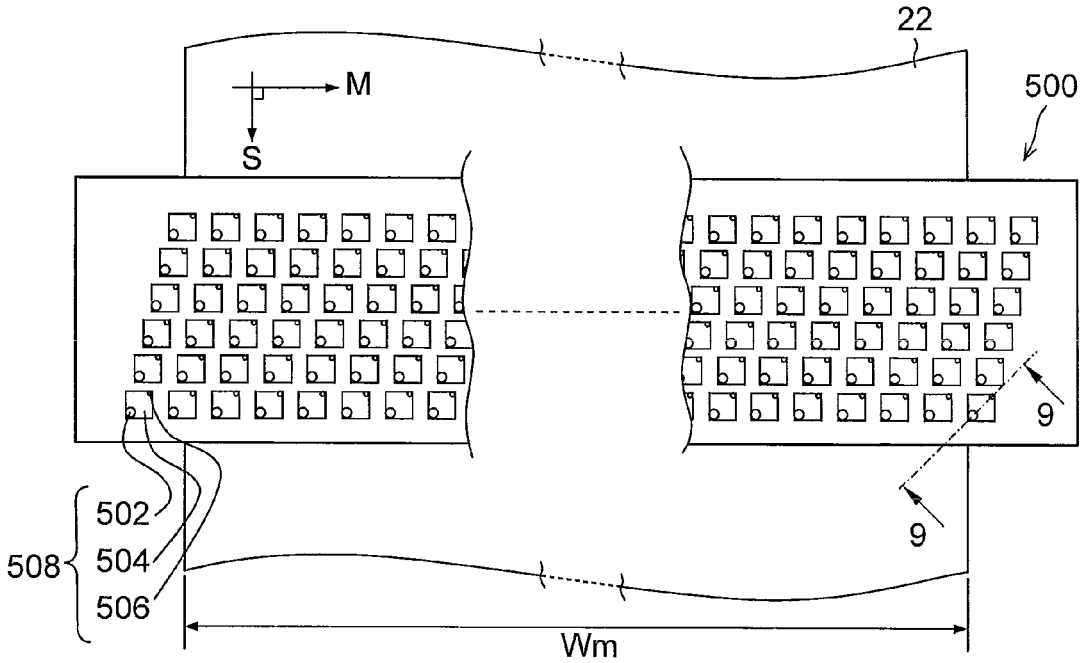
FIG. 7A is a plan view perspective diagram illustrating an example of the structure of a head.
Figure 7B:
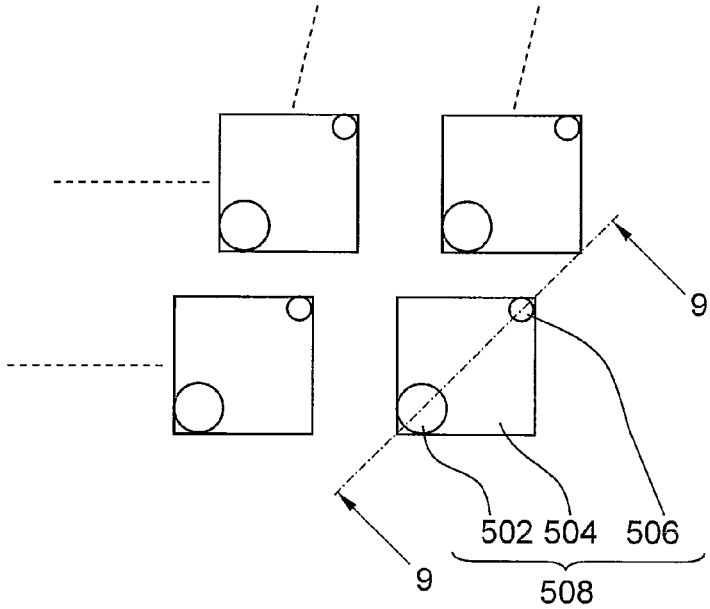
FIG. 7B is an enlarged view of same.

FIG. 7A is a planar perspective view illustrating a structure of the ink head 500. FIG. 7B is an enlarged view of part thereof. A nozzle pitch density in the ink head 500 has to be increased in order to increase the pitch density of dots printed on the recording medium 22. As illustrated in FIGS. 7A and 7B, the ink head 500 of the present example has a structure in which a plurality of ink chamber units (liquid droplet ejection elements serving as recording element units) 508, each including a nozzle 502 serving as an ink ejection port and a pressure chamber 504 corresponding to the nozzle 502, are arranged in a zigzag manner as a matrix (two-dimensional configuration). As a result, it is possible to increase substantially the density of nozzle spacing (projected nozzle pitch) that is projected to ensure alignment along the longitudinal direction of the head (direction perpendicular to the conveyance direction of the recording medium 22).

Figure 8:
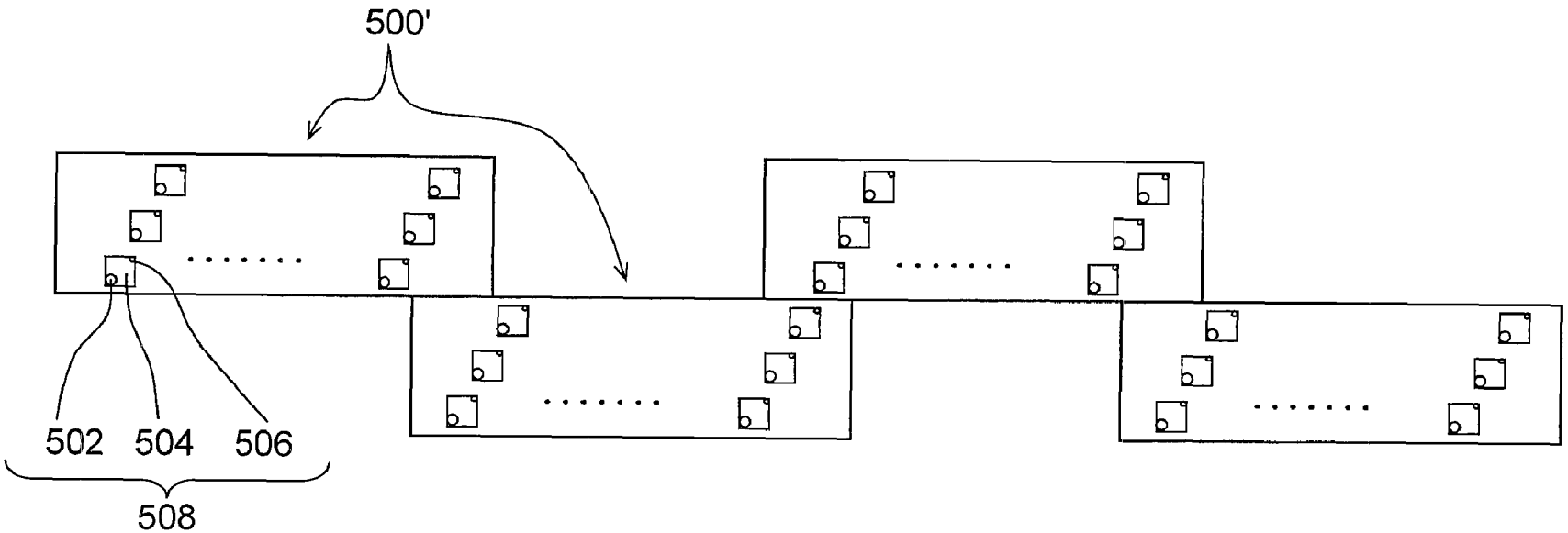
FIG. 8 is a plan view perspective diagram illustrating a further example of the structure of a head.

A mode of configuring at least one nozzle column along a length corresponding to the entire width of the image formation region of the recording medium 22 in the direction (arrow M in FIGS. 7A and 7B) that is almost perpendicular to the conveyance direction (arrow S in FIGS. 7A and 7B) of the recording medium 22 is not limited to the example illustrated in the drawing. For example, instead of the configuration illustrated in FIG. 7A, a line head that as a whole has a nozzle row of a length corresponding to the entire width of the image formation region of the recording medium 22 may be configured by arranging in a zigzag manner short head modules 100' in which a plurality of nozzles 502 are arranged two-dimensionally and enlarging the length by joining the modules together as illustrated in FIG. 8.

The pressure chamber 504 provided correspondingly to each nozzle 502 has an almost square shape in the plan view thereof (see FIGS. 7A and 7B), an outflow port to the nozzle 502 is provided in one of the two corners on a diagonal of the pressure chamber, and an inflow port (supply port) 506 of the supplied ink is provided in the other corner on the diagonal. The shape of the pressure chamber 504 is not limited to that of the present example, and a variety of planar shapes, for example, a polygon such as a rectangle (rhomb, rectangle, etc.), a pentagon, and an octagon, a circle, and an ellipse can be employed.

Figure 9:
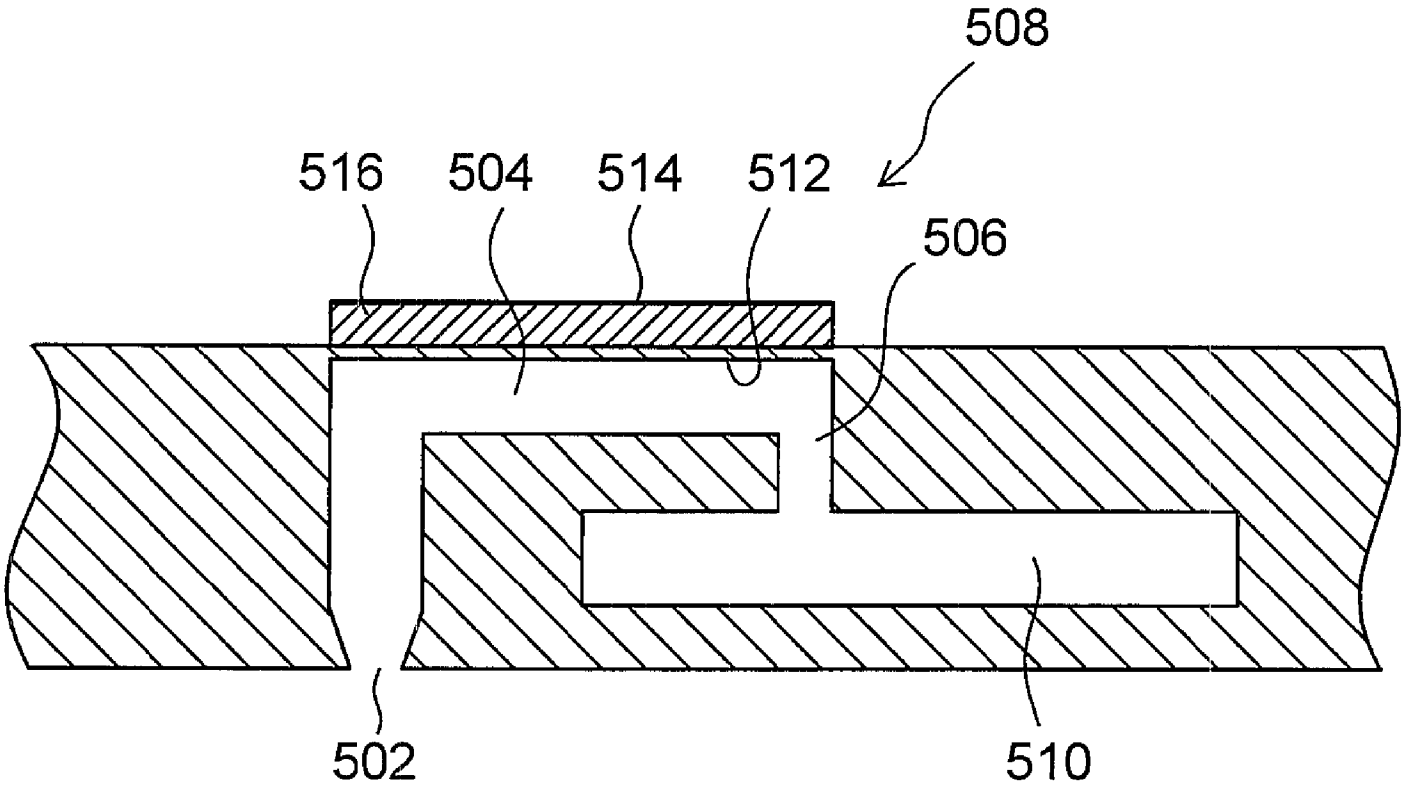
FIG. 9 is a cross-sectional view along line 9-9 in FIGS. 7A and 7B.

FIG. 9 is a cross-sectional view (cross-sectional view along line 9-9 in FIGS. 7A and 7B) illustrating a three-dimensional configuration of a droplet ejection element (ink chamber unit corresponding to one nozzle 502) of one channel that serves as a recording element unit in the ink head 500.

As illustrated in FIG. 9, each pressure chamber 504 communicates with a common flow channel 510 via the supply port 506. The common flow channel 510 communicates with an ink tank (not illustrated in the drawing) that serves as an ink supply source, and the ink supplied from the ink tank is supplied into each pressure chamber 504 via the common flow channel 510.

An actuator 516 having an individual electrode 514 is joined to a pressure application plate (oscillation plate also used as a common electrode) 512 that configures part of the surface (top surface in FIG. 9) of the pressure chamber 504. Where a drive voltage is applied between the individual electrode 514 and the common electrode, the actuator 516 is deformed, the volume of the pressure chamfer 504 changes, and the ink is ejected from the nozzle 502 by the variation in pressure that follows the variation in volume. A piezoelectric element using a piezoelectric material such as lead titanate zirconate or barium titanate can be advantageously used in the actuator 516. When the displacement of the actuator 516 returns to the original state after the ink has been ejected, the pressure chamber 504 is refilled with new ink from the common flow channel 510 via the supply port 506.

An ink droplet can be ejected from the nozzle 502 by controlling the drive of the actuator 516 correspondingly to each nozzle 502 according to dot data generated by a digital half toning processing from the input image. By controlling the ink ejection timing of each nozzle 502 according to the conveyance speed on the recording medium 22, while conveying the recording medium with a constant speed in the sub-scanning direction, it is possible to record the described image on the recording medium 22.

Figure 10:
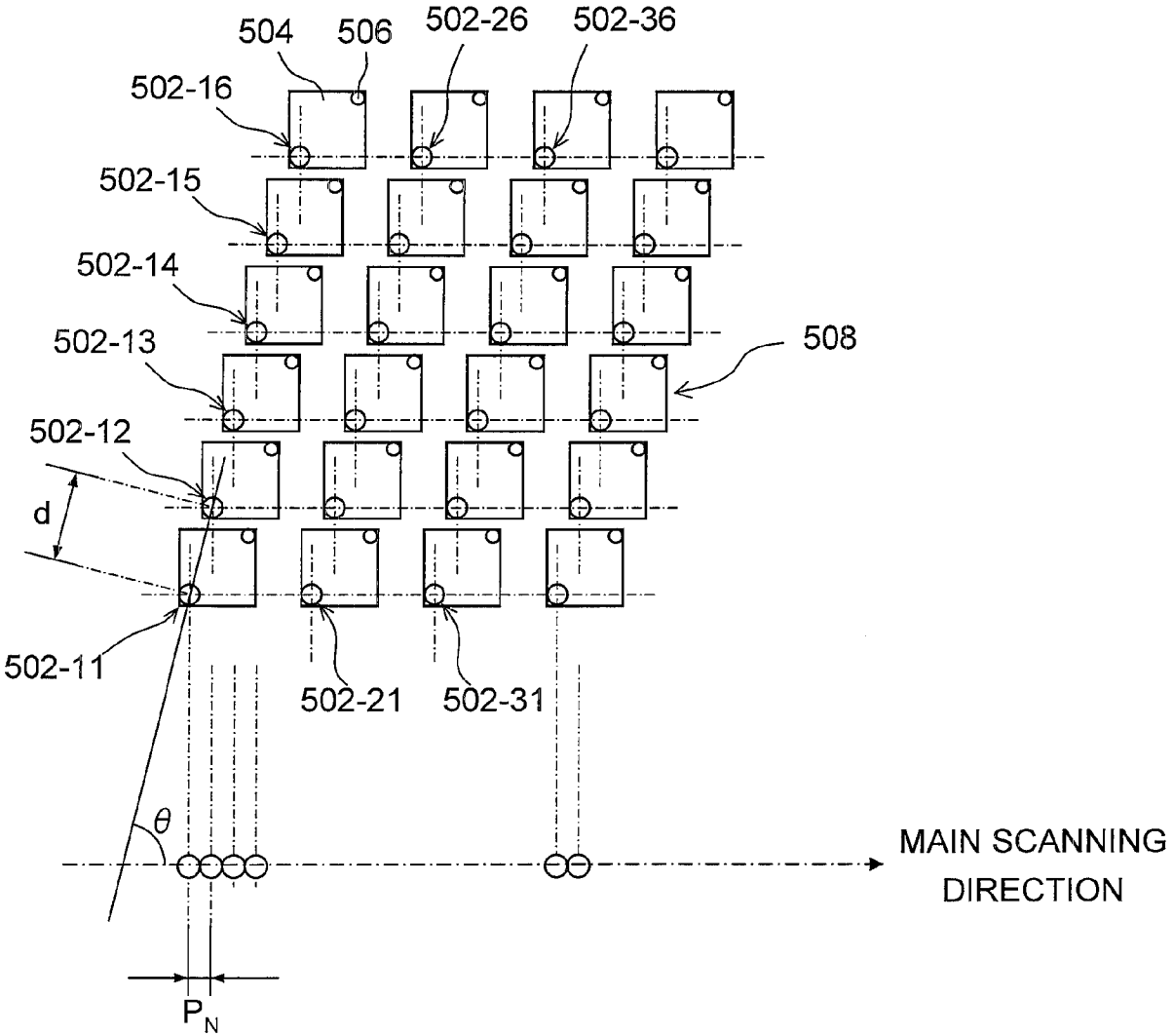
FIG. 10 is an enlarged view illustrating a nozzle arrangement in the print head illustrated in FIGS. 7A and 7B.

A high-density nozzle head of the present example is realized by arranging a large number of ink chamber units 508 having the above-described configuration in a grid-like manner with a constant arrangement pattern along a row direction coinciding with the main scanning direction and an oblique column direction that is inclined at a certain angle θ, rather than perpendicular, to the main scanning direction, as illustrated in FIG. 10.

Thus, with a structure in which a plurality of ink chamber units 508 are arranged with a constant pitch, d, along a direction inclined at a certain angle θ to the main scanning direction, a pitch, P, of nozzles projected (front projection) to be aligned in the main scanning direction will be $d \times \cos\theta$, and with respect to the main scanning direction, the configuration can be handled as equivalent to that in which the nozzles 502 are arranged linearly with a constant pitch PN. With such a configuration, it is possible to realize a substantial increase in density of nozzle columns that are projected so as to be aligned in the main scanning direction.

When the nozzles are driven with a full line head that has a nozzle column of a length corresponding to the entire printable width, the drive can be performed by: (1) simultaneously driving all the nozzles, (2) successively driving the nozzles from one side to the other, and (3) diving the nozzles into blocks and successively driving in each block from one side to the other. A nozzle drive such that one line (a line produced by dots of one column or a line composed of dots of a plurality of columns) is printed in the direction perpendicular to the conveyance direction of the recording medium 22 is defined as main scanning.

In particular, when the nozzles 502 arranged in a matrix such as illustrated in FIG. 10 are driven, the main scanning of the above-described type (3) is preferred. Thus, nozzles 502-11, 502-12, 502-13, 502-14, 502-15, and 502-16 are taken as one block (also, nozzles 502-21, . . . , 502-26 are taken as one block, nozzles 502-31, 502-36 are taken as one block) and the nozzles 502-11, 502-12, . . . , 502-16 are successively driven in accordance with the conveyance speed of the recording medium 22, thereby printing one line in the direction perpendicular to the conveyance diction of the recording medium 22.

On the other hand, a process in which printing of one line (a line produced by dots of one column or a line composed of dots of a plurality of columns) formed in the aforementioned main scanning area is repeated by moving the above-described full line head and the recording medium 22 relative to each other is defined as sub-scanning.

Accordingly, the direction indicated by one line (or a longitudinal direction of a band-like region) recorded in the above-described main scanning is called a main scanning direction, whereas the direction in which the aforementioned sub-scanning is performed called a sub-scanning direction. Thus, in the present embodiment, the conveyance direction of the recording medium 22 will be called a sub-scanning direction, and the direction perpendicular thereto will be called a main scanning direction. The arrangement structure of the nozzles in the implementation of the present invention is not limited to that illustrated by way of an example in the drawings.

Further, in the present embodiment, a system is employed in which ink droplets are ejected by the deformation of an actuator 516 such as peizoelement (piezoelectric element), but a system for ejecting the ink in the implementation of the present invention is not particularly limited, and a variety of systems can be employed instead of the piezo jet system. An example of another suitable system is a thermal jet system in which the ink is heated by a heat-generating body such as a heater, gas bubbles are generated, and the ink droplets are ejected by the pressure of gas bubbles.

Composition of Ink Supply System

Figure 11:
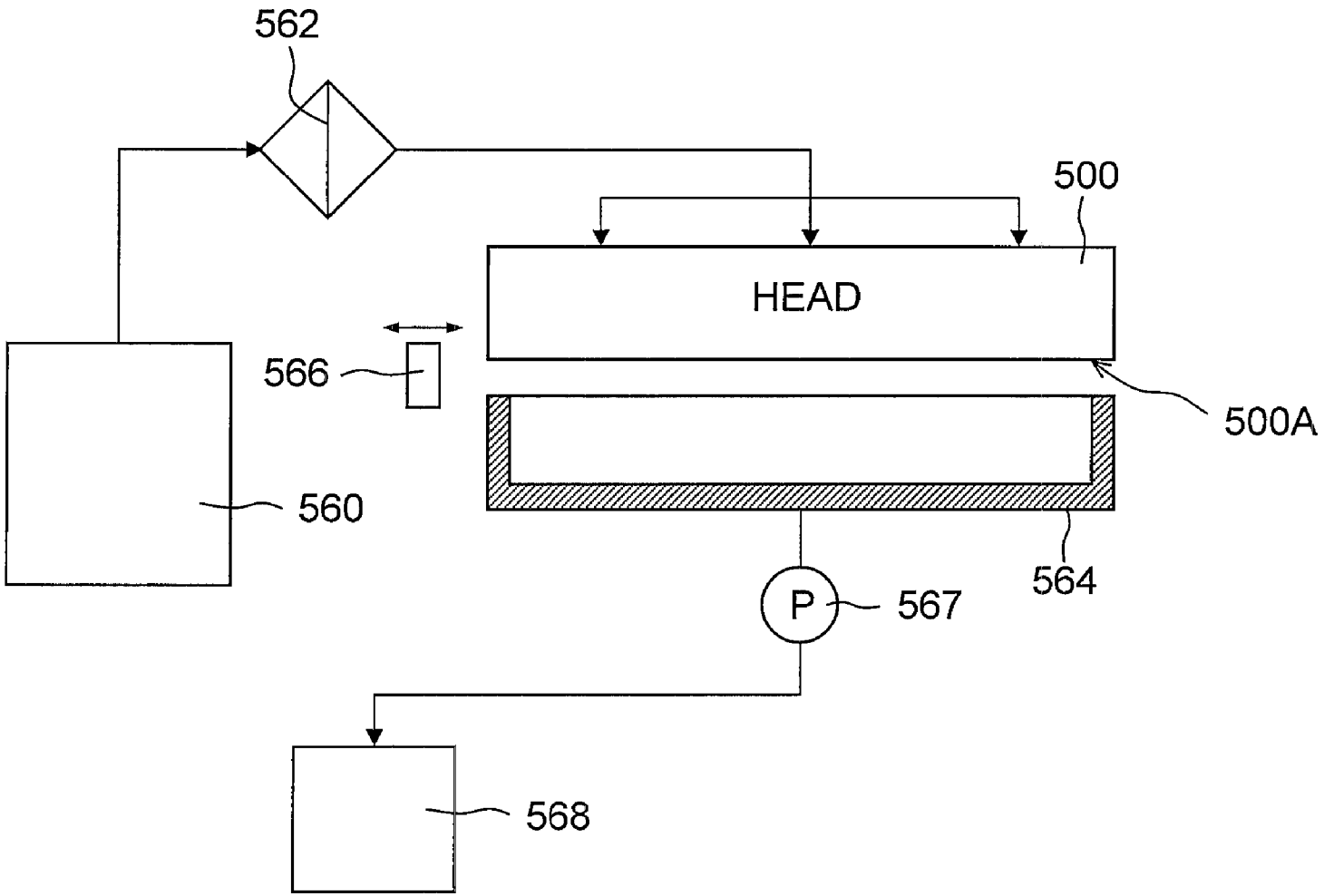
FIG. 11 is a schematic drawing of an ink supply system.

FIG. 11 is a schematic drawing illustrating the composition of an ink supply system in the inkjet recording apparatus 1. Here, the ink supply system is described, but if a treatment liquid is ejected as droplets from an ejection head similar to an inkjet head, then a treatment liquid supply system similar to that illustrated in FIG. 11 may be provided.

The ink tank 560 is a base tank for supplying ink to the head 500. The ink tank 560 may employ a mode where ink is replenished via a replenishment port (not illustrated) when the remaining amount of ink has become low, or a cartridge system where each tank is replaced individually. If the type of ink is changed in accordance with the usage, then a cartridge system is suitable. In this case, desirably, ink type information is identified by means of a bar code or the like, and ejection is controlled in accordance with the type of ink.

As illustrated in FIG. 11, a filter 562 for removing foreign material and gas bubbles is provided between the ink tank 560 and the head 500. The filter mesh size is desirably equal to or smaller than the nozzle diameter. Although not illustrated in FIG. 11, a desirable composition is one in which a sub tank is provided in the vicinity of, or in an integrated fashion with, the head 500. The sub tank has a function of improving the damping effect of preventing internal pressure variations in the head, as well as improving refilling characteristics.

Furthermore, a cap 564 forming a device for preventing drying of the nozzles 502 and increase in viscosity of the ink in the vicinity of the nozzles, and a cleaning wiper 566 forming a cleaning device for the nozzle surface 500A, are provided in the inkjet recording apparatus 1. A maintenance unit (restoration device) including this cap 564 and cleaning wiper 566 is movable relatively with respect to the head 500 by means of a movement mechanism (not illustrated), and is moved to a maintenance position below the head 500 from a prescribed withdrawn position in accordance with requirements.

The cap 564 is displaced upward and downward in a relative fashion with respect to the head 500 by an elevator mechanism (not illustrated). When the power is switched off or at print standby, the cap 564 is raised until a prescribed raised position and is placed in tight contact with the head 500, whereby the nozzle surface 500A is covered by the cap 564.

The cleaning wiper 566 is constituted by an elastic member made of rubber, or the like, and can be slided over the nozzle surface 500A of the head 500 (nozzle plate surface) by means of a wiper movement mechanism (not illustrated). If ink droplets or foreign matter become attached to the surface of the nozzle plate, the nozzle surface is wiped by sliding the cleaning wiper 566 over the nozzle plate.

During printing or during standby, if the use frequency of a particular nozzle has become low and the viscosity of the ink in the vicinity of the nozzle has increased, then preliminary ejection (purging) is carried out toward the cap 564 (which also serves as an ink receptacle) in order to expel this degraded ink.

If the head 500 continues in a state in which ink is not ejected from the head 500 for a certain amount of time or longer, the ink solvent in the vicinity of the nozzles 502 evaporates and the ink viscosity increases. In such a state, ink can no longer be ejected from the nozzles 502 even if the actuators 516 for driving ejection are operated. Therefore, before a state of this kind is reached (while the ink is in a range of viscosity which allows ink to be ejected by means of operation of the actuators 516), a "preliminary ejection" is carried out, whereby the actuators 516 are operated and the ink in the vicinity of the nozzles, which is of raised viscosity, is ejected toward the ink receptacle.

Furthermore, after cleaning away soiling on the surface of the nozzle plate by means of a wiper, such as a cleaning wiper 566, which is provided as a cleaning device on the nozzle surface 500A, a preliminary ejection is also carried out in order to prevent infiltration of foreign matter into the nozzles 502 due to the wiping action of the wiper.

On the other hand, if air bubbles become intermixed into the nozzles 502 or pressure chambers 504, or if the rise in the viscosity of the ink inside the nozzles 502 exceeds a certain level, then it may not be possible to eject ink in the preliminary ejection operation described above. In cases of this kind, a cap 564 forming a suction device is pressed against the nozzle surface 500A of the print head 500, and the ink inside the pressure chambers 504 (namely, the ink containing air bubbles of the ink of increased viscosity) is suctioned by a suction pump 567. The ink suctioned and removed by means of this suction operation is sent to a recovery tank 568. The ink collected in the recovery tank 568 may be used, or if reuse is not possible, it may be discarded. Since the suctioning operation is performed with respect to all of the ink in the pressure chambers 504, it consumes a large amount of ink, and therefore, desirably, restoration by preliminary ejection is carried out while the increase in the viscosity of the ink is still minor. The suction operation is also carried out when ink is loaded into the print head 500 for the first time, and when the head starts to be used after being idle for a long period of time. Furthermore, a composition is adopted whereby maintenance of the head 500, such as preliminary ejection or a suctioning operation, is carried out in a state where the head 500 has been withdrawn from a printing position directly above the printing drum 70 to a prescribed maintenance position (for example, a position outside the drum in the axial direction of the printing drum 70).

First Example of Method of Judging Head Replacement Time

Figure 12:
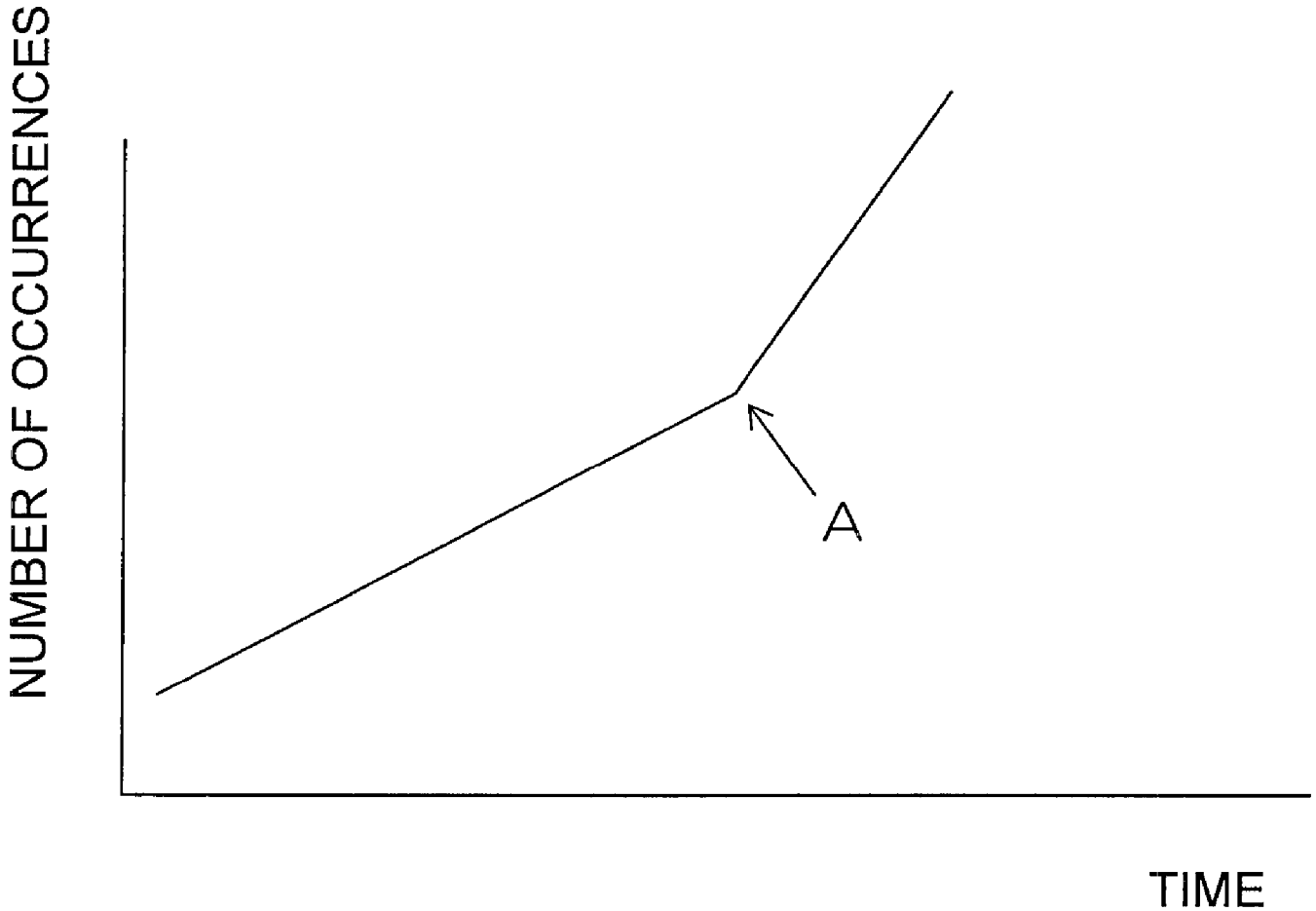
FIG. 12 is an illustrative diagram illustrating a first example of a method of judging the head replacement time.

The number of occurrences of nozzle defects (non-ejection from a nozzle) or deviation of the ejection direction which cannot be restored by normal maintenance is detected by the in-line detection unit 90 and plotted against a time line. FIG. 12 illustrates an example of this. The horizontal axis represents time and the vertical axis represents the number of occurrences of nozzle defects and deviation of the ejection direction which are not restored by normal maintenance.

Normal maintenance means an operation of restoring ejection performance including at least one operation of wiping of the nozzle surface by means of a cleaning wiper 566, or the like, purging (preliminary ejection, dummy ejection), or nozzle suctioning, and desirably, these operations are combined appropriately and a plurality of operations are carried out in accordance with requirements. This normal maintenance operation is carried out automatically in response to an operational sequence based on the program of the apparatus or the input of an instruction by the operator, and in general, is executed at a suitable timing, either when the apparatus is started up, when an ink tank is replaced, when a new print job is started, when a certain number of prints has been printed, when a non-printing state has continued for a certain period of time, or the like.

As opposed to this, the tasks of head replacement or intensive maintenance aim to restore ejection characteristics by means of an operator or service technician opening the outer panel (frame) of the apparatus, for instance, and carrying out individual remedial tasks as necessary, such as removing or disassembling, cleaning or replacing components, and the like.

During a head replacement or intensive maintenance task, printing becomes impossible for a long period of time, and these tasks are substantially equivalent in that they are able to return the ejection performance of the head to an initial state (a state generally the same as that upon shipment of the apparatus) when the task is completed. Here, in order to simplify the description, "head replacement" is described as an example, but the same applies if intensive maintenance is carried out instead of "head replacement".

As illustrated in FIG. 12, if the elapsed time from the initial state (shipment of the apparatus or head replacement) is plotted on the horizontal axis and the number of occurrences of ejection abnormalities detected after carrying out normal maintenance is plotted on the vertical axis, then the time when the number of occurrences starts to increase (the turning point of the graph) is taken as the head replacement point.

After a normal maintenance operation, a test pattern is printed in which a line pattern is recorded by each individual nozzle, and by reading in this test pattern by means of the in-line detection unit 90, the number of occurrences of ejection failure and abnormal deviation of the ejection direction (where the deviation in the depositing position exceeds a prescribed acceptable value) is counted, and this value is stored together with the measurement date and time (elapsed time) in a storage device (for example, a non-volatile memory in the apparatus, or the like), thereby producing a graph such as that illustrated in FIG. 12.

As illustrated in FIG. 12, as time passes, the number of defective nozzles which are not restored by normal maintenance increases, and at a certain time (the turning point indicated by "A" in FIG. 12), the number of occurrences of ejection abnormalities rises sharply. Until reaching point A, this number increases linearly at a generally uniform gradient, and after point A, the gradient increases sharply. When a sharp increasing trend of this kind is observed, replacement of the head is prompted.

The number of occurrences of ejection abnormalities is traced and when a large gradient exceeding a specified value has been detected, a warning which prompts replacement of the head is output. Alternatively, instead of or in combination with this warning, it is also possible to implement control for transferring automatically to a prescribed compulsory maintenance mode.

The compulsory maintenance mode referred to here is the programmed implementation of restoration processing and restoration operations which are even more rigorous than the normal maintenance operation.

Second Example of Method of Judging Head Replacement Time

Furthermore, as a further method, it is also possible to employ the method described below.

Here, the term "ejection abnormality" is used as a general term which encompasses nozzle defects (ejection failure, non-ejection) and abnormal deviation of the ejection direction. The time at which one ejection abnormality occurs after replacing a head having a plurality of nozzles (restoration of initial characteristics), is taken as "t". If the total number of nozzles in the head (total nozzle number) is taken as "a", then the occurrence rate n of ejection abnormalities after time x can be expressed stochastically as $n=x/t$.

In other words, an ejection abnormality can be expected to occur in x/t nozzles of the nozzles, after a time x. On the other hand, as specifications for non-uniformity compensation processing for compensating density non-uniformities caused by ejection abnormalities by means of ejection of droplets from adjacent nozzles, for example, a case where an abnormality has occurred in one nozzle of five mutually adjacent nozzles, for example, is designed as the limit at which the compensating function is effective, and if ejection abnormalities occur in more nozzles than this, then it is not possible to respond by means of the compensating function. In the case of an apparatus equipped with an automatic compensating function of this kind, it is difficult to compensate non-uniformities if a plurality of nozzles amongst the four adjacent nozzles produce ejection abnormalities simultaneously.

The probability that one or a plurality of ejection abnormalities has already occurred and that the point (nozzle position) where the next ejection abnormality occurs is within four nozzle positions of the point of a previous ejection abnormality is $8n/(a-n)$, and the time for head replacement is judged to have arrived at the time that a number of ejection abnormalities has occurred whereby this probability becomes b %, in other words, at the time that $8n/(a-n)=b/100$.

The time "t" at which one ejection abnormality occurs varies depending on the method of use and the operating environment, but desirably data up to this time is stored and recalculated each time an ejection fault or deviation of the ejection direction occurs. In other words, desirably, each time the number of ejection abnormalities is counted, the number of occurrences and data about the elapsed time is stored, and the value of "t" is recalculated, thereby correcting t to a more appropriate value. Moreover, a desirable mode is one in which data of various apparatuses is gathered by a remote monitoring system (FIG. 22) which is described hereinafter, the defect occurrence time t is calculated for each model of apparatus, and these results are obtained.

Furthermore, desirably, if the probability of the occurrence of an ejection abnormality accelerates in accordance with the time, then the rate of acceleration is also included in the stored information.

The value of the probability b % which forms a judgment reference for the head replacement time can be set to any desired value, but desirably, it is set in the range of 0.5% to 20%, and more desirably, the range of 1% to 10%. Particularly desirably, the value of b is set in the range of 3% to 7%. If the value is below this range, then it becomes necessary to replace the head frequently, and if the value is above this range, then there is inevitably an increased frequency of cases where a warning is not issued, even if there is an ejection abnormality in which the non-uniformity cannot be compensated. Desirably, the printing apparatus is not halted within a range where a problem does not arise in the printed item, and from the viewpoint of maintaining productivity and suppressing the frequency of replacement, the reference value (b %) should be set to the range described above.

Description of Control System

Figure 13:
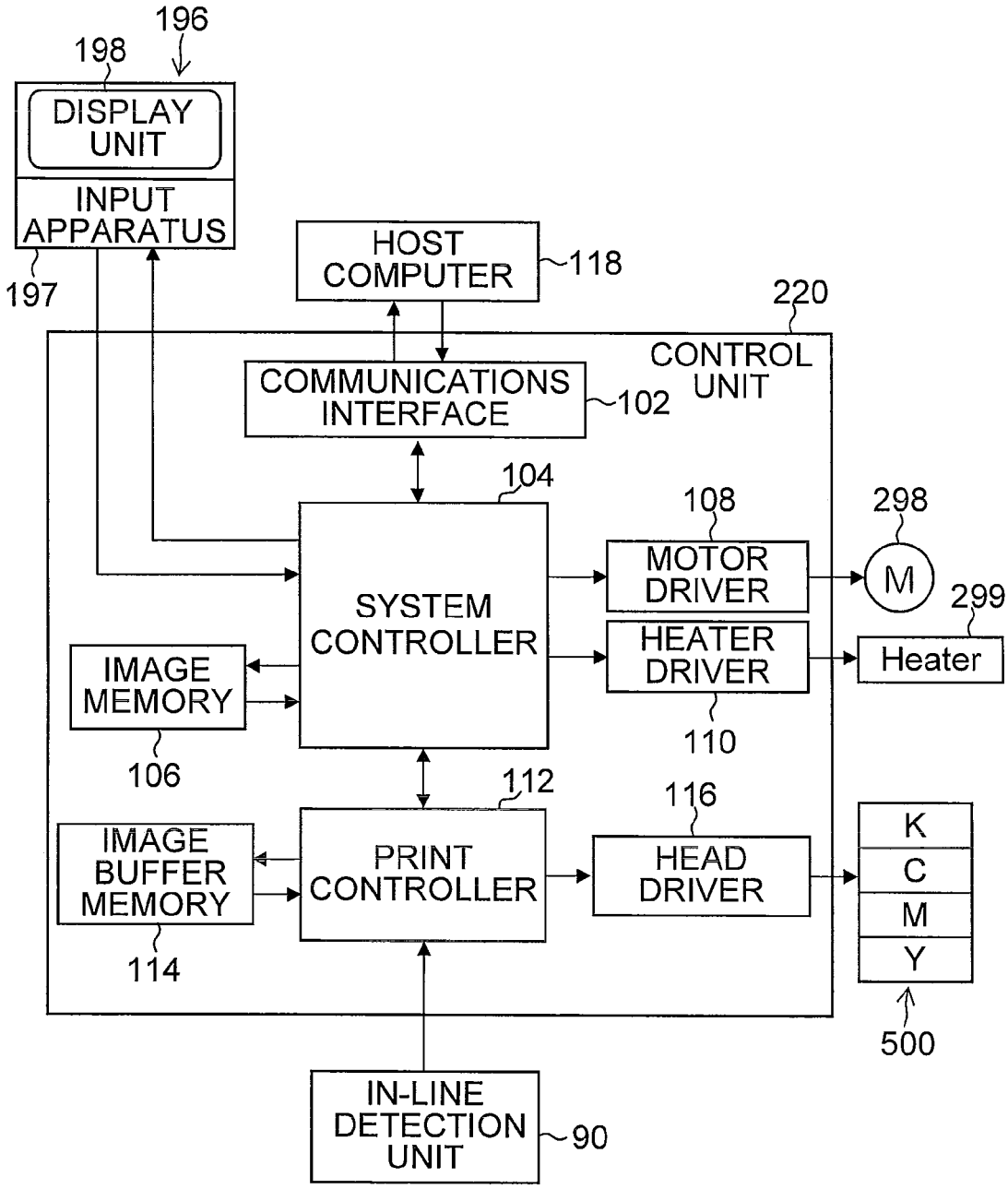
FIG. 13 is a principal block diagram illustrating the composition of the control unit of an inkjet recording apparatus.

FIG. 13 is a principal block diagram illustrating the system composition of the control unit 220 of the inkjet recording apparatus 1.

The control unit 220 comprises a communications interface 102, system controller 104, image memory 106, motor driver 108, heater driver 110, print controller 112, image buffer memory 114, head driver 116, and the like, and the control unit 220 controls the paper supply unit 10, the treatment liquid deposition unit 12, the printing unit 14, the drying unit 16, the fixing unit 18, the output unit 20, the conveyance, heating and printing of the recording medium 22, and detection by the in-line detection unit 90, and the like, as illustrated in FIG. 1.

The system controller 104 is a control unit which controls the respective units such as the communications interface 102, the image memory 106, the motor driver 108, the heater driver 110, and the like. The system controller 104 is constituted by a central processing unit (CPU) and peripheral circuits of same, and the like, and controls communications with the host computer 118, and reading and writing from and to the image memory 106, and the like, as well as generating control signals for controlling the motor 298 and the heater 299 of the conveyance system.

The communications interface 102 receives image data sent by the host computer 118 and sends this image data to the system controller 104. As the communications interface 102, it is possible to use a serial interface, such as a USB, IEEE1394, Ethernet (registered trademark), wireless network, or the like, or a parallel interface such as a Centronics interface. Moreover, it is also possible to install a buffer memory for increasing the communications speed.

The image memory 106 is a storage device which temporarily stores an image input via the communications interface 102, and data is read from and written to the image memory 174 via the system controller 104. The image memory 106 is not limited to being a memory comprising a semiconductor element, and may also use a magnetic medium, such as a hard disk.

Image data sent from the host computer 118 is fed into the image forming apparatus 1 via the communications interface 102, and is stored in the image memory 106 via the system controller 104.

The motor driver 108 is a driver (drive circuit) which drives the motor 298 in accordance with instructions from the system controller 104.

The heater driver 110 is a driver which drives a heater 299, such as a post-drying unit 746, in accordance with instructions from a system controller 104.

The print controller 112 is a control unit which has signal processing functions for carrying out processing, density non-uniformity compensation, and other treatments in order to generate a print control signal on the basis of the image data in the image memory 106, under the control of the system controller 104, and which supplies the print control signal (print data) generated from the image data to the head driver 116.

Required signal processing is carried out in the print controller 112, and the ejection timing of the ink droplets in the head 500 are controlled via the head driver 116 on the basis of the image data. By this means, a desired arrangement of dots can be achieved.

The operating unit 196 which forms a user interface is constituted by an input apparatus 197 where the operator can make various inputs and a display unit (display) 198. The input apparatus 197 may employ various formats, such as a keyboard, mouse, touch panel, buttons, or the like. An operator is able to input print conditions, input and edit additional information, search for information, and the like, by operating the input apparatus 197, and is able to check various information, such as the input contents, search results, a warning display which conveys head replacement time, and the like, via a display on the display unit 198. In other words, the display unit 198 functions as a warning notification device which displays a warning message, or the like, which prompts replacement of the head.

In the present embodiment, a combination of the system controller 104 and the print controller 112 corresponds to an "image formation control device" and the system controller 104 functions as a "judgment device".

Figure 14:
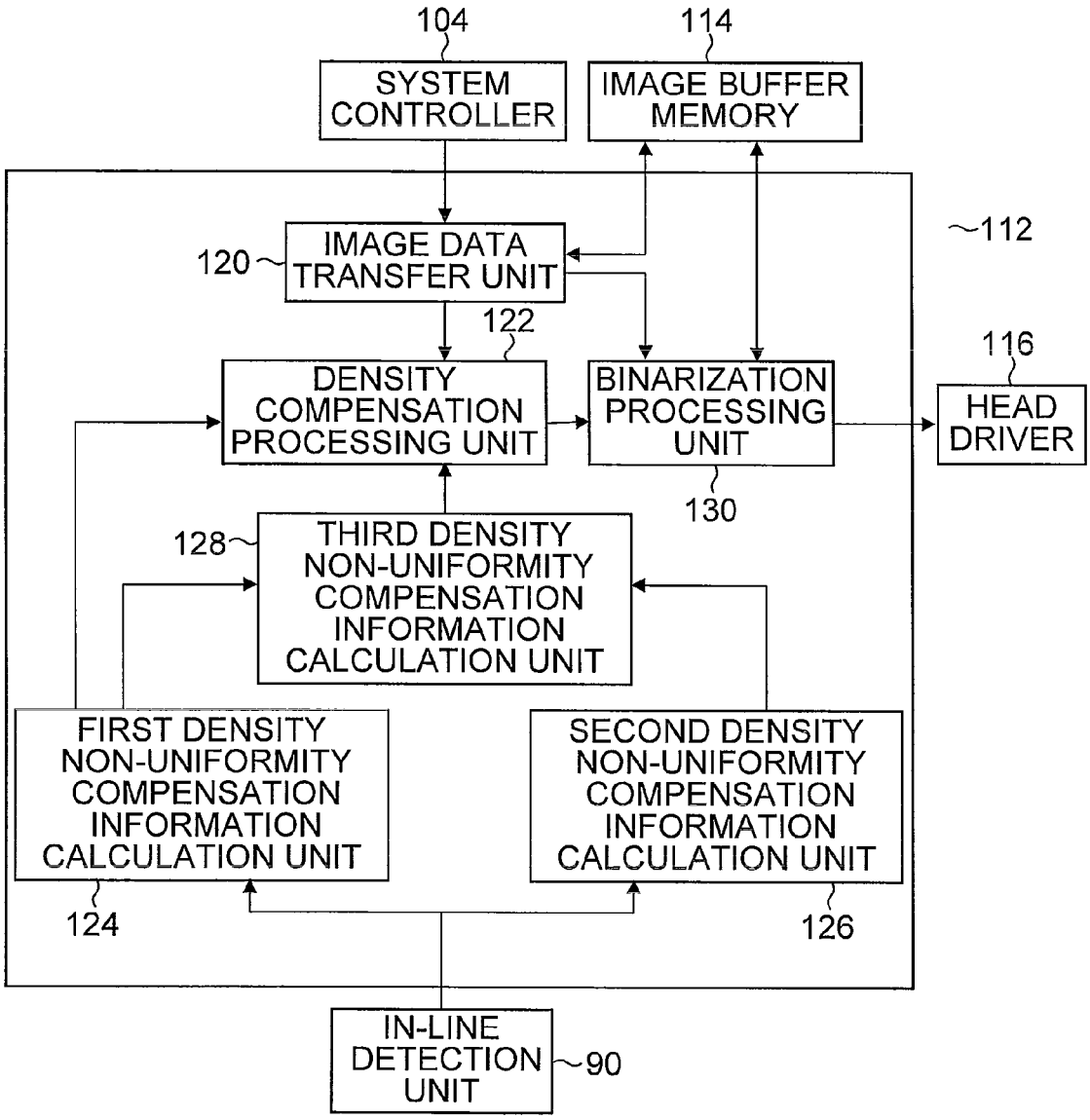
FIG. 14 is a principal block diagram illustrating the configuration of the print controller illustrated in FIG. 13.

Here, FIG. 14 is a principal block diagram illustrating the system composition of the print controller 112.

As illustrated in FIG. 14, the print controller 112 comprises: an image data transfer unit 120; a density compensation processing unit 122, a first density non-uniformity compensation information calculation unit 124, a second density non-uniformity compensation information calculation unit 126, a third density non-uniformity compensation information calculation unit 128, and a binarization processing unit 130. Furthermore, an image buffer memory 114 is provided with the print controller 112.

The image buffer memory 114 temporarily stores data such as image data and parameter data, and the like, when processing image data in the print controller 112. FIG. 13 and FIG. 14 illustrate a mode in which the image buffer memory 114 is attached to the print controller 112; however, the image buffer memory 114 may also serve as the image memory 106. Also possible is a mode in which the print controller 112 and the system controller 104 are integrated to form a single processor.

The image data transfer unit 120 receives image data supplied (input) from the system controller 104 and sends this data to a density compensation processing unit 122 or the binarization processing unit 130. The image data transfer unit 120 switches between sending the image data to the density compensation processing unit 122, and sending the image data to the binarization processing unit 130, in accordance with the type of image data supplied.

Furthermore, in accordance with requirements, it is also possible that the image data is also stored temporarily in the image buffer memory 114, read out from the image buffer memory 114 and sent to the density compensation processing unit 122 and the binarization processing unit 130.

The density compensation processing unit 122 subjects the image data transferred from the image data transfer unit 120 to density non-uniformity compensation processing, on the basis of density non-uniformity compensation information supplied from the second density non-uniformity compensation information calculation unit 126 or the third density non-uniformity compensation information calculation unit 128, which are described below, and then sends to the binarization processing unit 130 the image data compensated for density non-uniformity.

The first density non-uniformity compensation information calculation unit 124 calculates, on the basis of the first test pattern read by the in-line sensor 90, first density non-uniformity compensation information relating to high-frequency density non-uniformity caused by landing position error in the ejection unit. Furthermore, the first density non-uniformity compensation information calculation unit 124 sends the calculated first density non-uniformity compensation information to the third density non-uniformity compensation information calculation unit 128. Moreover, the first density non-uniformity compensation information calculation unit 124 also sends the first density non-uniformity compensation information to the density compensation processing unit 122, in accordance with requirements.

The second density non-uniformity compensation information calculation unit 126 calculates second density non-uniformity compensation information relating to low-frequency density non-uniformity caused by change in the diameter of the liquid droplets ejected from the ejection unit (or the landing diameter of the liquid droplets), on the basis of the second test pattern which has been read in by the in-line detection unit 90. The second density non-uniformity compensation information calculation unit 126 sends the calculated second density non-uniformity compensation information to the third density non-uniformity compensation information calculation unit 128.

The third density non-uniformity compensation information calculation unit 128 calculates the third density non-uniformity compensation information on the basis of the first density non-uniformity compensation information which is supplied from the first density non-uniformity compensation information calculation unit 124 and the second density non-uniformity compensation information which is supplied from the second density non-uniformity compensation information calculation unit 126. The third density non-uniformity compensation information calculation unit 128 sends the calculated third density non-uniformity compensation information to the density compensation processing unit 122.

Here, the method of calculating the first density non-uniformity compensation information, the second density non-uniformity compensation information and the third density non-uniformity compensation information is described in detail further below.

Thereupon, the binarization processing unit 130 carries out binarization processing on the image data which is sent directly from the image data transfer unit 120, or on image data which has undergone non-uniformity compensation processing sent from the density compensation processing unit, thereby generating a print control signal. In other words, in order to record the supplied image data onto the recording medium, the binarization processing unit 130 decides the on/off switching (in other words, the ejection pattern) at respective ejection timings of the respective ejection units of the head 500, on the basis of the image data, and thereby generates a print control signal. The binarization processing unit 130 supplies the generated print control signal to the head driver 116.

In the binarization processing unit 130, it is possible to use various processing methods as the method of generating an ejection control signal from the image data; for example, it is possible to use a dithering method, error diffusion method, or the like.

Thereupon, the head driver 116 drives actuators of the respective ejection units of the heads of respective colors (72K, 72C, 72M, 72Y), on the basis of the ejection control signal (print data) supplied from the print controller 112. A feedback control system for maintaining constant drive conditions in the head may be included in the head driver 116.

The inkjet recording apparatus 1 basically has a composition such as that described above.

Next, the method of creating the third density non-uniformity compensation information in the inkjet recording apparatus 1 will be described. Here, the method of creating the third density non-uniformity compensation information is carried out in a similar fashion in each of the inkjet heads 72K, 72C, 72M and 72Y, and therefore a head 500 is described below as a representative example.

Figure 15A:
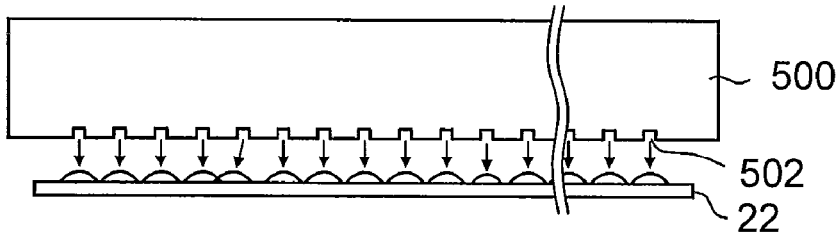
FIG. 15A illustrates a side face diagram illustrating the relationship between the respective ejection units of a recording head and the landing positions of ink droplets.
Figure 15B:
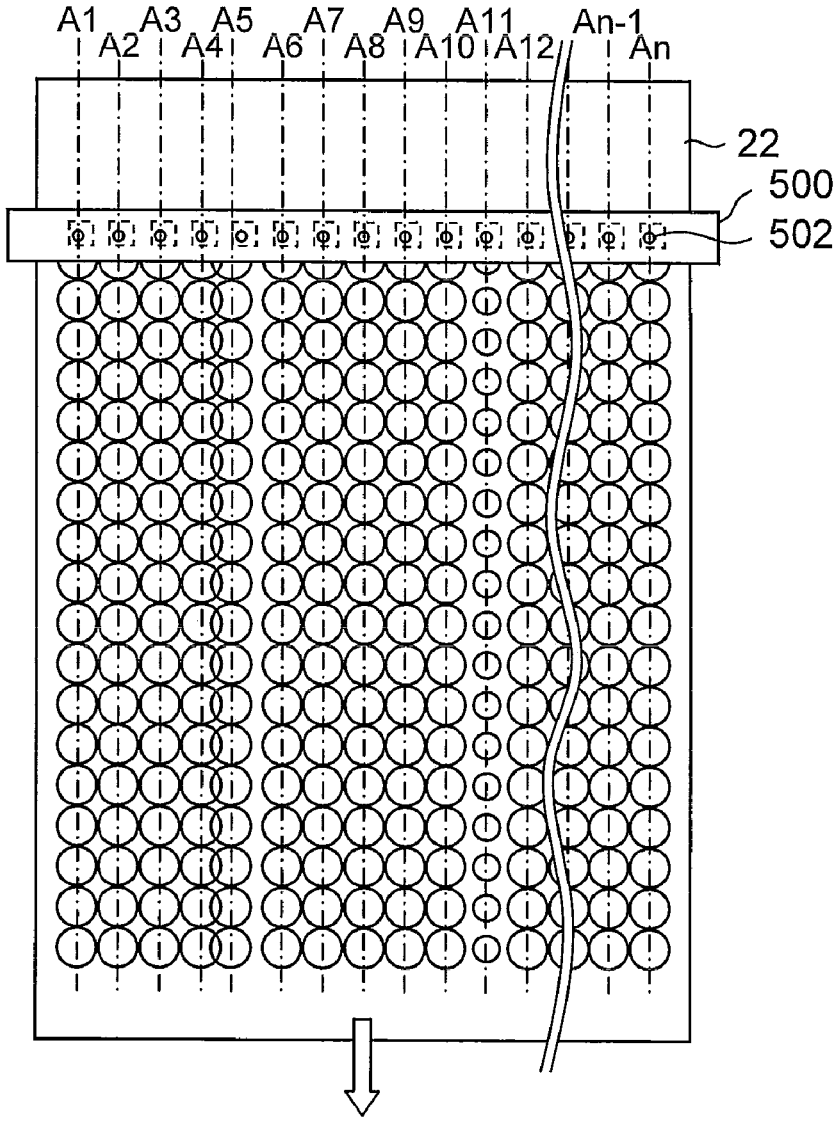
FIG. 15B illustrates a top view diagram of FIG. 15A.

FIG. 15A is a side surface diagram illustrating the relationship between the respective ejection units (nozzles 502) of the head 500 and the landing positions of the ink droplets, and FIG. 15B is an upper surface diagram of the FIG. 15A. In FIGS. 15A and 15B, in order to simplify the description, the nozzle arrangement is simplified to one row, and a plurality of ejection units (nozzles 502) which are arranged in this row configuration are defined as A1, A2, A3, . . . An, sequentially from one end to the other end.

As illustrated in FIGS. 15A and 15B, when ink droplets ejected from one ejection unit (the ejection unit 502 with number A5 in FIGS. 15A and 15B) are ejected in a different direction from the ink droplets ejected from other ejection units, then the droplet ejection positions of the ink droplets are displaced, in other words, the landing positions of the ink droplets are displaced, and a density non-uniformity occurs in the formed image.

Furthermore, as illustrated in FIGS. 15A and 15B, if the ink volume of the ink droplets ejected from one ejection unit (the ejection unit with number A11 in FIGS. 15A and 15B) is smaller than the desired volume, then the droplet ejection points formed by the ink droplets ejected from that ejection unit (number A11) have a smaller size than the droplet ejection points formed by the ink droplets ejected from other ejection units. If the size of the droplet ejection points is different than the desired size in this way, then a density non-uniformity occurs in the formed image.

The third density non-uniformity compensation information described above is compensation information for compensating the ejection characteristics of ink droplets ejected from an ejection unit, such as the landing position, ink volume, or the like, which is the cause of density non-uniformities of this kind.

By compensating the image data on the basis of this third density non-uniformity compensation information, it is possible to form an image on the recording medium which appears to contain no density non-uniformities, even in a case where the image has been recorded using a recording head unit which has density non-uniformity.

Figure 16:
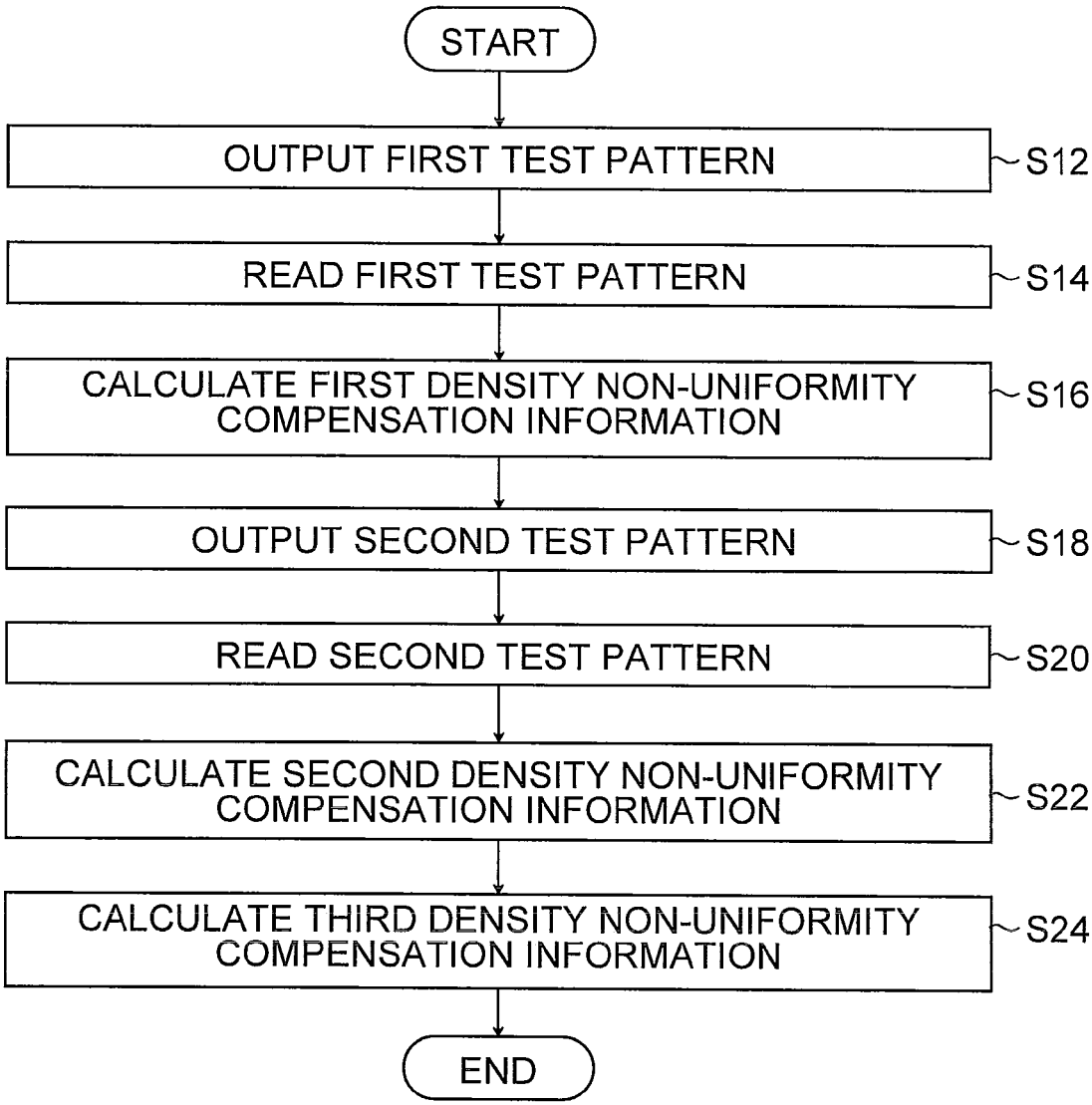
FIG. 16 is a flow diagram illustrating the steps of a method of creating the third density non-uniformity compensation information.
Figure 17A:
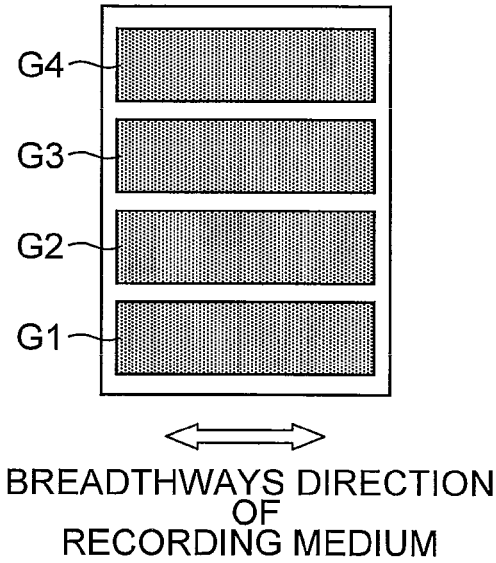
FIG. 17A is a schematic drawing illustrating one example of a first test pattern and FIG. 17B is a partial enlarged diagram of FIG. 17A.
Figure 17B:
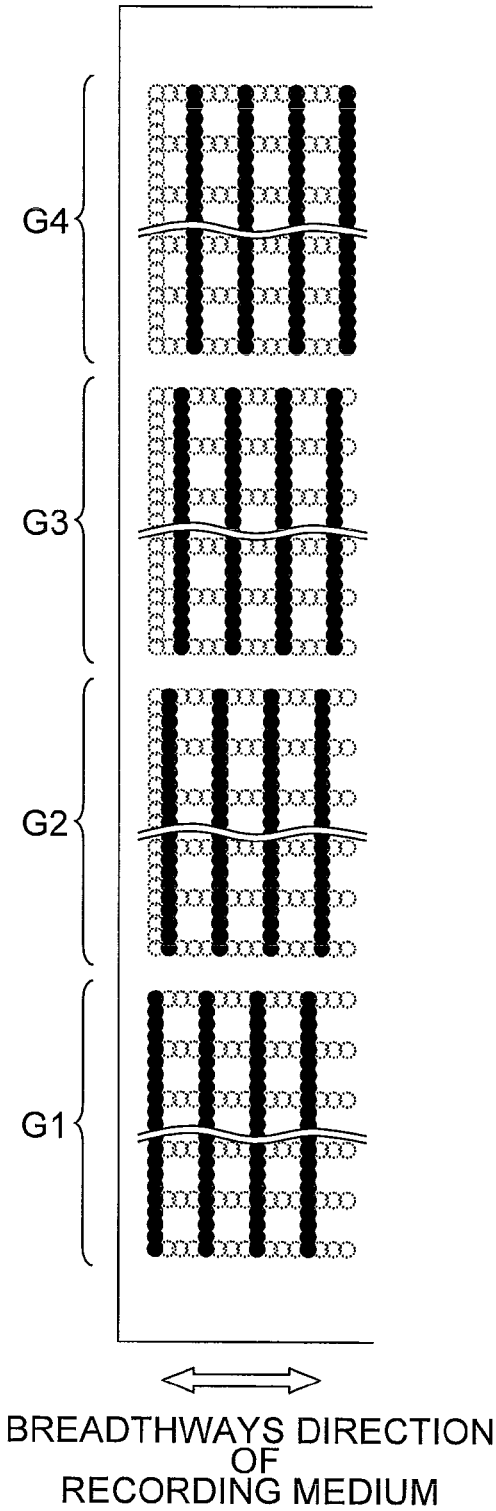
Figure 18:
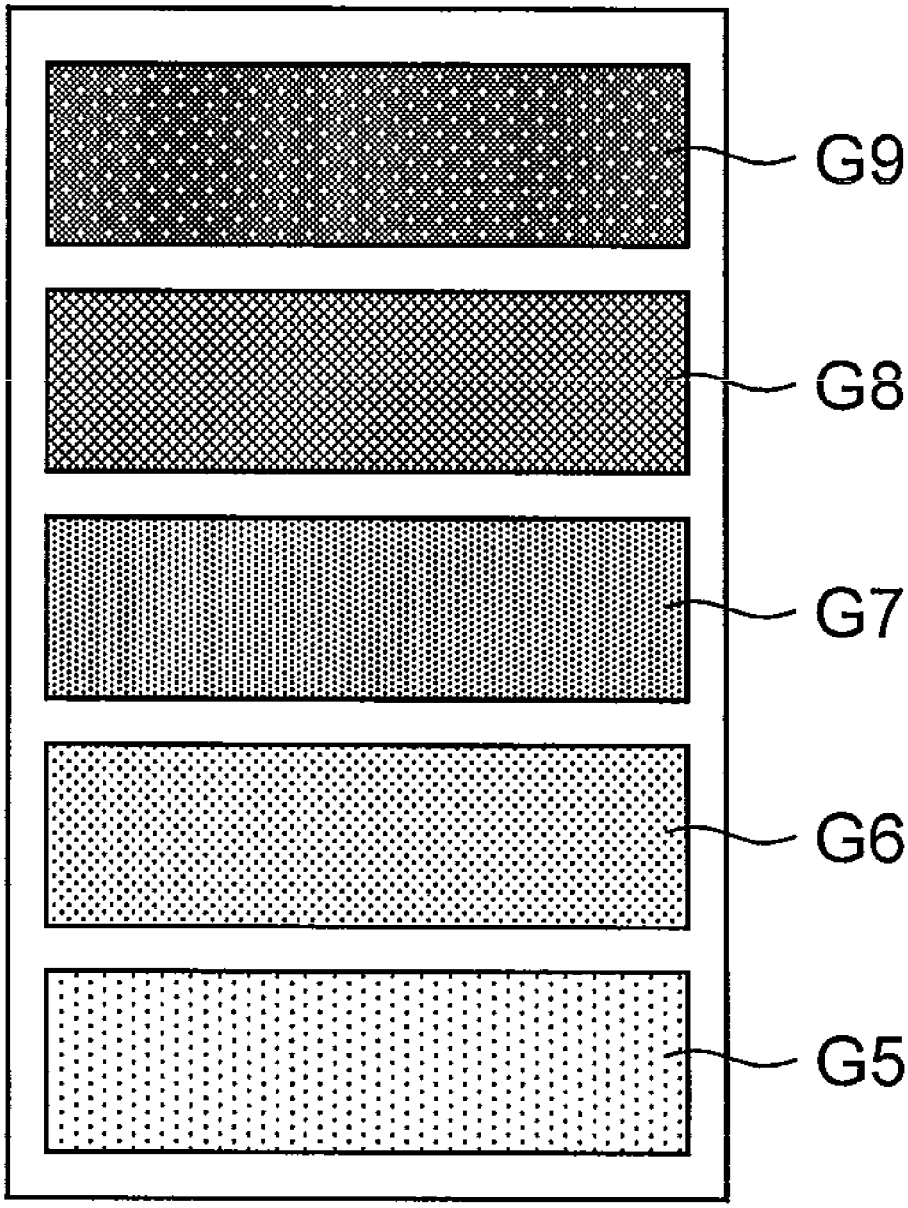
FIG. 18 is a schematic drawing illustrating one example of a second test pattern.
Figure 19A:
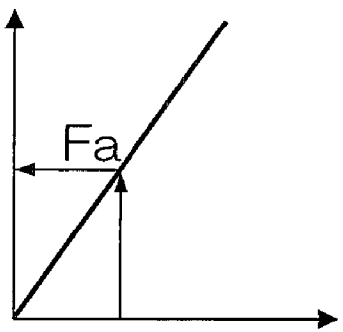
FIG. 19A is a graph showing one example of first density non-uniformity compensation information.
Figure 19B:
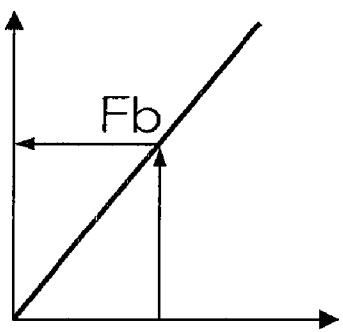
FIG. 19B is a graph showing one example of second density non-uniformity compensation information and FIG. 19C is a graph showing one example of third density non-uniformity compensation information.
Figure 19C:
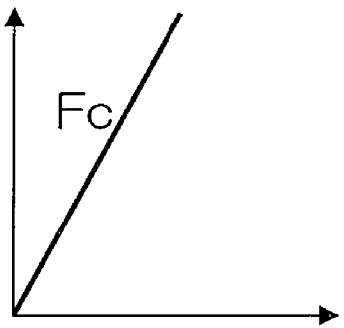

FIG. 16 is a flow diagram illustrating steps of a method of creating the third density non-uniformity compensation information. FIG. 17A is a schematic drawing illustrating one example of a first test pattern, and FIG. 17B is an enlarged partial diagram of FIG. 17A. Furthermore, FIG. 18 is a schematic drawing illustrating one example of a second test pattern. Moreover, FIG. 19A is a graph showing one example of first density non-uniformity compensation information, FIG. 19B is a graph showing one example of second density non-uniformity compensation information and FIG. 19C is a graph showing one example of third density non-uniformity compensation information.

Firstly, a first test pattern is printed on the recording medium 22 by the head 500 (step S12 in FIG. 16).

More specifically, if a plurality of ejection units which are arranged in a row fashion as described above are defined as A1, A2, A3, . . . , An, sequentially from one end to the other end (see FIGS. 15A and 15B), then these ejection units are divided into four groups, 4k−3, 4k−2, 4k−1 and 4k (k=1, 2, 3, . . . ) on the basis of number of the ejection units, ink droplets are ejected continuously from the ejection units having an ejection unit number of 4k−3, thereby forming a straight line from each ejection unit on the recording medium P, whereupon ink droplets are ejected continuously from the ejection units having an ejection unit number of 4k−2, thereby forming a straight line from each ejection unit on the recording medium P, and subsequently, in a similar fashion, straight lines are formed on the recording medium P respectively from the respective ejection units having an ejection unit number of 4k−1 and the ejection units having an ejection unit number of 4k.

Furthermore, by grouping together ejection units which are spaced at a uniform interval apart, it is possible to form straight lines without ejecting ink from mutually adjacent ejection units. By this means, it is possible to prevent overlapping between the straight lines.

In the present embodiment, droplet ejection points are formed on the recording medium 22 by ejecting ink droplets from the respective ejection units of the head 500 while conveying the recording medium 22 in a conveyance direction, in other words, a direction perpendicular to the lengthwise direction of the head 500 (the alignment direction of the nozzles 502).

As described above, four image regions (G1, G2, G3, G4) corresponding to the four groups of ejection units are formed on the recording medium 22, as illustrated in FIGS. 17A and 17B, and a first test pattern in which straight lines corresponding to the respective ejection units are formed is created in each of the groups.

Here, by dividing the nozzles into four groups on the basis of the remainder of dividing the ejection unit number (nozzle number) by four, groups of nozzles spaced at an almost uniform interval apart are created, but it is also possible to use a similar method to divide the nozzles into D groups on the basis of the remainder E of dividing the nozzle number by an integer D (an integer equal to or greater than 2).

Next, the first test pattern formed on the recording medium 22 as described above is read in by the in-line detection unit 90 (step S14 in FIG. 16).

More specifically, after forming the first test pattern, the recording medium 22 is conveyed again by the conveyance units (the second intermediate conveyance unit 26 and the third intermediate conveyance unit 28, and the like) and passes a position opposing the in-line detection unit 90.

The in-line detection unit 90 reads in the first test pattern by reading in the image formed on the recording medium 22 which passes this opposing position. In this, the in-line detection unit 90 reads in the first test pattern at high resolution. Furthermore, the in-line detection unit 90 sends the read image data to the first density non-uniformity compensation information calculation unit 124 of the control unit 220 (see FIG. 14).

Thereupon, the first density non-uniformity compensation information calculation unit 124 calculates the first density non-uniformity compensation information on the basis of the first test pattern (step S16 in FIG. 16).

Firstly, the first density non-uniformity compensation information calculation unit 124 calculates the landing positions (ejection characteristics) of the ink droplets of the respective ejection units, from the image data obtained by reading in the first test pattern in which straight lines are formed by each ejection unit.

Here, the landing positions can be calculated as the landing positions of the ink droplets ejected from each ejection unit, by determining the density profile of each straight line and calculating the center of the straight line from this determination result, as described in Japanese Patent Application Publication No. 2006-264069, for example.

Furthermore, the method of calculating the central position is not limited in particular, and it is possible to determine respective edges of the ink droplets and take the central position between these edges as the center, or to determine the position of highest density as the center.

Moreover, desirably, the landing positions are defined by calculating the centers of a plurality of points on each straight line, and then calculating an approximation line by joining these centers together. By calculating an approximation line which joins together the centers of a plurality of dots, it is possible to determine the landing positions of the ink droplets more accurately.

Moreover, by extending this approximation line, it is possible to determine accurately the relative positional relationship between the respective groups. The relative positional relationship should be such that a reference ejection unit is set when creating the first test pattern and a straight line formed by that ejection unit is created for all of the four groups.

The first density non-uniformity compensation information calculation unit 124 calculates the first density non-uniformity compensation information on the basis of the landing position information of each of the ejection units thus calculated. Here, the first density non-uniformity compensation information is information for compensating density non-uniformity caused by the landing position information of the respective ejection units (parameters, compensation coefficients, and the like, for each ejection unit).

Here, the method of calculating the first density non-uniformity compensation information from the calculated landing position information of the respective ejection units is not limited in particular, and it is also possible to calculate the first density non-uniformity compensation information by carrying out an averaging process so as to make the density of the area corresponding to the ejection unit approach the reference density, on the basis of landing position information, as described in Japanese Patent Application Publication No, 2006-264069, and it is also possible to calculate the first density non-uniformity compensation information by carrying out a numerical calculation process between the ejection unit in question and a plurality of adjacent ejection units, on the basis of the landing position information, as described in Japanese Patent Application Publication No. 2006-347164.

Next, a second test pattern is printed on the recording medium 22 by the head 500 (step S18 in FIG. 16).

More specifically, ink droplets are ejected from all of the ejection units of the head 500 and solid monochrome images (images having a uniform density within each set region) of a plurality of different densities are recorded. In the present embodiment, as illustrated in FIG. 18, a solid image at 20% density is formed in the image region G5, a solid image at 40% density is formed in the image region G6, a solid image at 60% density is formed in the image region G7, a solid image at 80% density is formed in the image region G8, and a solid image at 100% density is formed in the image region G9.

Here, the print controller 112 compensates the second test pattern using the first density non-uniformity compensation information calculated by the first density non-uniformity compensation information calculation unit 124 (see FIG. 14), converts the second test pattern which has been compensated in respect of density non-uniformity, into an ejection control signal, and then prints the second test pattern onto the recording medium on the basis of this ejection control signal.

More specifically, the image data transfer unit 120 illustrated in FIG. 14 sends the image data of the second test pattern (the five solid images of different densities) which is sent from the system controller 104, to the density compensation processing unit 122. The density compensation processing unit 122 carries out density non-uniformity compensation processing on the second test pattern, using this first density non-uniformity compensation information. In other words, the density compensation processing unit 122 subjects the image data of the second test pattern to density non-uniformity compensation processing which takes account of the landing position error of the ejection units, in such a manner that there are no density non-uniformities caused by landing position error in the second test pattern which is recorded on the recording medium.

The density compensation processing unit 122 sends the image data of the second test pattern which has undergone density compensation processing, to the binarization processing unit 130.

The binarization processing unit 130 binarizes the image data of the second test pattern which has undergone density compensation processing, and thereby generates an ejection control signal. Furthermore, the ejection control signal thus generated is sent to the head driver 116, and a second test pattern is printed by means of the head 500 recording an image on the recording medium on the basis of the ejection control signal.

Next, the second test pattern formed on the recording medium 22 is read in by the in-line detection unit 90 (step S20 in FIG. 16).

More specifically, after forming the second test pattern, the recording medium 22 is conveyed further by the conveyance unit and passes a position opposing the in-line detection unit 90.

The in-line detection unit 90 reads in the second test pattern by reading in the image formed on the recording medium 22 which passes this opposing position. In this, the in-line detection unit 90 reads in the second test pattern at a lower resolution than the resolution used to read in the first test pattern.

Furthermore, the in-line detection unit 90 sends the read image data to the second density non-uniformity compensation information calculation unit 126 of the print controller 112 (see FIG. 14).

Thereupon, the second density non-uniformity compensation information calculation unit 126 calculates the second density non-uniformity compensation information on the basis of the second test pattern (step S22 in FIG. 16).

The second density non-uniformity compensation information calculation unit 126 calculates density change from the image data read in from the second test pattern in which a plurality of solid images of differing densities are formed.

Next, the ejected droplet volume (ejection characteristics) of the respective ejection units are calculated from the density change thus calculated.

Here, as described above, the second test pattern has been compensated for density non-uniformity on the basis of the first density non-uniformity compensation information and therefore, if ink droplets of uniform droplet volume are ejected from the respective ejection units, then an image of uniform density which is free of density change is formed. Consequently, density change in the solid image can be identified as variation in the liquid droplet volume ejected from the respective ejection units, and the ink droplet volume ejected from each ejection unit can be calculated on the basis of the density change and the landing position information calculated in the first test pattern. Furthermore, by this means, it is possible to calculate density non-uniformities caused by variation (amount of change) in the ink droplet volume ejected from the respective ejection units.

Furthermore, by forming solid images of different densities and calculating the ink droplet volume ejected from each ejection unit on the basis of a plurality of calculation values, it is possible to calculate density non-uniformity caused by variation in the ink droplet volume in a more accurate fashion. Moreover, it is also possible to calculate density non-uniformity caused by variation in the ink droplet volume for each respective density.

Thereupon, the second density non-uniformity compensation information calculation unit 126 calculates the second density non-uniformity compensation information on the basis of the density change caused by variation in the ink droplet volume ejected from the respective ejection units thus calculated. Here, the second density non-uniformity compensation information is information for compensating density non-uniformity caused by variation in the volume of the ink droplets ejected by the respective ejection units (parameters, compensation coefficients, and the like, for each ejection unit).

For example, if the droplet volume ejected from an ejection unit is smaller than average, then compensation information is calculated whereby the ejection unit is set so as to eject droplets with a greater frequency than the other ejection units at a given image density, whereas if the droplet volume ejection from the ejection unit is greater than average, then compensation information is calculated whereby the ejection unit is set so as to eject droplet with a lower frequency than the other ejection units at a given image density. Furthermore, compensational coefficients are calculated whereby, if the density of a certain region is low, then the ink ejection frequency of the ejection units in that region is raised, whereas if the density of a certain region is high, then the ink ejection frequency of the ejection units in that region is lowered.

Furthermore, compensation is not limited to being made by means of the ejection frequency of one ejection unit only, and it is possible to calculate compensation coefficients which also use adjacent ejection units and the like, so that on a macroscopic level (with the naked eye), it is perceived that an image of the desired density is formed, or that on a macroscopic level, the amount of change is such that no non-uniformity is perceived.

Next, the third density non-uniformity compensation information is calculated by the third density non-uniformity compensation information calculation unit 128 (step S24 in FIG. 16).

The third density non-uniformity compensation information calculation unit 128 calculates the third density non-uniformity compensation information on the basis of the first density non-uniformity compensation information which is calculated by the first density non-uniformity compensation information calculation unit 124 and the second density non-uniformity compensation information which is calculated by the second density non-uniformity compensation information calculation unit 126. The third density non-uniformity compensation information is compensation information whereby it is possible to compensate density non-uniformities caused by both the landing positions of the ink droplets ejected from the ejection units and the droplet volume of the ink droplets ejected from the ejection units, by being calculated on the basis of the first density non-uniformity compensation information and the second density non-uniformity compensation information.

More specifically, the relationship between the ejection frequency and density as illustrated in FIG. 19C is calculated as third density non-uniformity compensation information by using both the relationship between the ejection frequency and density illustrated in FIG. 19A which has been calculated as first density non-uniformity compensation information, and the relationship between the ejection frequency and density illustrated in FIG. 19B which has been calculated as second density non-uniformity compensation information.

The calculation (synthesis) of the third density non-uniformity compensation information Fe may be made by synthesizing the first density non-uniformity compensation information Fa as a variable with the second density non-uniformity compensation information Fb (in other words, Fc=Fb(Fa)), or by synthesizing the second density non-uniformity compensation information Fb as a variable with the first density non-uniformity compensation information Fa (in other words, Fe=Fa(Fb)).

The image recording apparatus calculates the third density non-uniformity compensation information as described above.

Next, the image forming method and image forming apparatus according to an embodiment of the present invention will be described in more detail by describing the method of forming a printed item, or "print", by means of the inkjet recording apparatus 1.

Figure 20:
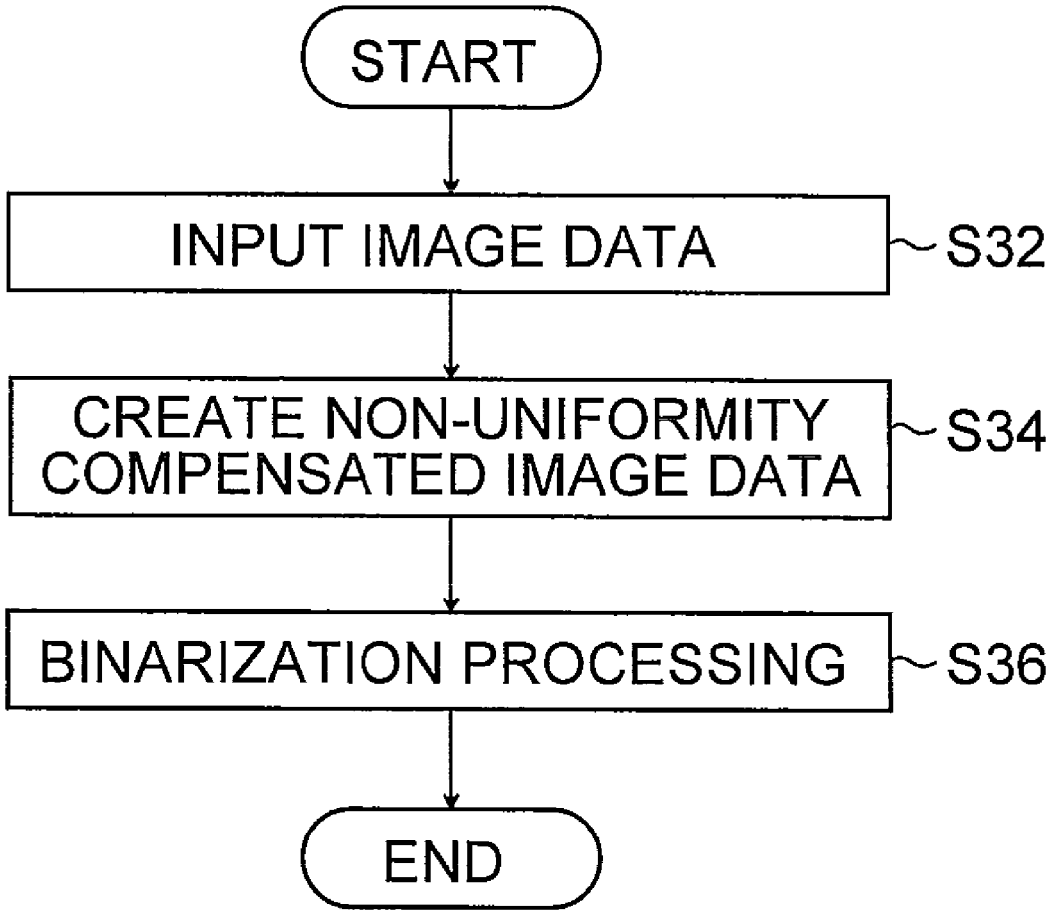
FIG. 20 is a flow diagram illustrating steps of processing image data used in printing.

FIG. 20 is a flow diagram illustrating steps of processing image data used in printing.

Firstly, image data is input to the system controller 104 from the host computer 118 via the communications interface 102.

Thereupon, image data is input to the image data transfer unit 120 of the print controller 112 from the system controller 104 (step S32).

The image data transfer unit 120 sends the input image data to the density compensation processing unit 122.

The density compensation processing unit 122, using the third density non-uniformity compensation information, applies density non-uniformity compensation to the sent image, thereby creating non-uniformity compensated image data (step S34).

The density compensation processing unit 122 sends the non-uniformity compensation image data thus created to the binarization processing unit 130.

The binarization processing unit 130 binarizes the non-uniformity compensated image data, thereby creating an ejection control signal (step S36). Thereupon, the binarization processing unit 130 sends the ejection control signal to the head driver 116.

Image data is processed and sent to the head driver 116 in the manner described above.

Embodiment of Recording Operation by Inkjet Recording Apparatus 1

Next, an example of a recording operation performed by the inkjet recording apparatus 1 is described.

On the treatment liquid drum 54 (diameter 450 mm), treatment liquid was applied in a thin film (having a thickness of 2 μm) by the treatment liquid application unit 56 onto the whole surface of a recording medium 22 taken up onto the image formation drum 70 from the paper feed unit 10 of the inkjet recording apparatus illustrated in FIG. 1. In this, a gravure roller was used as the treatment liquid application unit 56.

Thereupon, the recording medium 22 onto which the treatment liquid had been applied was dried by means of the warm-air blow-out nozzle 58 (temperature 70° C., 9 $m^3$/min. blow rate) and the IR heater 60 (180° C.), thereby drying a portion of the solvent in the treatment liquid. This recording medium 22 was then conveyed through the first intermediate conveyance unit 24 to the image formation unit 14, and droplets of respective aqueous inks of C M and Y (cyan, magenta and yellow) were ejected from the head 72C, 72M and 72Y in accordance with an image signal. The ink ejection volume was 1.4 pl in the highlight portions and 3 pl (2 drops) in the high-density portions, and the recording density was 1200 dpi in both the main scanning direction and the sub-scanning direction.

In this case, if a nozzle suffering an ejection failure occurred, then processing was implemented whereby 5 pl (3 drops) was used in the nozzles adjacent to the ejection failure nozzle, so as to reduce the visibility of banding caused by the ejection failure. By providing the treatment liquid drum 54 and the drying drum 76 separately from the image formation drum 70, stable ejection was achieved without the heat or air flow causing any adverse effects on the image formation unit, even if drying of the treatment liquid was carried out at high-speed.

Thereupon, the recording medium was dried on the drying drum 76 by means of the first IR heater 78 (surface temperature 180° C.), the air blowing nozzle 80 (warm air flow at 70° C. and flow rate of 12 $m^3$/min.) and the second IR heater 82 (surface temperature 180° C.). The drying time was about 2 seconds.

Thereupon, the recording medium 22 on which the image had been formed was fixed by heating at a nip pressure of 0.30 MPa by means of the fixing drum 84 at 50° C., the first fixing roller 86 and the second fixing roller 88 at 80° C. In this, the rollers used as the first fixing roller 86 and the second fixing roller 88 were rollers formed by providing 6 mm thick silicone rubber having a hardness of 30° on a metal core, and forming a soft PFA coating (having a thickness of 50 μm) thereon, to yield a roller having excellent contact and separating characteristics with respect to the ink image.

The recording medium 22 was conveyed at a conveyance speed of 535 mm/s by drum conveyance by means of the drums 54, 70, 76 and 84.

As described above, the inkjet recording apparatus 1 prints (records) an image on the recording medium 22 so as to produce a printed item, or "print".

As described above, according to the present embodiment, by separately calculating first density non-uniformity compensation information which compensates density non-uniformities caused by landing position error and second density non-uniformity compensation information which compensates density non-uniformities caused by the ink droplet volume, and calculating a third density non-uniformity compensation information using these two compensation information, it is possible to compensate satisfactorily both landing position error and error caused by the ink droplet volume, and therefore an image with little or no density non-uniformity can be recorded.

In the foregoing description, the density non-uniformity compensated by the first density non-uniformity compensation information is density non-uniformity caused by landing position error, but the present invention is not limited to this, and the first density non-uniformity may include high-frequency non-uniformities (non-uniformities illustrating a steep change in density) which are caused by a variety of factors. Furthermore, the density non-uniformity compensated by the second density non-uniformity compensation information is taken to be caused by the ink droplet volume, but is not limited to this and may also include low-frequency density non-uniformities of various types (non-uniformities showing gradual change in density), such as density non-uniformity in the ink ejected from the respective ejection units.

Furthermore, by calculating high-frequency density non-uniformities and low-frequency density non-uniformities separately, it is possible to reduce the image reading volume and the image processing volume, as well as being able to compensate density non-uniformities in a suitable fashion.

More specifically, landing position error is required to be calculated by acquiring image data at a higher resolution than the resolution of the droplet ejection points (for example, at 2400 dpi), but for low-frequency density non-uniformity, it is sufficient to use a resolution capable of reading in non-uniformities which are visible to a human observer, and therefore if low-frequency density non-uniformity is detected from a solid image, it is possible to compensate the low-frequency density non-uniformity by performing the calculation on the basis of image data read in at a low resolution (100 to 600 dpi).

In this way, by altering the resolution of the read image in accordance with the respective characteristics, it is possible to reduce the image reading volume and the image processing volume.

Here, the in-line detection unit 90 desirably uses a resolution for reading the first test pattern which is two or more times higher than the resolution for reading the second test pattern.

By using a reading resolution for the first test pattern which is two or more times higher than the reading resolution for the second test pattern, it is possible to calculate the landing position error accurately, while also being able to reduce the processing volume in respect of the second test pattern.

As stated above, desirably, the resolution for reading the first test pattern is desirably higher than the resolution of the image which is recorded by the recording head.

By performing the reading at a resolution higher than the resolution of the recorded image, it is possible to calculate the landing position error accurately.

Furthermore, the first density non-uniformity compensation information and the second density non-uniformity compensation information do not have to be calculated simultaneously, and can be detected at separate timings. For example, it is possible to update only the second density non-uniformity compensation information, and to use the density non-uniformity compensation information of the previous occasion (non-uniformity compensation information which is calculation-completed information at the time of update) for the first density non-uniformity compensation information.

Desirably, the first density non-uniformity compensation information is updated at a lower frequency than the second density non-uniformity compensation information. As stated above, the first density non-uniformity compensation information must be obtained by reading the image at a high resolution, and therefore the image reading volume and image processing volume are high. However, the causes of high-frequency density non-uniformity which is compensated by the first density non-uniformity compensation information, for example, landing position error, or the like, varies over time due to the effects of temporal deterioration of the surface where the nozzles are provided in the recording head, and so on, but this change is relatively gradual and therefore the first density non-uniformity compensation information does not change very frequently. On the other hand, the causes of low-frequency density non-uniformity which is compensated by the second density non-uniformity compensation information, for instance, the ink droplet volume, also depends on temperature change, and therefore must be updated at shorter intervals.

Consequently, by updating only the second density non-uniformity compensation information, it is possible to reduce the image processing volume, and the third density non-uniformity compensation information can be calculated rapidly. Furthermore, it is also possible to perform suitable density non-uniformity compensation by updating the second density non-uniformity compensation information only, and not updating the first density non-uniformity compensation information.

In this way, by calculating the first density non-uniformity compensation information and the second density non-uniformity compensation information separately, it is possible to update only the necessary information, and hence suitable compensation information can be calculated while incurring a small processing load.

Furthermore, in the inkjet recording apparatus 1, since a test pattern can be created in a state where high-frequency density non-uniformity has been compensated, then the image data of the second test pattern is compensated by means of the first density non-uniformity compensation information, and a second test pattern is created by using this compensated image data for the second test pattern, but the present invention is not limited to this and it is also possible to create a second test pattern without compensation on the basis of the first density non-uniformity compensation information.

In this way, if a second test pattern is created without compensation on the basis of the first density non-uniformity compensation information, then it is possible to reduce the data processing load involved in creating the second test pattern. In this case, there may be increase in the data processing volume when calculating the third density non-uniformity compensation information.

Example of Composition of in-Line Detection Unit

Figure 21:
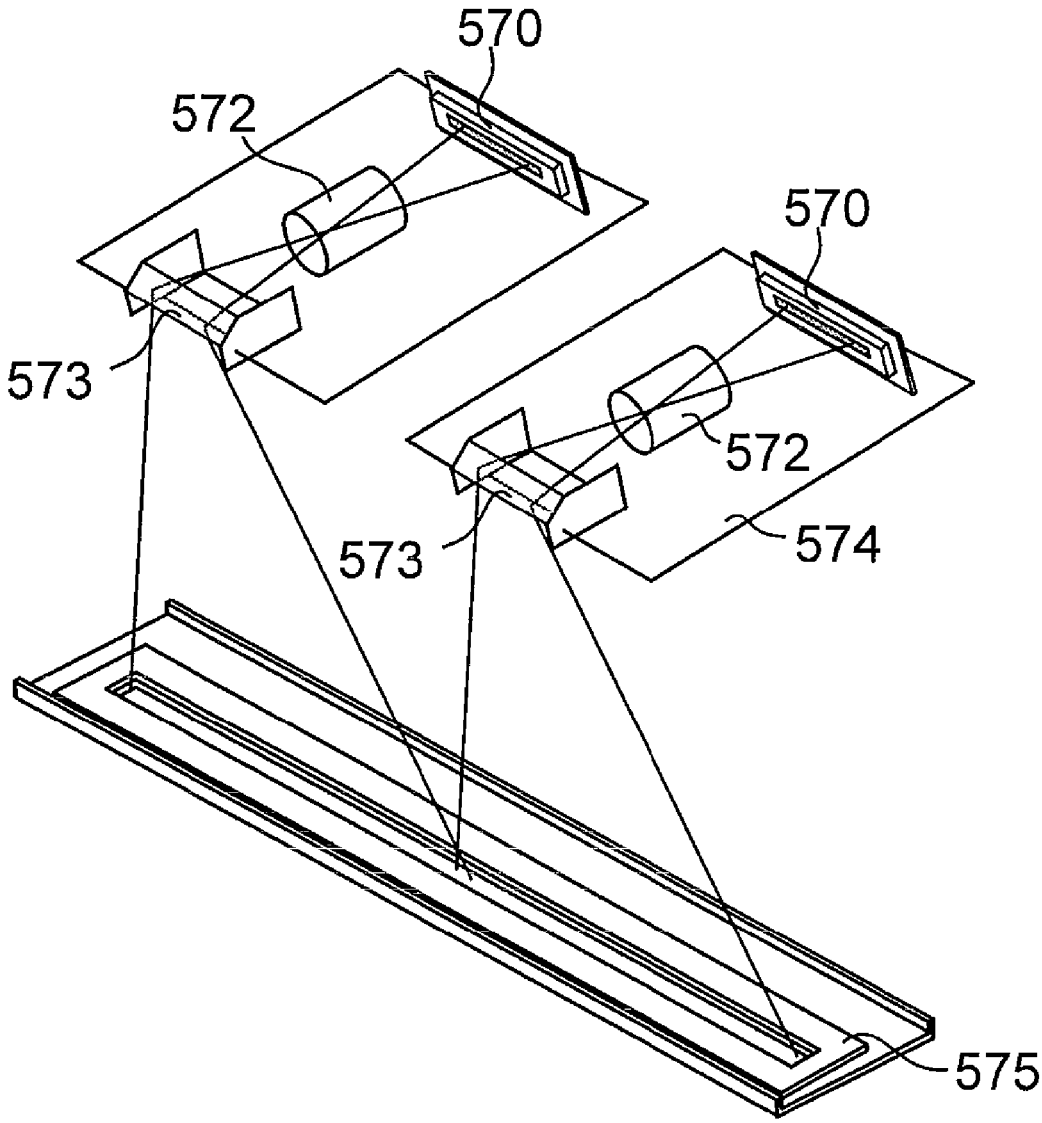
FIG. 21 is a schematic drawing of an in-line detection unit.

FIG. 21 is a schematic drawing of the in-line detection unit 90. In the in-line detection unit 90, reading unit sensors 574 each comprising a line CCD 570 (corresponding to an "image reading device"), a lens 572 which focuses (provides) an image on a light receiving surface of the line CCD 570, and a mirror 573 which bends the light path which are integrated in a unified manner, are provided in parallel fashion and respectively read out the image on a recording medium. The line CCD 570 has an array of color-specific photocells (pixels) provided with three-color RGB filters, and is able to read in a color image by means of RGB color analysis (color separation). For example, a CCD analog shift register is provided next to a photo-cell array of each of the RGB three (3) lines, and the CCD analog register respectively and independently transfers electric charges for each of the even-numbered pixels and odd-numbered pixels in a single line.

More specifically, it is possible to use an NEC Electronics line CCD "μ PD8827A" (product name) having a pixel pitch of 9.325 μm, 7600 pixels×RGB, and an element length (width of the sensor in direction of arrangement of photocells) of 70.87 mm.

The line CCD 570 is fixed in a configuration where the direction of arrangement of the photocells is parallel with the axis of the drum on which the recording medium is conveyed.

The lens 572 is a lens of a condenser optics system which focuses (provides) an image on the recording medium that is wrapped about the conveyance drum (reference numeral 84 in FIG. 1), at a prescribed rate of reduction. For example, if a lens which reduces the image to 0.19 times is employed, then an image having the 373 mm width on the recording medium is focused (provided) onto the line CCD 570. In this case, the reading resolution on the recording medium is 518 dpi.

As illustrated in FIG. 21, the reading sensor units 574 each comprising the integrated line CCD 570, lens 572 and mirror 573 can be moved and adjusted in parallel with the axis of the conveyance drum, whereby the positions of the two reading sensor units 574 are adjusted and the respective reading sensor units 574 are disposed in such a manner that the images read by same are slightly overlapping. Furthermore, although not illustrated in FIG. 21, as an illumination device for determination, a xenon fluorescent lamp is disposed on the rear surface of a bracket 575, on the side of the recording medium, and a white reference plate is inserted periodically between the image and the illumination source, and a white reference is measured. In this state, the lamp is extinguished and a black reference level is measured.

The reading width of the line CCD 570 (the range which can be scanned in one action) can be designed variously in accordance with the width of the image recording range on the recording medium. From the viewpoint of lens performance and resolution, for example, the reading width of the line CCD 570 is approximately ½ of the width of the image recording range (the maximum width which can be scanned).

The image data obtained by the line CCD 570 is converted into digital data by an A/D converter, or the like, and stored in a temporary memory, whereupon the data is processed via the system controller 104 and stored in the memory (for example, a memory which also serves as the image memory 106 in FIG. 13).

First Modification of Embodiment

Furthermore, in the inkjet recording apparatus 1, the first test pattern and the second test pattern recorded on the recording medium are read in by one in-line detection unit 90, but the implementation of the present invention is not limited to this, and it is also possible separately to provide a scanner (detection unit) which reads in the first test pattern and a scanner (detection unit) which reads in the second test pattern.

By providing separate scanners in this way, it is possible to provide scanners which are designed specifically for their purpose. In other words, the scanner which reads the first test pattern can be a scanner which reads an image so as to be able to calculate the droplet ejection positions accurately (for example, a scanner which has low density tone graduation but reads the image at a high resolution) and the scanner which reads the second test pattern can be a scanner which reads the image in such a manner that density change can be calculated accurately, (for example, a scanner which does not have high resolution, but reads in the image with high density tone graduation).

By this means, it is possible to detect density non-uniformities more accurately. Moreover, since it is not necessary to switch the scanner mode, then operation becomes more straightforward.

If separate scanners are provided, then the scanner which reads in the first test pattern desirably employs a scanner which reads in an image at higher resolution than the scanner which reads in the second test pattern.

Second Modification of Embodiment

In the inkjet recording apparatus 1 described above, a scanner is provided in the conveyance path of the recording medium inside the apparatus (in other words, an in-line detection type system is employed), but the implementation of the present invention is not limited to this, and it is also possible to provide a scanner at a position outside the conveyance path of the recording medium, for example, outside the frame of the image recording apparatus (in other words, an off-line scanner system), and to read in a recording medium on which an image has been printed by the image recording apparatus by means of the scanner provided outside the frame of the image recording apparatus and to detect density non-uniformity by means of a similar method to that described above.

For example, the scanner which reads in the first test pattern is an off-line scanner, and the scanner which reads in the second test pattern is an on-line scanner, and by making the scanner which reads in the first test pattern one scanner which is shared by a plurality of image recording apparatuses, then the number of scanners which read an image of high resolution is reduced, and hence apparatus-related costs can be lowered.

Furthermore, as described above, the first density non-uniformity compensation information does not change suddenly, and therefore is calculated at lower frequency than the second density non-uniformity compensation information. Consequently, if the related scanner is a separate member and time is required for calculation, this presents little problem to the operation of the apparatus.

Third Modification of the Embodiment

In the embodiment described above, straight lines divided into four sets are formed as a first test pattern, but the present invention is not limited to this and it is also possible to form straight lines divided into two sets, to form straight lines divided into three sets, or to form straight lines divided into five or more sets.

In the embodiment described above, a pattern of straight lines is formed by continuous droplet ejection from one nozzle, respectively for each nozzle, but it is also possible to determine the landing position on the basis of one droplet ejection point.

Furthermore, in a state where adjacent droplet ejection points do not make contact on the recording medium, in other words, if one droplet ejection point and the adjacent droplet ejection point are not in contact, then it is possible to form the droplet ejection points formed by all of the ejection units on the same straight line in a direction perpendicular to the conveyance direction of the recording medium.

For example, if it is possible to adjust the size of the ejected ink droplets, in other words, if it is possible to adjust the size of the droplet ejection points, then it is possible to prevent one droplet ejection point from making contact with an adjacent droplet ejection point by making the ejected ink droplet small and thereby making the droplet ejection point small.

By avoiding contact between one droplet ejection point and an adjacent droplet ejection point in this way, it is possible accurately to calculate the respective ends of each droplet ejection point in the reference direction.

Fourth Modification of Embodiment

In the embodiment described above, an ejection control signal is generated by binarizing image data in a binarization processing unit, but the implementation of the present invention is not limited to this, and the image data may be converted to N values (where $N \geqq 2$) in accordance with the ejection characteristics of the recording head. For example, if the recording head is able to eject large dots and small dots, then the image data may be subjected to ternary data processing (processing of conversion into three values) in order to generate an ejection control signal comprising three values: large dot, small dot and no ejection.

Fifth Modification of Embodiment

In the embodiment described above, the recording head of the printing unit is described in terms of a full line head in which ejection units are arranged in a single line configuration, but the recording head is not limited to a single row configuration and as illustrated in FIGS. 7A and 7B, it is also possible to form an image of higher resolution by arranging the nozzles 502 in a two-dimensional configuration and thereby forming one row of droplet ejection points by means of ejection units in a plurality of rows.

Furthermore, in the present embodiment, an apparatus composition which forms a color image by using inks of a plurality of colors (YMCK) is described, but it is also possible to employ only a recording head which ejects one color only (for instance, K (black) ink), in other words, a monochrome recording head unit, in an image forming apparatus which prints a monochrome image.

Composition of Remote Monitoring System

Next, an example of a system for remotely monitoring the inkjet recording apparatus 1 described above via a network will be described.

Figure 22:
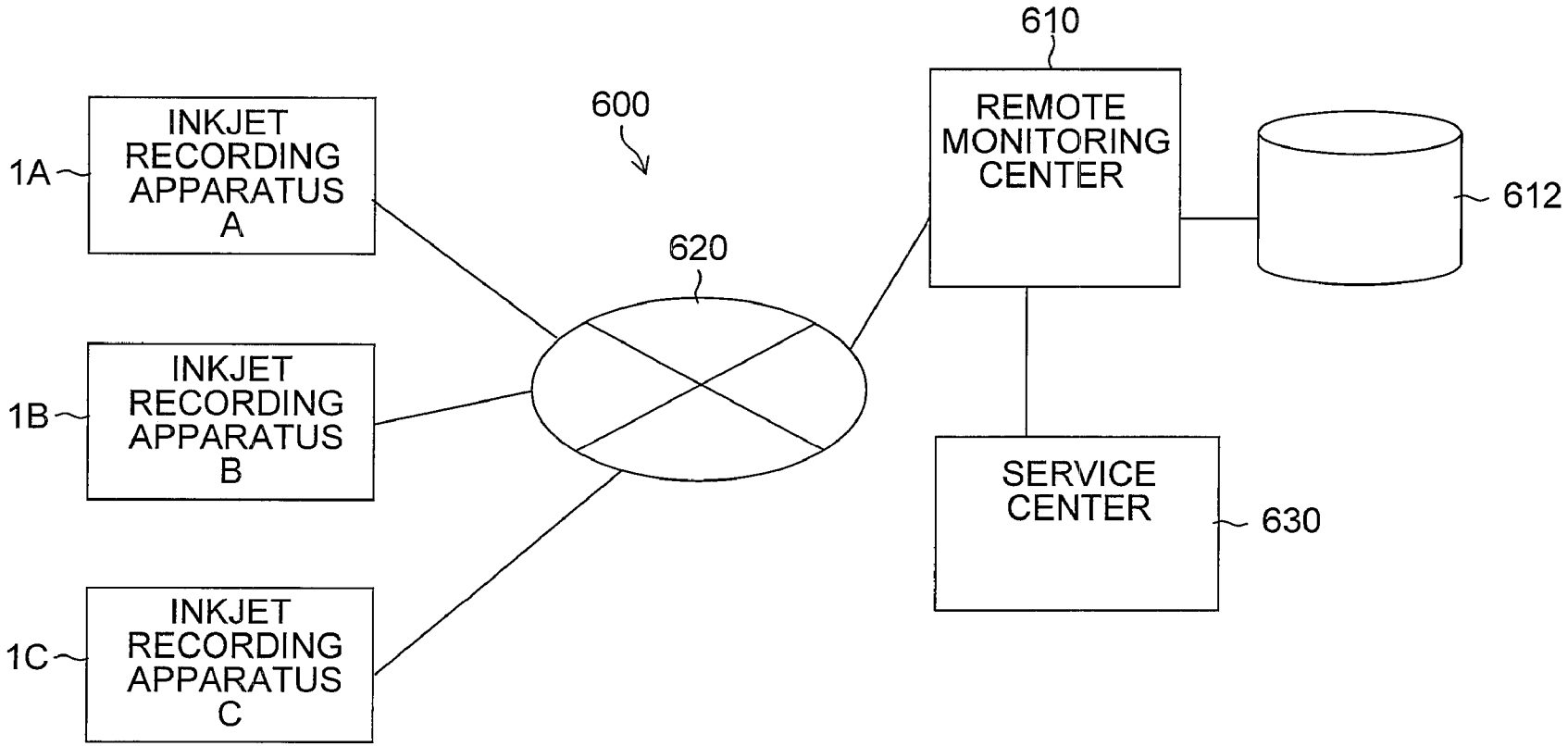
FIG. 22 is a schematic drawing of a remote monitoring system.

FIG. 22 is a schematic drawing of a remote monitoring system 600. Here, the system described by way of example is a system where a plurality of inkjet recording apparatuses 1A, 1B and 1C are centrally managed by means of a computer in a remote monitoring center (hereinafter, called "remote monitoring center apparatus") 610. In FIG. 22, three inkjet recording apparatuses 1A, 1B and 1C are depicted, but there are no particular restrictions on the number of inkjet recording apparatuses which are the object of monitoring.

The respective inkjet recording apparatuses 1A, 1B and 1C are connected communicably to the remote monitoring center apparatus 610 via communications lines 620. There are no particular restrictions on the mode of the communications circuit 620, which may be an internal LAN, or a wide area network (WAN) such as the Internet. There are no particular restrictions on the communications method, which may be wired, wireless, or a combination of these.

The respective inkjet recording apparatuses 1A, 1B and 1C each send information read in and gathered by the in-line detection unit 90 in that apparatus, to the remote monitoring center apparatus 610 via the communications lines 620. The remote monitoring center apparatus 610 stores the information gathered from the inkjet recording apparatuses 1A, 1B and 1C in a storage apparatus 612, and thereby accumulates data relating to the number of occurrences of ejection abnormalities, and the timing and the occurrence probability of same, and the like, for each apparatus and each model.

The remote monitoring center apparatus 610 calculates the time t which is used to calculate a prediction of the occurrence of ejection abnormality (time period for one ejection abnormality occurring) on the basis of the gathered information, and sends this information, as necessary, to the respective inkjet recording apparatuses 1A, 1B and 1C.

By this means, the inkjet recording apparatuses 1A, 1B and 1C are able to predict the occurrence of ejection abnormalities using the most recent parameters.

In the inkjet recording apparatuses 1A, 1B and 1C, if it is judged that head replacement, or the like, is necessary and a warning to this effect is issued, then either automatically or by means of an operator receiving the warning and carrying out a prescribed operation, information requesting a maintenance service is sent from the apparatus to the remote monitoring center apparatus 610.

The remote monitoring center apparatus 610 is connected in a communicable fashion with a computer of the service center which provides maintenance services (hereinafter, called "service center apparatus") 630, creates information requesting the dispatch of a service technician in respect of the inkjet recording apparatus 1A, 1B or 1C where head replacement or intensive maintenance by the service technician has been judged necessary, and sends this maintenance request information to the service center apparatus 630.

The service center apparatus 630 centrally manages the maintenance request information and assists the task of dispatching service technicians. In this way, a service technician is dispatched to the site of the apparatus in question, from the service center, and the service technician carries out the required maintenance task, such as head replacement.

The remote monitoring center apparatus 610 and the service center apparatus 630 may be connected via an internal LAN, or via a wide area network (WAN) such as the Internet. Furthermore, a mode is also possible where the remote monitoring center apparatus 610 and the service center apparatus 630 are realized by means of a shared computer, and a composition is also possible where the host computer 118 illustrated in FIG. 13 also serves as the remote monitoring center apparatus 610.

Example of Creation of Cyan Ink Composition

Next, concrete examples of an ink and treatment liquid which are suitable for the present embodiment will be described.

The following description indicates an example of synthesis. (Synthesis of resin dispersant P-1) This is synthesized by the following scheme.

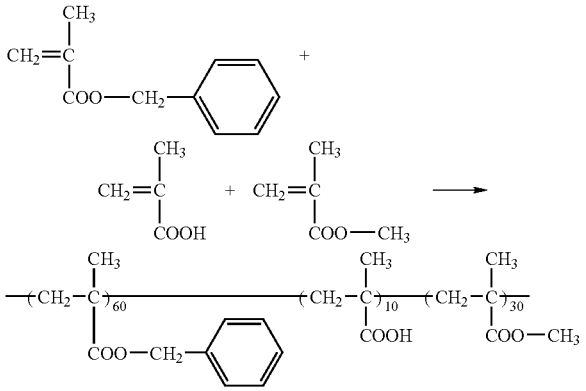

P-1

A total of 88 g of methyl ethyl ketone was placed in a three-neck flask with a capacity of 1000 milliliters (ml) equipped with a stirrer and a cooling tube, heating to 72° C. was performed under a nitrogen atmosphere, and then a solution obtained by dissolving 0.85 g of dimethyl 2,2'-azobisisobutyrate, 60 g of benzyl methacrylate, 10 g of methacrylic acid, and 30 g of methyl methacrylate in 50 g of methyl ethyl ketone was dropwise added within 3 hours. Upon completion of dropping, the reaction was conducted for 1 hour, then a solution obtained by dissolving 0.42 g of dimethyl 2,2'-azobisisobutyrate in 2 g of methyl ethyl ketone was added, the temperature was raised to 78° C. and heating was performed for 4 hours. The reaction solution obtained was twice reprecipitated in a large excess amount of hexane, and the precipitated resin was dried to obtain 96 g of the resin dispersant P-1.

The composition of the obtained resin was verified by $^{1}$H-NMR, and the weight-average molecular weight (Mw) found by GPC was 44,600. Further, the acid value of the polymer was found by a method described in a JIS standard (JIS K0070:1992). The result was 65.2 mg KOH/g.

A total of 360.0 g of methyl ethyl ketone was loaded into a reaction a three-neck flask of two liters and equipped with a stirrer, a thermometer, a reflux cooler, and a nitrogen gas introducing tube, and the temperature was raised to 75° C. A mixed solution including 180.0 g of phenoxyethyl acrylate, 162.0 g of methyl methacrylate, 18.0 g of acrylic acid, 72 g of methyl ethyl ketone, and 1.44 g of "V-601" (manufactured by Wako Junyaku) was dropwise added at a constant rate so that the dropwise addition was completed within 2 hours, while maintaining the temperature inside the reaction container at 75° C. Upon completion of dropping, a solution including 0.72 g of "V-601" and 36.0 g of methyl ethyl ketone was added and stirring was performed for 2 hours at a temperature of 75° C. Then, a solution including 0.72 g of "V-601" and 36.0 g of isopropanol was added and stirring was performed for 2 hours at 75° C., followed by heating to 85° C. and further stirring for 2 hours. The weight-average molecular weight (Mw) of the copolymer obtained was 64,000, and the acid value was 38.9 (mg KOH/g). The weight-average molecular weight (Mw) was calculated by polystyrene recalculation by gel permeation chromatography (GPC). The columns TSKgel SuperHZM-H, TSKgel SuperHZ4000, and TSKgel SuperHZ200 (manufactured by Tosoh Corp.) were used in this process.

A total of 668.3 g of the polymerization solution of the copolymer was then weighed, 388.3 g of isopropanol and 145.7 ml of 1 mol/L aqueous NaOH solution were added, and the temperature inside the reaction container was raised to 80° C. Then, 720.1 g of distilled water was dropwise added at a rate of 20 ml/min and an aqueous dispersion was obtained. The temperature inside the reaction container was then maintained for 2 hours at 80° C., for 2 hours at 85° C., and for 2 hours at 90° C. under atmospheric pressure, and the pressure inside the reaction container was then lowered to distill out a total of 913.7 g of isopropanol, methyl ethyl ketone, and distilled water. As a result, an aqueous dispersion (emulsion) of self-dispersible polymer microparticles (B-01) with a concentration of solids of 28.0% was obtained. A chemical structure formula of the self-dispersible polymer microparticles (B-01) is presented below. The numerical values relating to each structural unit represent a weight ratio.

(B-01)

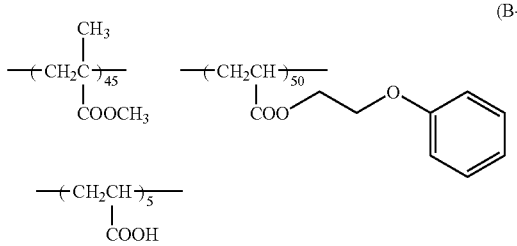

Preparation of Dispersion of Resin Particles Including a Cyan Pigment

A total of 10 parts by weight by a Pigment Blue 15:3 (Phthalocyanine Blue A220, manufactured by Dainichi Seika Color & Chemicals), 5 parts by weight of the resin dispersant (P-1), 42 parts by weight of methyl ethyl ketone, 5.8 parts by weight of 1N aqueous NaOH solution, and 86.9 parts by weight of deionized water were mixed and dispersed for 2 hours to 6 hours in a bead mill using zirconia beads with a diameter of 0.1 mm.

The methyl ethyl ketone was removed from the obtained dispersion at 55° C. under reduced pressure and part of water was then removed to obtain a dispersion of resin particles including a pigment with a pigment concentration of 10.2 wt %.

Preparation of Cyan Ink Composition C-1

The obtained dispersion of resin particles including a pigment and self-dispersible polymer microparticles (B-01) were used to prepare an ink composition of the following composition:

- Dispersion of resin particles including a cyan pigment: 39.2 parts by weight.
- Self-dispersible polymer microparticles (B-01): 28.6 parts by weight.
- GP-250 (oxypropylene glyceryl ether, Sunnicks GP250, manufactured by Sanyo Chemical Industries, Ltd.): 10 parts by weight.
- DEGmEE (diethylene glycol monoethyl ether): 5 parts by weight.
- Olfine E1010 (manufactured by Nisshin Kagaku Kogyo): 1 part by weight.
- Deionized water: 16.2 part by weight.

Preparation of Magenta Ink Composition M-1

A magenta ink composition M-1 was prepared in the same manner as the cyan ink composition, except that Cromophthal Jet Magenta DWQ (PR-122) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

Preparation of Yellow Ink Composition Y-1

A yellow ink composition Y-1 was prepared in the same manner as the cyan ink composition, except that Irgalite Yellow GS (PY74) manufactured by Chiba Specialty Chemicals was used instead of the Pigment Blue 15:3 (Phthalocyanine Blue A220, manufactured by Dainichi Seika Color & Chemicals) used in the preparation of the cyan pigment dispersion.

Preparation of Black Ink Composition Bk-1

A black ink composition Bk-1 was prepared in the same manner as the cyan ink composition, except that Carbon Black MA100 manufactured by Mitsubishi Chemicals was used instead of the Pigment Blue 15:3 (Phthalocyanine Blue A220, manufactured by Dainichi Seika Color & Chemicals) used in the preparation of the cyan pigment dispersion.

Preparation of Aggregating Treatment Agent

An aggregating treatment agent was prepared by mixing materials according to the following composition.

- Malonic acid (made by Wako Pure Chemical Industries, Ltd.): 22.5 wt %
- GP250 (a trioxypropylene glyceryl ether, Sannix GP250, made by Sanyo Chemical Industries, Ltd.): 10.0 wt %
- Surfactant 1 (structure as in Chemical Formula II below): 0.01 wt %
- Deionized water: 67.49%

When the physical properties of the reaction liquid prepared in this way were measured, the viscosity was 2.3 mPa·s, the surface tension was 42 mN/n and the pH was 0.9.

Chemical Formula 11

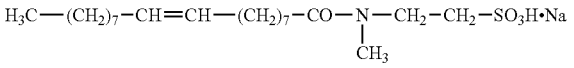

As described above, it is possible to carry out intensive maintenance or head replacement at an optimal timing by means of an embodiment to which the present invention is applied.

The range of application of the present invention is not limited to the embodiments described above, and various improvements or modifications may be implemented within a scope that does not deviate from the essence of the present invention.

APPENDIX

As has become evident from the detailed description of the embodiments given above, the present specification includes disclosure of various technical ideas including the inventions described below.

One aspect of the invention is directed to an image forming apparatus comprising: a recording head which has a plurality of nozzles for ejecting an ink onto a recording medium; a movement device which causes relative movement between the recording head and the recording medium; an image forming controller which controls the recording head according to image data in such a manner that an image corresponding to the image data is formed on the recording medium; an ejection abnormality detection device which detects an ejection abnormality caused by at least one of non-ejection and ejection direction deviation of the plurality of nozzles; a compensation device which compensates an image defect caused by the ejection abnormality; and a determination device which determines whether or not the head is in a state where the compensation device can compensate the image defect, according to detection result of the ejection abnormality detection device.

The inkjet recording apparatus which is one mode of the image forming apparatus of the present invention comprises: a liquid ejection head (recording head) in which a plurality of liquid droplet ejection elements (ink liquid chamber units) are arranged at high density, each liquid droplet ejection element comprising a nozzle (ejection port) for ejecting an ink droplet in order to form a dot and a pressure generating device (piezoelectric element or heating element for heating and bubble generation) which generates an ejection pressure; and an ejection control device which controls the ejection of liquid droplets from the liquid ejection head on the basis of ink ejection data (dot image data) generated from the input image. An image is formed on a recording medium by means of the liquid droplets ejected from the nozzles.

For example, color conversion and halftone processing are carried out on the basis of the image data (print data) input via the image input device, and ink ejection data corresponding to the ink colors is generated. The driving of the pressure generating elements corresponding to the respective nozzles of the liquid ejection head is controlled on the basis of this ink ejection data, and ink droplets are ejected from the nozzles.

In order to achieve high-resolution image output, a desirable mode is one using a recording head in which a large number of liquid droplet ejection elements (ink chamber units) are arranged at high density, each liquid droplet ejection element comprising a nozzle (ejection port) which ejects ink liquid, and a pressure chamber and a pressure generating device corresponding to the nozzle.

A compositional example of a recording head based on an inkjet method of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzle rows which do not reach a length corresponding to the full width of the recording medium are combined and joined together, thereby forming a nozzle row of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction.

The conveyance device for causing the recording medium and the recording head to move relative to each other may include a mode where the recording medium is conveyed with respect to a stationary (fixed) head, or a mode where a head is moved with respect to a stationary recording medium, and a mode where both the head and the recording medium are moved. When forming color images by means of an inkjet recording head, it is possible to provide recording heads each of which is provided for each color of a plurality of colored inks (recording liquids), or it is possible to eject inks of a plurality of colors, from one recording head.

Possible modes of the conveyance device are a conveyance drum (conveyance roller) having a round cylindrical shape which is able to rotate about a prescribed rotational axis, and a conveyance belt, and the like.

More specifically, the term "recording medium" includes various types of media, irrespective of material and size, such as continuous paper, cut paper, sealed paper, resin sheets, such as OHP sheets, film, cloth, a printed circuit board on which a wiring pattern, or the like, is formed, and the like.

Desirably, the determination device stores number of occurrences of the ejection abnormality which cannot be restored by normal maintenance operation including at least one of wiping of the nozzle surface, preliminary ejection and nozzle suctioning, over elapsed time, and determines that, when the number of occurrences has started to increase and exceeded a specific value, the recording head is in a state where a compensating effect by the compensation device cannot be expected.

A normal maintenance operation is, for example, an operation of head maintenance which is carried out at the start up of the apparatus or before the start of a print job, or the like, and is implemented on the basis of a prescribed program.

When the occurrence of ejection abnormalities starts to increase rapidly at an accelerated pace, there is a high possibility that sufficient response cannot be provided compensation by means of a compensation device, and therefore a desirable mode is one where head replacement or intensive maintenance is recommended in such situations.

Desirably, the determination device determines that, the recording head is in a state where a compensating effect by the compensation device cannot be expected, when a probability of $8n/(a-n)$ that a position of a nozzle that is next to suffer the ejection abnormality is within four nozzle positions of a nozzle that has already suffered the ejection abnormality reaches b % where t represents a time until one ejection abnormality occurs, a represents total number of the plurality of nozzles, $n=x/t$ represents quantity of the ejection abnormality occurring after a time x, and $0.5 \leqq b \leqq 20$ is satisfied.

When compensation is carried out to compensate an image defect by means of adjacent nozzles surrounding a nozzle that has given rise to an ejection abnormality causing the image defect, in an actual nozzle row in a recording head, if the nozzle positions of ejection abnormalities are close together, then there is a greater possibility that the image defect cannot be compensated by the compensation device. A desirable mode is one where a situation such as this is predicted on the basis of probabilistic technique, and the timing for head replacement or intensive maintenance is decided on the basis of a probability b % which is a suitable judgment reference.

By setting the probability b % of the judgment reference to a suitable range, it is possible to recommend head replacement or intensive maintenance immediately before compensation becomes impossible.

Desirably, the image forming apparatus further comprises a treatment liquid deposition device which deposits a treatment liquid for aggregating the ink on the recording medium, wherein the recording head ejects the ink onto the recording medium onto which the treatment liquid has been deposited.

An image forming apparatus which employs a method of aggregating ink by reaction with a treatment liquid tends to be more liable to produce ejection abnormalities than an apparatus which does not use treatment liquid, and therefore application of the present invention is particularly effective in such an apparatus.

Desirably, the image is formed on the recording medium in accordance with a single pass recording.

In the case of a single pass method which forms an image by means of a single scanning action, if an ejection abnormality occurs in a nozzle of the recording head, it is not possible directly to eject a droplet onto the droplet ejection point that should have been recorded by the abnormal nozzle, from another nozzle, and therefore compensation is generally carried out so as to compensate the resulting image defect by amending the ink ejection volume and the droplet ejection arrangement from the adjacent nozzles. Application of the present invention is effective in an apparatus mode of this kind.

Desirably, the ejection abnormality detection device includes an image reading device which reads the image formed on the recording medium by the recording head during conveyance of the recording medium.

By adopting an in-line detection method, it is possible to automate detection.

Desirably, the compensation device comprises: a first recording characteristics information acquisition device which acquires first recording characteristics information on the plurality of nozzles from reading result of a first test pattern which is formed on the recording medium by ejecting the ink from the plurality of nozzles of the recording head; a first density non-uniformity compensation information calculation device which determines first density non-uniformity compensation information from the first recording characteristics information; a second recording characteristics information acquisition device which acquires second recording characteristics information on the plurality of nozzles from reading result of a second test pattern that is different from the first test pattern and that is formed on the recording medium by ejecting the ink from the plurality of nozzles of the recording head; a second density non-uniformity compensation information calculation device which determines second density non-uniformity compensation information from the second recording characteristics information; a third density non-uniformity compensation information calculation device which determines third density non-uniformity compensation information from the first density non-uniformity compensation information and the second density non-uniformity compensation information; a density compensation processing device which compensates the image data according to the third density non-uniformity compensation information so as to calculate the image data which has been subjected to density non-uniformity compensation; and an ejection control signal calculation device which calculates an ejection pattern of the plurality of nozzles according to the image data which has been subjected to the density non-uniformity compensation.

Various compensation methods can be used as a method of compensating an image defect (density non-uniformity), but, for example, this aspect of the invention is desirable.

Furthermore, in relation to this aspect of the invention, the present specification provides an image recording apparatus, comprising: a recording head having a plurality of recording elements for ejecting ink droplets onto a recording medium; a movement device which causes relative movement between the recording head and the recording medium; a recording operation control device which causes an image to be recorded onto the recording medium by ejecting ink droplets from the recording head onto the recording medium while the recording head and the recording medium are moved relatively with respect to each other; a first test pattern reading device which reads a first test pattern formed on a recording medium by ejecting ink droplets from each of the recording elements of the recording head; a first recording characteristics information acquisition device which acquires first recording characteristics information about the recording elements from the reading result of the first test pattern; a first density non-uniformity compensation information calculation device which determines first density non-uniformity compensation information from the first recording characteristics information; a second test pattern reading device which reads a second test pattern, different to the first test pattern, which is formed on the recording medium by ejecting ink droplets from each of the recording elements of the recording head; a second recording characteristics information acquisition device which acquires second recording characteristics information about the recording elements from the reading result of the second test pattern; a second density non-uniformity compensation information calculation device which determines second density non-uniformity compensation information from the second recording characteristics information; a third density non-uniformity compensation information calculation device which determines third density non-uniformity compensation information from the first density non-uniformity compensation information and the second density non-uniformity compensation information; a density compensation processing device which calculates image data compensated for density non-uniformity by compensating the image data on the basis of the third density non-uniformity compensation information; and an ejection pattern calculation device which calculates an ejection pattern for the recording elements from the image data compensated for density non-uniformity.

Here, desirably, the first density non-uniformity compensation information calculation device calculates the positions at which the ink droplets ejected from the respective recording elements land on the recording medium, and calculates first density non-uniformity compensation information on the basis of the landing position information thus determined, and the second density non-uniformity compensation information calculation device detects density non-uniformity caused by change in the ink droplet volumes ejected from the respective recording elements, on the basis of density variation in the second test pattern, and calculates second density non-uniformity compensation information on the basis of density non-uniformity caused by the ink droplet volumes ejected from the respective recording elements thus determined.

Furthermore, desirably, the first test pattern reading device and the second test pattern reading device are the same device which has switchable resolution.

Moreover, desirably, the first test pattern reading device and the second test pattern reading device are not disposed on the conveyance path of the recording medium by the movement device.

Moreover, desirably, the first test pattern reading device and the second test pattern reading device are disposed on the conveyance path of the recording medium by the movement device.

Furthermore, desirably, the first test pattern reading device is not disposed on the conveyance path of the recording medium by the movement device, and the second test pattern reading device is disposed on the conveyance path of the recording medium by the movement device.

Desirably, the image forming apparatus further comprises an information output device which, when determination is made that the recording head is in a state where a compensating effect by the compensation device cannot be expected, outputs information indicating the determination.

By outputting a determination result from the determination device, it is possible to control notification of a warning, transfer to a particular operating mode, and the like, on the basis of this output information.

Desirably, the information output device includes a notification device which notifies a warning for recommending implementation of replacement of the recording head and intensive maintenance.

According to this mode, it is possible to carry out efficient head replacement and intensive maintenance.

Desirably, the image forming apparatus automatically transfers to a prescribed compulsory maintenance mode according to a signal output from the information output device.

It is also possible to adopt a mode in which, instead of or in combination with the issuing of a warning which reports the timing of head replacement, or the like, the apparatus automatically transfers to a compulsory maintenance mode.

Desirably, the image forming apparatus further comprises a communication device which is capable of providing a communication connection with an external apparatus, wherein information obtained by the ejection abnormality detection device can be sent to the external apparatus which is connected in a communicable fashion via the communication device.

Another aspect of the present invention is directed to a remote monitoring system comprising: the image forming apparatus; and a remote monitoring information management apparatus which serves as the external apparatus that gathers and manages the information obtained by the ejection abnormality detection device of the image forming apparatus.

Desirably, the remote monitoring system further comprises a maintenance service request information generation device which generates information requesting dispatch of a service technician for the image forming apparatus which has been determined to have the recording head in a state where a compensating effect by the compensation device cannot be expected.

The maintenance service request information generation device may be provided in the image forming apparatus, or may be provided in the remote monitoring information management apparatus.

Another aspect of the present invention is directed to a method of providing a maintenance service, in which in use of the remote monitoring system, a service technician is dispatched and at least one maintenance task of head replacement and intensive maintenance is carried out by the service technician, for the image forming apparatus which is determined to have the recording head in a state where a compensating effect by the compensation device cannot be expected.

Another aspect of the present invention is directed to an image forming method which causes an ink to be ejected from a plurality of nozzles of a recording head onto a recording medium while causing relative movement between a recording medium and the recording head in such a manner that an image is formed on the recording medium, the image forming method comprising: an ejection abnormality detection step of detecting ejection abnormality including at least one of non-ejection and ejection direction deviation of the plurality of nozzles; a compensation step of compensating an image defect caused by the ejection abnormality; and a determination step of determining whether or not the recording head is in a state where compensation in the compensation step is possible, according to detection result in the ejection abnormality detection step.

It is desirable to use a method such as the following as a method of compensating an image defect.

In other words, the present specification provides an image recording method of recording an image on a recording medium by an image recording apparatus having a recording head having a plurality of recording elements for ejecting ink droplets onto a recording medium and a movement device which causes relative movement between the recording head and the recording medium, in such a manner that ink droplets are ejected from the recording elements onto the recording medium while the recording head and the recording medium are moved relatively with respect to each other by the movement device. The image recording method comprises: a first recording characteristics information acquisition step of ejecting ink droplets from the respective recording elements of the recording head to form a first test pattern on the recording medium, reading in the first test pattern thus created, and acquiring first recording characteristics information about the recording elements from the reading result; a first density non-uniformity compensation information calculation step of determining first density non-uniformity compensation information from the first recording characteristics information; a second recording characteristics information acquisition step of ejecting ink droplets from the respective recording elements of the recording head to form a second test pattern, which is different to the first test pattern, on the recording medium, reading in the second test pattern thus created, and acquiring second recording characteristics information about the recording elements from the reading result; a second density non-uniformity compensation information calculation step of determining second density non-uniformity compensation information from the second recording characteristics information; a third density non-uniformity compensation information calculation step of determining third density non-uniformity compensation information from the first density non-uniformity compensation information and the second density non-uniformity compensation information; a density compensation processing step of calculating image data compensated for density non-uniformity by compensating the image data on the basis of the third density non-uniformity compensation information; and an ejection control signal calculation step of calculating an ejection pattern of the recording elements on the basis of the image data compensated for density non-uniformity.

Here, desirably, the second density non-uniformity compensation information calculation step calculates density non-uniformity of lower frequency than the density non-uniformity calculated by the first density non-uniformity compensation information calculation step.

Furthermore, desirably, the first recording characteristics information is information about the positions where ink droplets ejected respectively from the recording elements land on the recording medium.

Desirably, the second density non-uniformity compensation information acquisition step creates the second test pattern using the first density non-uniformity compensation information.

Desirably, the second recording characteristics information acquisition step acquires second density non-uniformity compensation information at a higher frequency than the acquisition of the first density non-uniformity compensation information by the first recording characteristics information acquisition step.

Desirably, the first characteristics information acquisition step reads in the first test pattern at a higher resolution than the resolution of the image data of the first test pattern, and the second characteristics information acquisition step reads in the second test pattern at a lower resolution than the first characteristics information acquisition step.

Desirably, the first characteristics information acquisition step reads in the first test pattern at two or more times the resolution of the image data of the first test pattern.

Desirably, the first recording characteristics information and the second recording characteristics information are density information with respect to each recording element.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a recording head which has a nozzle surface including a plurality of nozzles for ejecting an ink onto a recording medium;

a movement device which causes relative movement between the recording head and the recording medium;

an image forming controller which controls the recording head according to image data in such a manner that an image corresponding to the image data is formed on the recording medium;

an ejection abnormality detection device which detects ejection abnormality including at least one of non-ejection and ejection direction deviation of the plurality of nozzles;

a compensation device which compensates an image defect caused by the ejection abnormality;

a determination device which determines whether or not the recording head is in a state where a compensation effect caused by the compensation device is not expected, according to detection result of the ejection abnormality detection device; and a display unit which shows a warning display when the determination device determines that the recording head is in a state where a compensation effect caused by the compensation device is not expected.

2. The image forming apparatus as defined in claim 1, further comprising a treatment liquid deposition device which deposits a treatment liquid for aggregating the ink on the recording medium, wherein the recording head ejects the ink onto the recording medium onto which the treatment liquid has been deposited.

3. The image forming apparatus as defined in claim 1, wherein the image is formed on the recording medium in accordance with a single pass recording.

4. The image forming apparatus as defined in claim 1, wherein the ejection abnormality detection device includes an image reading device which reads the image formed on the recording medium by the recording head during conveyance of the recording medium.

5. The image forming apparatus as defined in claim 1, further comprising an information output device which, when determination is made that the recording head is in a state where a compensating effect by the compensation device cannot be expected, outputs information indicating the determination.

6. The image forming apparatus as defined in claim 5, wherein the display unit shows a warning display for recommending implementation of replacement of the recording head or intensive maintenance.

7. The image forming apparatus as defined in claim 5, wherein the image forming apparatus automatically transfers to a prescribed compulsory maintenance mode according to a signal output from the information output device.

8. The image forming apparatus as defined in claim 1, further comprising a communication device which is capable of providing a communication connection with an external apparatus, wherein information obtained by the ejection abnormality detection device can be sent to the external apparatus which is connected in a communicable fashion via the communication device.

9. A remote monitoring system comprising:

the image forming apparatus as defined in claim 8; and a remote monitoring information management apparatus which serves as the external apparatus that gathers and manages the information obtained by the ejection abnormality detection device of the image forming apparatus.

10. The remote monitoring system as defined in claim 9, further comprising a maintenance service request information generation device which generates information requesting dispatch of a service technician for the image forming apparatus which has been determined to have the recording head in a state where a compensating effect by the compensation device cannot be expected.

11. A method of providing a maintenance service, in which in use of the remote monitoring system as defined in claim 9, a service technician is dispatched and at least one maintenance task of head replacement and intensive maintenance is carried out by the service technician, for the image forming apparatus which is determined to have the recording head in a state where a compensating effect by the compensation device cannot be expected.

12. An image forming apparatus comprising:

a recording head which has a nozzle surface including a plurality of nozzles for ejecting an ink onto a recording medium;

a movement device which causes relative movement between the recording head and the recording medium;

an image forming controller which controls the recording head according to image data in such a manner that an image corresponding to the image data is formed on the recording medium;

an ejection abnormality detection device which detects ejection abnormality including at least one of non-ejection and ejection direction deviation of the plurality of nozzles;

a compensation device which compensates an image defect caused by the ejection abnormality; and a determination device which determines whether or not the recording head is in a state where the compensation device can compensate the image defect, according to detection result of the ejection abnormality detection device, wherein the determination device stores number of occurrences of the ejection abnormality which cannot be restored by normal maintenance operation including at least one of wiping of the nozzle surface, preliminary ejection and nozzle suctioning, over elapsed time, and determines that, when the number of occurrences has started to increase and exceeded a specific value, the recording head is in a state where a compensating effect by the compensation device cannot be expected.

13. The image forming apparatus as defined in claim 12, further comprising a treatment liquid deposition device which deposits a treatment liquid for aggregating the ink on the recording medium, wherein the recording head ejects the ink onto the recording medium onto which the treatment liquid has been deposited.

14. The image forming apparatus as defined in claim 12, wherein the image is formed on the recording medium in accordance with a single pass recording.

15. The image forming apparatus as defined in claim 12, wherein the ejection abnormality detection device includes an image reading device which reads the image formed on the recording medium by the recording head during conveyance of the recording medium.

16. The image forming apparatus as defined in claim 12, further comprising an information output device which, when determination is made that the recording head is in a state where a compensating effect by the compensation device cannot be expected, outputs information indicating the determination.

17. The image forming apparatus as defined in claim 16, wherein the information output device includes a notification device which notifies a warning for recommending implementation of replacement of the recording head and intensive maintenance.

18. The image forming apparatus as defined in claim 16, wherein the image forming apparatus automatically transfers to a prescribed compulsory maintenance mode according to a signal output from the information output device.

19. A remote monitoring system comprising:

the image forming apparatus as defined in claim 18; and a remote monitoring information management apparatus which serves as the external apparatus that gathers and manages the information obtained by the ejection abnormality detection device of the image forming apparatus.

20. The remote monitoring system as defined in claim 19, further comprising a maintenance service request information generation device which generates information requesting dispatch of a service technician for the image forming apparatus which has been determined to have the recording head in a state where a compensating effect by the compensation device cannot be expected.

21. A method of providing a maintenance service, in which in use of the remote monitoring system as defined in claim 19, a service technician is dispatched and at least one maintenance task of head replacement and intensive maintenance is carried out by the service technician, for the image forming apparatus which is determined to have the recording head in a state where a compensating effect by the compensation device cannot be expected.

22. The image forming apparatus as defined in claim 12, further comprising a communication device which is capable of providing a communication connection with an external apparatus, wherein information obtained by the ejection abnormality detection device can be sent to the external apparatus which is connected in a communicable fashion via the communication device.

23. An image forming apparatus comprising:

a recording head which has a nozzle surface including a plurality of nozzles for ejecting an ink onto a recording medium;

a movement device which causes relative movement between the recording head and the recording medium;

an image forming controller which controls the recording head according to image data in such a manner that an image corresponding to the image data is formed on the recording medium;

an ejection abnormality detection device which detects ejection abnormality including at least one of non-ejection and ejection direction deviation of the plurality of nozzles;

a compensation device which compensates an image defect caused by the ejection abnormality; and a determination device which determines whether or not the recording head is in a state where the compensation device can compensate the image defect, according to detection result of the ejection abnormality detection device, wherein the determination device determines that, the recording head is in a state where a compensating effect by the compensation device cannot be expected, when a probability of $8n/(a-n)$ that a position of a nozzle that is next to suffer the ejection abnormality is within four nozzle positions of a nozzle that has already suffered the ejection abnormality reaches b % where t represents a time until one ejection abnormality occurs, a represents total number of the plurality of nozzles, $n=x/t$ represents quantity of the ejection abnormality occurring after a time x, and $0.5 \leqq b \leqq 20$ is satisfied.

24. The image forming apparatus as defined in claim 23, further comprising a treatment liquid deposition device which deposits a treatment liquid for aggregating the ink on the recording medium, wherein the recording head ejects the ink onto the recording medium onto which the treatment liquid has been deposited.

25. The image forming apparatus as defined in claim 23, wherein the image is formed on the recording medium in accordance with a single pass recording.

26. The image forming apparatus as defined in claim 23, wherein the ejection abnormality detection device includes an image reading device which reads the image formed on the recording medium by the recording head during conveyance of the recording medium.

27. The image forming apparatus as defined in claim 23, further comprising an information output device which, when determination is made that the recording head is in a state where a compensating effect by the compensation device cannot be expected, outputs information indicating the determination.

28. The image forming apparatus as defined in claim 27, wherein the information output device includes a notification device which notifies a warning for recommending implementation of replacement of the recording head and intensive maintenance.

29. The image forming apparatus as defined in claim 27, wherein the image forming apparatus automatically transfers to a prescribed compulsory maintenance mode according to a signal output from the information output device.

30. A remote monitoring system comprising:

the image forming apparatus as defined in claim 29; and a remote monitoring information management apparatus which serves as the external apparatus that gathers and manages the information obtained by the ejection abnormality detection device of the image forming apparatus.

31. The remote monitoring system as defined in claim 30, further comprising a maintenance service request information generation device which generates information requesting dispatch of a service technician for the image forming apparatus which has been determined to have the recording head in a state where a compensating effect by the compensation device cannot be expected.

32. A method of providing a maintenance service, in which in use of the remote monitoring system as defined in claim 30, a service technician is dispatched and at least one maintenance task of head replacement and intensive maintenance is carried out by the service technician, for the image forming apparatus which is determined to have the recording head in a state where a compensating effect by the compensation device cannot be expected.

33. The image forming apparatus as defined in claim 23, further comprising a communication device which is capable of providing a communication connection with an external apparatus, wherein information obtained by the ejection abnormality detection device can be sent to the external apparatus which is connected in a communicable fashion via the communication device.

34. An image forming apparatus comprising:

a recording head which has a nozzle surface including a plurality of nozzles for ejecting an ink onto a recording medium;

a movement device which causes relative movement between the recording head and the recording medium;

an image forming controller which controls the recording head according to image data in such a manner that an image corresponding to the image data is formed on the recording medium;

an ejection abnormality detection device which detects ejection abnormality including at least one of non-ejection and ejection direction deviation of the plurality of nozzles;

a compensation device which compensates an image defect caused by the ejection abnormality; and a determination device which determines whether or not the recording head is in a state where the compensation device can compensate the image defect, according to detection result of the ejection abnormality detection device, wherein the compensation device comprises:

a first recording characteristics information acquisition device which acquires first recording characteristics information on the plurality of nozzles from reading result of a first test pattern which is formed on the recording medium by ejecting the ink from the plurality of nozzles of the recording head;

a first density non-uniformity compensation information calculation device which determines first density non-uniformity compensation information from the first recording characteristics information;

a second recording characteristics information acquisition device which acquires second recording characteristics information on the plurality of nozzles from reading result of a second test pattern that is different from the first test pattern and that is formed on the recording medium by ejecting the ink from the plurality of nozzles of the recording head;

a second density non-uniformity compensation information calculation device which determines second density non-uniformity compensation information from the second recording characteristics information;

a third density non-uniformity compensation information calculation device which determines third density non-uniformity compensation information from the first density non-uniformity compensation information and the second density non-uniformity compensation information;

a density compensation processing device which compensates the image data according to the third density non-uniformity compensation information so as to calculate the image data which has been subjected to density non-uniformity compensation; and an ejection control signal calculation device which calculates an ejection pattern of the plurality of nozzles according to the image data which has been subjected to the density non-uniformity compensation.

35. The image forming apparatus as defined in claim 34, further comprising a treatment liquid deposition device which deposits a treatment liquid for aggregating the ink on the recording medium, wherein the recording head ejects the ink onto the recording medium onto which the treatment liquid has been deposited.

36. The image forming apparatus as defined in claim 34, wherein the image is formed on the recording medium in accordance with a single pass recording.

37. The image forming apparatus as defined in claim 34, wherein the ejection abnormality detection device includes an image reading device which reads the image formed on the recording medium by the recording head during conveyance of the recording medium.

38. The image forming apparatus as defined in claim 34, further comprising an information output device which, when determination is made that the recording head is in a state where a compensating effect by the compensation device cannot be expected, outputs information indicating the determination.

39. The image forming apparatus as defined in claim 38, wherein the information output device includes a notification device which notifies a warning for recommending implementation of replacement of the recording head and intensive maintenance.

40. The image forming apparatus as defined in claim 38, wherein the image forming apparatus automatically transfers to a prescribed compulsory maintenance mode according to a signal output from the information output device.

41. A remote monitoring system comprising:

the image forming apparatus as defined in claim 40; and a remote monitoring information management apparatus which serves as the external apparatus that gathers and manages the information obtained by the ejection abnormality detection device of the image forming apparatus.

42. The remote monitoring system as defined in claim 41, further comprising a maintenance service request information generation device which generates information requesting dispatch of a service technician for the image forming apparatus which has been determined to have the recording head in a state where a compensating effect by the compensation device cannot be expected.

43. A method of providing a maintenance service, in which in use of the remote monitoring system as defined in claim 41, a service technician is dispatched and at least one maintenance task of head replacement and intensive maintenance is carried out by the service technician, for the image forming apparatus which is determined to have the recording head in a state where a compensating effect by the compensation device cannot be expected.

44. The image forming apparatus as defined in claim 34, further comprising a communication device which is capable of providing a communication connection with an external apparatus, wherein information obtained by the ejection abnormality detection device can be sent to the external apparatus which is connected in a communicable fashion via the communication device.

45. An image forming method which causes an ink to be ejected from a plurality of nozzles of a recording head onto a recording medium while causing relative movement between the recording medium and the recording head in such a manner that an image is formed on the recording medium, the image forming method comprising:

an ejection abnormality detection step of detecting ejection abnormality including at least one of non-ejection and ejection direction deviation of the plurality of nozzles;

a compensation step of compensating an image defect caused by the ejection abnormality;

a determination step of determining whether or not the recording head is in a state where a compensation effect caused by the compensation step is not expected, according to detection result in the ejection abnormality detection step; and displaying a warning display when the determination step determines that the recording head is in a state where a compensation effect caused by the compensation step is not expected.

46. An image forming method which causes an ink to be ejected from a plurality of nozzles of a recording head onto a recording medium while causing relative movement between the recording medium and the recording head in such a manner that an image is formed on the recording medium, the image forming method comprising:

an ejection abnormality detection step which detects ejection abnormality including at least one of non-ejection and ejection direction deviation of the plurality of nozzles;

a compensation step which compensates an image defect caused by the ejection abnormality; and a determination step which determines whether or not the recording head is in a state where the compensation step can compensate the image defect, according to detection result of the ejection abnormality detection step, wherein the determination step stores number of occurrences of the ejection abnormality which cannot be restored by normal maintenance operation including at least one of wiping of the nozzle surface, preliminary ejection and nozzle suctioning, over elapsed time, and determines that, when the number of occurrences has started to increase and exceeded a specific value, the recording head is in a state where a compensating effect by the compensation step cannot be expected.

47. An image forming method which causes an ink to be ejected from a plurality of nozzles of a recording head onto a recording medium while causing relative movement between the recording medium and the recording head in such a manner that an image is formed on the recording medium, the image forming method comprising:

an ejection abnormality detection step which detects ejection abnormality including at least one of non-ejection and ejection direction deviation of the plurality of nozzles;

a compensation step which compensates an image defect caused by the ejection abnormality; and a determination step which determines whether or not the recording head is in a state where the compensation step can compensate the image defect, according to detection result of the ejection abnormality detection step, wherein the determination step determines that, the recording head is in a state where a compensating effect by the compensation step cannot be expected, when a probability of $8n/(a-n)$ that a position of a nozzle that is next to suffer the ejection abnormality is within four nozzle positions of a nozzle that has already suffered the ejection abnormality reaches b % where t represents a time until one ejection abnormality occurs, a represents total number of the plurality of nozzles, $n=x/t$ represents quantity of the ejection abnormality occurring after a time x, and $0.5 \leqq b \leqq 20$ is satisfied.

48. An image forming method which causes an ink to be ejected from a plurality of nozzles of a recording head onto a recording medium while causing relative movement between the recording medium and the recording head in such a manner that an image is formed on the recording medium, the image forming method comprising:

an ejection abnormality detection step which detects ejection abnormality including at least one of non-ejection and ejection direction deviation of the plurality of nozzles;

a compensation step which compensates an image defect caused by the ejection abnormality; and a determination step which determines whether or not the recording head is in a state where the compensation step can compensate the image defect, according to detection result of the ejection abnormality detection step, wherein the compensation step comprises:

a first recording characteristics information acquisition step which acquires first recording characteristics information on the plurality of nozzles from reading result of a first test pattern which is formed on the recording medium by ejecting the ink from the plurality of nozzles of the recording head;

a first density non-uniformity compensation information calculation step which determines first density non-uniformity compensation information from the first recording characteristics information;

a second recording characteristics information acquisition step which acquires second recording characteristics information on the plurality of nozzles from reading result of a second test pattern that is different from the first test pattern and that is formed on the recording medium by ejecting the ink from the plurality of nozzles of the recording head;

a second density non-uniformity compensation information calculation step which determines second density non-uniformity compensation information from the second recording characteristics information;

a third density non-uniformity compensation information calculation step which determines third density non-uniformity compensation information from the first density non-uniformity compensation information and the second density non-uniformity compensation information;

a density compensation processing step which compensates the image data according to the third density non-uniformity compensation information so as to calculate the image data which has been subjected to density non-uniformity compensation; and an ejection control signal calculation step which calculates an ejection pattern of the plurality of nozzles according to the image data which has been subjected to the density non-uniformity compensation.

* * * * *